US007681631B2

(12) United States Patent
Thomas, Jr. et al.

(10) Patent No.: US 7,681,631 B2
(45) Date of Patent: Mar. 23, 2010

(54) AUTOMATIC FALSE ROTARY

(75) Inventors: Allen Keith Thomas, Jr., Houston, TX (US); Jim Wiens, Willis, TX (US); Michael Hayes, Lafayette, LA (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/943,641

(22) Filed: Nov. 21, 2007

(65) Prior Publication Data

US 2008/0066928 A1 Mar. 20, 2008

Related U.S. Application Data

(63) Continuation of application No. 10/945,544, filed on Sep. 20, 2004, now Pat. No. 7,314,090.

(60) Provisional application No. 60/504,427, filed on Sep. 19, 2003.

(51) Int. Cl.
*E21B 19/02* (2006.01)
*E21B 19/06* (2006.01)

(52) U.S. Cl. ..... 166/77.1; 166/77.51; 166/85.1; 166/378; 166/380

(58) Field of Classification Search ..... 166/77.1, 166/77.51, 85.1, 78.1, 98, 378, 379, 380; 175/85, 423

See application file for complete search history.

(56) References Cited

U.S. PATENT DOCUMENTS 1,541,669 A 6/1925 Summers
2,063,361 A 12/1936 Baash
2,298,507 A 10/1942 Penick et al.
2,589,159 A 3/1952 Stone
2,934,148 A 4/1960 Allaire
3,063,509 A 11/1962 Guier
3,099,323 A 7/1963 Kelley
3,188,708 A 6/1965 O'Haver
3,287,776 A 11/1966 Brown
3,330,354 A 7/1967 Chamblee
3,675,278 A 7/1972 Powell (Continued)

FOREIGN PATENT DOCUMENTS

CA 2 284 428 4/2001

(Continued)

OTHER PUBLICATIONS

Bohrtechnische Ausrustung Und Erfahrungen, Dual Elevator On KTB Rig, pp. 449-450, C-3.1.

(Continued)

*Primary Examiner*—Jennifer H Gay
*Assistant Examiner*—Brad Harcourt
(74) *Attorney, Agent, or Firm*—Patterson & Sheridan, L.L.P.

(57) ABSTRACT

A method and apparatus for remotely performing a pipe handling operation is provided. In one aspect, the method and apparatus includes a false rotary table capable of supporting one or more tubulars during the pipe handling operation which is moveable between a position for landing one or more tubulars to a position for running one or more tubulars into a wellbore. In another aspect, the present invention provides a method and apparatus for remotely connecting elevator links alternatingly between interchangeable elevators which are capable of axially engaging one or more tubulars above the wellbore.

19 Claims, 40 Drawing Sheets

U.S. PATENT DOCUMENTS

| | | | | |
|---|---|---|---|---|
| 3,748,702 | A | 7/1973 | Brown | |
| 4,035,012 | A * | 7/1977 | Guier | 294/90 |
| 4,126,348 | A | 11/1978 | Palmer | |
| RE29,995 | E | 5/1979 | Guier | |
| 4,208,158 | A | 6/1980 | Davies et al. | |
| 4,209,066 | A | 6/1980 | Watson | |
| 4,326,745 | A | 4/1982 | Guier | |
| 4,354,706 | A | 10/1982 | Coyle, Sr. | |
| 4,381,584 | A | 5/1983 | Coyle, Sr. | |
| 4,396,216 | A | 8/1983 | Hamilton | |
| 4,417,846 | A | 11/1983 | Elliston | |
| 4,421,447 | A | 12/1983 | Gudgel et al. | |
| 4,489,794 | A | 12/1984 | Boyadjieff | |
| 4,523,645 | A | 6/1985 | Moore | |
| 4,600,054 | A | 7/1986 | Miller et al. | |
| 4,643,259 | A | 2/1987 | Zeringue, Jr. | |
| 4,715,456 | A * | 12/1987 | Poe et al. | 175/423 |
| 4,800,968 | A | 1/1989 | Shaw et al. | |
| 4,843,945 | A | 7/1989 | Dinsdale | |
| 4,867,236 | A | 9/1989 | Haney et al. | |
| 5,083,356 | A | 1/1992 | Gonzalez et al. | |
| 5,335,756 | A | 8/1994 | Penisson | |
| 5,484,040 | A | 1/1996 | Penisson | |
| 5,609,226 | A | 3/1997 | Penisson | |
| 5,848,647 | A | 12/1998 | Webre et al. | |
| 6,056,060 | A | 5/2000 | Abrahamsen et al. | |
| 6,089,338 | A | 7/2000 | Bouligny, Jr. | |
| 6,131,664 | A | 10/2000 | Sonnier | |
| 6,192,981 | B1 | 2/2001 | Boquet et al. | |
| 6,237,684 | B1 | 5/2001 | Bouligny, Jr. et al. | |
| 6,378,399 | B1 | 4/2002 | Bangert | |
| 6,422,311 | B1 | 7/2002 | Jansch | |
| 6,591,471 | B1 | 7/2003 | Hollingsworth et al. | |
| 6,640,939 | B2 | 11/2003 | Buck | |
| 6,651,737 | B2 | 11/2003 | Bouligny et al. | |
| 6,742,596 | B2 | 6/2004 | Haugen | |
| 6,845,814 | B2 | 1/2005 | Mason et al. | |
| 6,920,931 | B1 | 7/2005 | Webre et al. | |
| 7,043,814 | B2 | 5/2006 | Hollingsworth et al. | |
| 7,044,216 | B2 | 5/2006 | Otten et al. | |
| 7,073,598 | B2 | 7/2006 | Haugen | |
| 7,216,716 | B2 | 5/2007 | Cole et al. | |
| 7,222,677 | B2 | 5/2007 | Webre et al. | |
| 2002/0096337 | A1 * | 7/2002 | Bouligny et al. | 166/379 |
| 2005/0000696 | A1 | 1/2005 | McDaniel et al. | |
| 2006/0108122 | A1 * | 5/2006 | Buytaert et al. | 166/379 |
| 2006/0137884 | A1 * | 6/2006 | Torres | 166/380 |

FOREIGN PATENT DOCUMENTS

| | | |
|---|---|---|
| DE | 198 14 033 | 10/1999 |
| EP | 0 479 583 | 10/1991 |
| FR | 2658972 | 8/1991 |
| GB | 2 014 215 | 8/1979 |
| GB | 2 053 318 | 3/1981 |
| GB | 2 355 030 | 4/2001 |
| WO | WO 99/10674 | 3/1999 |
| WO | WO 01/69034 | 9/2001 |

OTHER PUBLICATIONS

GB Search Report, Application No. GB0724873.5, dated Jan. 24, 2008.

GB Search Report, Application No. GB0724866.9, dated Jan. 18, 2008.

* cited by examiner

AUTOMATIC FALSE ROTARY

CROSS-REFERENCE TO RELATED APPLICATIONS

This application is a continuation of U.S. patent application Ser. No. 10/945,544, filed Sep. 20, 2004, now U.S. Pat. No. 7,314,090, which claims benefit of U.S. provisional patent application Ser. No. 60/504,427, filed Sep. 19, 2003. Each of the aforementioned related patent applications is herein incorporated by reference.

BACKGROUND OF THE INVENTION

1. Field of the Invention

Embodiments of the present invention generally relate to handling tubulars. More specifically, embodiments of the present invention relate to connecting and lowering tubulars into a wellbore.

2. Description of the Related Art

In conventional well completion operations, a wellbore is formed to access hydrocarbon-bearing formations by the use of drilling. In drilling operations, a drilling rig is supported by the subterranean formation. A rig floor of the drilling rig is the surface from which tubular strings, cutting structures, and other supplies are lowered to ultimately form a subterranean wellbore lined with casing. A hole is formed in a portion of the rig floor above the desired location of the wellbore. The axis that runs through the center of the hole formed in the rig floor is well center.

Drilling is accomplished by utilizing a drill bit that is mounted on the end of a drill support member, commonly known as a drill string. To drill within the wellbore to a predetermined depth, the drill string is often rotated by a top drive or rotary table on the drilling rig. After drilling to a predetermined depth, the drill string and drill bit are removed and a section or string of casing is lowered into the wellbore.

Often, it is necessary to conduct a pipe handling operation to connect sections of casing to form a casing string which extends to the drilled depth. Pipe handling operations require the connection of casing sections to one another to line the wellbore with casing. The casing string used to line the wellbore includes casing sections (also termed "casing joints") attached end-to-end, typically by threaded connection of male to female threads disposed at each end of a casing section. To install the casing sections, successive casing sections are lowered longitudinally through the rig floor and into the drilled-out wellbore. The length of the casing string grows as successive casing sections are added.

When the last casing section is added, the entire casing string must be lowered further into its final position in the wellbore. To accomplish this task, drill pipe sections (or "joints") are added end-to-end to the top casing section of the casing string by threaded connection of the drill pipe sections. The portion of the tubular string which includes sections of drill pipe is the landing string, which is located above the portion of the tubular string which is the casing string. Adding each successive drill pipe section to the landing string lowers the casing string further into the wellbore. Upon landing the casing string at its proper location within the wellbore, the landing string is removed from the wellbore by unthreading the connection between the casing string and the landing string, while the casing string remains within the wellbore.

Throughout this description, tubular sections include casing sections and/or drill pipe sections, while the tubular string includes the casing string and the drill pipe string. To threadedly connect the tubular sections, each tubular section is retrieved from its original location on a rack beside the drilling platform and suspended above the rig floor so that each tubular section is in line with the tubular section or tubular string previously disposed within the wellbore. The threaded connection is made up by a device which imparts torque to one tubular section relative to the other, such as a power tong or a top drive. The tubular string formed of the two tubular sections is then lowered into the previously drilled wellbore.

The handling of tubular sections has traditionally been performed with the aid of a spider along with an elevator. Spiders and elevators are used to grip the tubular sections at various stages of the pipe handling operation. In the making up or breaking out of tubular string connections between tubular sections during the pipe handling operation, the spider is typically used for securing the tubular string in the wellbore. Additionally, an elevator suspended from a rig hook is used in tandem with the spider. In operation, the spider remains stationary while securing the tubular string in the wellbore. The elevator positions a tubular section above the tubular string for connection. After completing the connection, the elevator pulls up on the tubular string to release the tubular string from the slips of the spider. Freed from the spider, the elevator may now lower the tubular string into the wellbore. Before the tubular string is released from the elevator, the spider is allowed to engage the tubular string again to support the casing string. After the load of the tubular string is switched back to the spider, the elevator may release the tubular string and continue the makeup process with an additional tubular section.

The elevator is used to impart torque to the tubular section being threaded onto the tubular section suspended within the wellbore by the spider. To this end, a traveling block suspended by wires from a draw works is connected to the drilling rig. A top drive with the elevator connected thereto by elevator links or bails is suspended from the traveling block. The top drive functions as the means for lowering the tubular string into the wellbore, as the top drive is disposed on rails so that it is moveable longitudinally upward and downward from the drilling rig along the rotational axis of well center. The top drive includes a motor portion used to rotate the tubular sections relative to one another which remains rotationally stationary on the top drive rails, while a swivel connection between the motor portion and the lower body portion of the top drive allows the tubular section gripped by the elevator to rotate. The rails help the top drive impart torque to the rotating tubular section by keeping the top drive lower body portion rotationally fixed relative to the swivel connection. Located within the rig floor is a rotary table into or onto which the spider is typically placed.

Recently, it has been proposed to use elevators to perform the functions of both the spider and the elevator in the pipe handling operation. The appeal of utilizing elevators for both functions lies in the reduction of instances of grippingly engaging and releasing each tubular section with the elevator and the spider which must occur during the pipe handling operation. Rather than releasing and gripping repeatedly, the first elevator which is used to grip the first casing section initially may simply be lowered to rest on the hole in the rig floor. The second elevator may then be used to grip the second casing section, and may be lowered to rest on the hole in the rig floor.

To accomplish this pipe handling operation only with elevators, the first elevator must somehow be removed from its location at the hole in the rig floor to allow the second elevator to be lowered to the hole. This removal is typically accomplished by manual labor, specifically rig personnel physically changing the location of the first elevator on the rig floor. Furthermore, the purely elevator pipe handling operation requires attachment of the elevator links to each elevator when it is acting as an elevator, as well as detachment of the elevator links from each elevator when it is acting as a spider. This attachment and detachment is also currently accomplished using manual labor. Manipulation of the elevator links and the elevator by manual labor is dangerous for rig personnel and time consuming, thus increasing well cost.

Manual labor is also used to remove the elevator or elevator slips (described below) when it is desired to lower the tubular, as well as replace the elevator or elevator slips when it is desired to grippingly engage the tubular. Manually executing the pipe handling operation is dangerous to personnel and time consuming, thus resulting in additional overall cost of the well.

Sometimes a false rotary table is mounted above a rig floor to facilitate wellbore operations. The false rotary table is an elevated rig floor having a hole therethrough in line with well center. The false rotary table allows the rig personnel to access tubular strings disposed between the false rotary table and the rig floor during various operations. Without the false rotary table, access to the portion of the tubular string below the gripping point could only be gained by rig hands venturing below the rig floor, which is dangerous and time-consuming. Manual labor is currently used to install and remove the false rotary table during various stages of the operation.

Typically, a spider includes a plurality of slips circumferentially surrounding the exterior of the tubular string. The slips are housed in what is commonly referred to as a "bowl". The bowl is regarded to include the surfaces on the inner bore of the spider. The inner sides of the slips usually carry teeth formed on hard metal dies for grippingly engaging the inside surface of the tubular string. The exterior surface of the slips and the interior surface of the bowl have opposing engaging surfaces which are inclined and downwardly converging. The inclined surfaces allow the slip to move vertically and radially relative to the bowl. In effect, the inclined surfaces serve as a camming surface for engaging the slip with the tubular string. Thus, when the weight of the tubular string is transferred to the slips, the slips will move downwardly with respect to the bowl. As the slips move downward along the inclined surfaces, the inclined surfaces urge the slips to move radially inward to engage the tubular string. In this respect, this feature of the spider is referred to as "self tightening." Further, the slips are designed to prohibit release of the tubular string until the tubular string load is supported by another means such as the elevator. The elevator may include a self-tightening feature similar to the one in the spider.

When in use, the inside surfaces of the currently utilized slips are pressed against and "grip" or "grippingly engage" the outer surface of the tubular section which is surrounded by the slips. The tapered outer surface of the slips, in combination with the corresponding tapered inner face of the bowl in which the slips sit, cause the slips to tighten around the gripped tubular section such that the greater the load being carried by that gripped tubular section, the greater the gripping force of the slips being applied around that tubular section. Accordingly, the weight of the casing string, and the weight of the landing string being used to "run" or "land" the casing string into the wellbore, affects the gripping force being applied by the slips, as the greater the weight of the tubular string, the greater the gripping force and crushing effect on the drill pipe string or casing string.

A significant amount of oil and gas exploration has shifted to more challenging and difficult-to-reach locations such as deep-water drilling sites located in thousands of feet of water. In some of the deepest undersea wells, wells may be drilled from a drilling rig situated on the ocean surface several thousands of feet above the sea floor, and such wells may be drilled several thousands of feet below the sea floor. It is envisioned that as time goes on, oil and gas exploration will involve the drilling of even deeper holes in even deeper water.

For many reasons, the casing strings required for such deep wells must often be unusually long and have unusually thick walls, which means that such casing strings are unusually heavy and can be expected in the future to be even heavier. Additionally, the landing string needed to land the casing strings in such extremely deep wells must often be unusually long and strong, hence unusually heavy in comparison to landing strings required in more typical wells. Hence, prior art slips in typical wells have typically supported combined landing string and casing string weights of hundreds of thousands to over a million pounds, and the slips are expected to require the capacity to support much heavier combined weights of casing strings and landing strings with increasing time.

Prior art slips used in elevators and spiders often fail to effectively and consistently support the combined landing string and casing string weight associated with extremely deep wells because of numerous problems which occur at such extremely heavy weights. First, slips currently used to support heavy combined landing string and casing string weights apply such tremendous gripping force due to the high tensile load that the slips must support that the gripped tubular section may be crushed or otherwise deformed and thereby rendered defective. Second, the gripped tubular section may be excessively scarred and thereby damaged due to the teeth-like grippers on the inside surface of the slips being pressed too deeply into the gripped tubular section. Furthermore, the prior art slips may experience damage due to the heavy load of the tubular string, thereby rendering them inoperable or otherwise damaged.

A related problem involves the often uneven distribution of force applied by the prior art slips to the gripped tubular section. If the tapered outer wall of the slips is not maintained substantially parallel to and aligned with the tapered inner wall of the bowl, the gripping force of the slips may be concentrated in a relatively small portion of the inside wall of the slips rather than being evenly distributed throughout the entire inside wall of the slips, possibly crushing or otherwise deforming the gripped tubular section or resulting in excessive and harmful strain or elongation of the tubular string below the point at which the tubular string is gripped. Additionally, the skewed concentration of gripping force may cause damage to the slips, rendering them inoperable or otherwise damaged. Rough wellbore operations may cause the slips and/or bowl to be jarred, resulting in misalignment and/or irregularities in the tapered interface between the slips and the bowl to cause the uneven gripping force. The uneven distribution of gripping force problem is exacerbated as the weight supported by the slips is increased.

It is therefore desirable to provide a method and apparatus for supporting the weight of the tubular string during pipe handling operations with minimal crushing, deforming, scarring, or stretching-induced elongation of the tubular string. It is further advantageous to provide a fully automated tubular handling and tubular running apparatus and method. There is a further need for apparatus and methods for utilizing a pipe handling system using elevators for the functions of both the elevator and the spider which are safer and more efficient than current apparatus or methods in use.

SUMMARY OF THE INVENTION

In one aspect, embodiments of the present invention provide an apparatus for handling tubulars, comprising at least two elevators for engaging one or more tubular sections, the at least two elevators interchangeable to support one or more tubular sections above a wellbore and to lower the one or more tubular sections into the wellbore; and elevator links attachable to each elevator, wherein the elevator links are remotely transferable between the at least two elevators. In another aspect, embodiments of the present invention include a method of remotely transferring elevator links between at least two elevators, comprising providing elevator links attachable interchangeably to a first elevator and a second elevator; detaching the elevator links from the first elevator by remotely extending a distance between the elevator links; and attaching the elevator links to the second elevator by remotely retracting the distance between the elevator links.

In yet another aspect, embodiments of the present invention include a method of forming and lowering a tubular string into a wellbore using a remotely operated elevator system, comprising providing elevator links attached to a first elevator and a sliding false rotary table located above a rig floor, wherein the false rotary table is disposed in a landing position to axially support a tubular; axially engaging the tubular with the first elevator; locating the first elevator substantially coaxial with the wellbore on the false rotary table; remotely detaching the elevator links from the first elevator; and remotely attaching the elevator links to a second elevator. Embodiments of the present invention also provide a false rotary table disposed above a rig floor for use in handling tubulars, comprising a table slidable over a wellbore; and a hole disposed in the table, wherein the table is slidable by remote activation from a first, pipe-supporting position to a second, pipe-passing position and, in the pipe-supporting position, the hole is located over the wellbore.

Embodiments of the present invention also provide a false rotary table disposed above a rig floor for use in handling tubulars, comprising a base plate having a hole therein disposed above a wellbore; and at least two sliding plates slidably connected to the base plate, wherein the at least two sliding plates are remotely and independently slidable over the base plate to alternately expose the hole or narrow a diameter of the hole. In an additional aspect, embodiments of the present invention provide an apparatus for grabbing an oil-field mechanism, comprising links operatively connected to an oil rig and capable of grabbing the mechanism; and at least one spreading member operatively connected to each link and disposed between the links, the spreading member comprising a motive member, wherein the spreading member is remotely operable.

In one aspect, the present invention provides at least two elevators which support the tubular string with minimal crushing, deforming, scarring, or stretching-induced elongation of the tubular string being engaged by one or more of the at least two elevators. In another aspect, the present invention advantageously provides an apparatus and method for fully automating a tubular handling and tubular running operation involving at least two elevators.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

When referred to herein, the terms "links" and "elevator links" also refer to bails, cables, or other mechanical devices which serve to connect a top drive to an elevator. The term "elevator," as used herein, may include any apparatus suitable for axially and longitudinally as well as rotationally engaging and supporting tubular sections in the manner described herein. The term "tubular section" may include any tubular body including but not limited to a pipe section, drill pipe section, and/or casing section. As used herein, a tubular string comprises multiple tubular sections connected, preferably threadedly connected, to one another. Directions stated below when describing the present invention such as left, right, up, and down are not limiting, but merely indicate movement of objects relative to one another.

Figure 1:
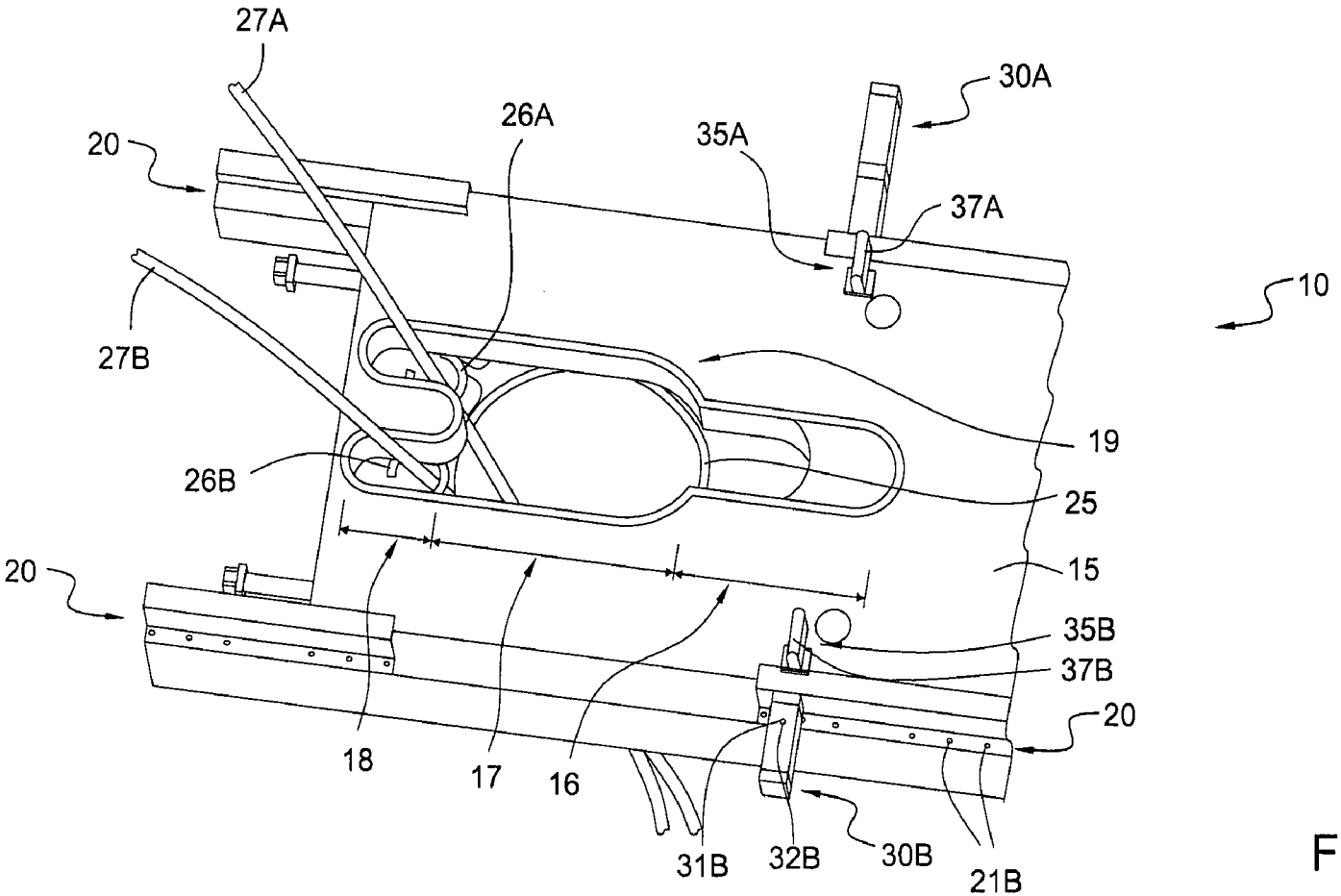
FIG. 1 is a perspective view of a first embodiment of an automated false rotary table in position to run a tubular through the rotary table.

FIG. 1 shows a first embodiment of an automated false rotary table 10 in the position for running one or more tubulars (see FIGS. 3-12) into a wellbore (not shown) below the false rotary table 10. A drilling rig (not shown) is located above the wellbore. The drilling rig has a rig floor (not shown), above which the false rotary table 10 is located.

The automated false rotary table 10 includes a sliding table 15 which is moveably disposed on a track 20. The sliding table 15 is slidable horizontally parallel to the track 20. Most preferably, although not limiting the scope of the present invention, the sliding table 15 is capable of supporting approximately 750 tons of weight thereon.

The sliding table 15 has a hole 19 therein. The hole 19 in the sliding table 15 is shown with three portions, including a narrowed portion 16 having a smaller diameter, a widened portion 17 having a larger diameter relative to the narrowed portion 16, and a control line portion 18. The narrowed portion 16 is utilized to support the weight of one or more tubular sections when an elevator axially and rotationally engaging the one or more tubular sections is landed on the false rotary table 10 (described below). The widened portion 17, which in one preferable embodiment has a width of at least 36 inches, allows the one or more tubular sections to pass through the rotary table 10 after the elevator releases the one or more tubular sections (described below). In FIG. 1, the false rotary is in the position to allow the one or more tubulars to pass through the widened portion 17.

Below the hole 19 in the sliding table 15 is a tubular-shaped support 25. The tubular shape of the support 25 defines a hole beneath the sliding table 15 for passing tubulars through when desired. At any one time, the tubular-shaped support 25 remains substantially co-axial with the wellbore. Disposed on the outer diameter of the tubular-shaped support 25, at the same end of the sliding table 15 as the control line portion 18 of the hole 19, is at least one control line passage, here shown as two control line passages 26A and 26B. The control line portion 18 of the hole 19, in conjunction with control line passages 26A and 26B, which in a preferred embodiment are each two inches by five inches, permit control lines 27A and 27B to travel through the automated false rotary table 10 without damage due to crushing the control lines 27A and 27B while passing through the elevator (described below). The control lines 27A and 27B may be dispensed from a spool (not shown) located at, above, or below the rig floor while running the tubular to and/or through the hole 19 in the sliding table 15. The control lines 27A and 27B, which may also include cables or umbilicals, may be utilized to operate downhole tools (not shown) or, in the alternative, to send signals from downhole to the surface for measuring wellbore or formation conditions, e.g. using fiber optic sensors (not shown). Any number of control lines 27A-B may be employed with the present invention having any number of corresponding control line passages 26A-B. The control line portion 18 of the hole 19 in the sliding table 15 may be of any shape capable of accommodating the number of control lines 27A-B employed. As shown in FIGS. 1-12, the control line portion 18 includes a forked area with two separate hole areas, but it is contemplated that the present invention may fork into any number of separate hole areas to allow protected, unimpeded passage of any number of control lines 27A-B.

Brackets 30A and 30B are connected to the track 20 on opposing sides of the sliding table 15. The brackets 30A and 30B are not connected to the sliding table 15, and thus the sliding table 15 is moveable with respect to the brackets 30A and 30B and the track 20 (described below). The brackets 30A and 30B are shown connected to the track 20 by one or more pins 32A, 32B inserted through holes 31A and 31B in the brackets 30A and 30B and through holes (not shown), 21B disposed in the track 20. The brackets 30A and 30B may be connected to the track 20 by any other method or apparatus known to those skilled in the art.

Each bracket 30A, 30B is connected at one end to one or more hydraulic lines (not shown) which introduce pressurized fluid thereto. At the opposite end of each bracket 30A, 30B from the hydraulic line is an elevator retainer assembly 35A, 35B. The elevator retainer assembly 35A, 35B functions to retain an elevator in position on the false rotary table 10 at various stages in the operation. As shown, each elevator retainer assembly 35A, 35B includes a piston 36A, 36B disposed within a cylinder 37A, 37B, and the pistons 36A and 36B are moveable inward toward one another in response to remote actuation due to fluid pressure supplied from the hydraulic line. Alternatively, the elevator retainer assembly 35A, 25B may include a piston/cylinder assembly actuated by a biasing spring, or the elevator retainer assembly 35A, 35B may extend to engage the elevator due to electronic actuation. The elevator retainer assembly 35A, 35B may include any other mechanism suitable for retaining an elevator which may be remotely actuated. Although two brackets 30A and 30B having an elevator retainer assembly 35A, 35B on each are shown, it is contemplated for purposes of the present invention that one bracket may be sufficient to adequately retain the elevator.

Figure 2:
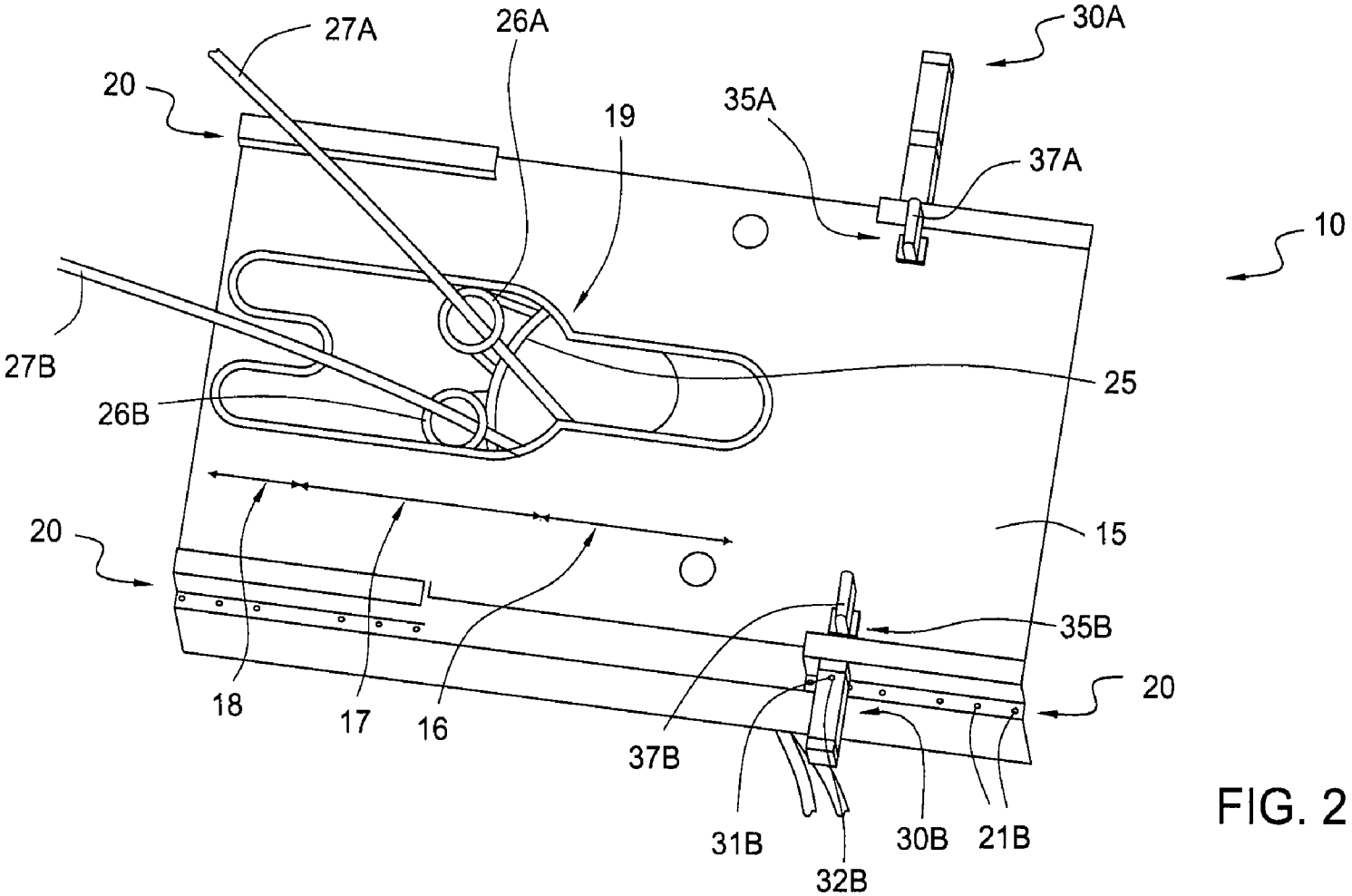
FIG. 2 is a perspective view of the automated false rotary table of FIG. 1 in position to land a tubular on the rotary table for the threading of additional tubulars thereon.

FIG. 2 shows the false rotary table 10 in the position for landing one or more tubular sections on the sliding table 15. A piston and cylinder assembly (not shown) may be utilized to remotely actuate the sliding motion of the sliding table 15 over the track 20 to the position to land tubulars on the narrowed portion 16 of the hole 19 in the sliding table 15. The piston and cylinder assembly includes a piston moveable from a cylinder in response to the introduction of pressurized fluid (hydraulic or pneumatic) behind the piston to move the sliding table 15. Alternatively, the sliding table 15 may be remotely moved by electric means or mechanical means such as a biasing spring. FIG. 2 illustrates that the track 20, the connected brackets 30A and 30B, and the tubular-shaped support 25 remain stationary relative to one another and the rig floor while the sliding table 15 moves in the direction shown by the arrows.

Figure 3:
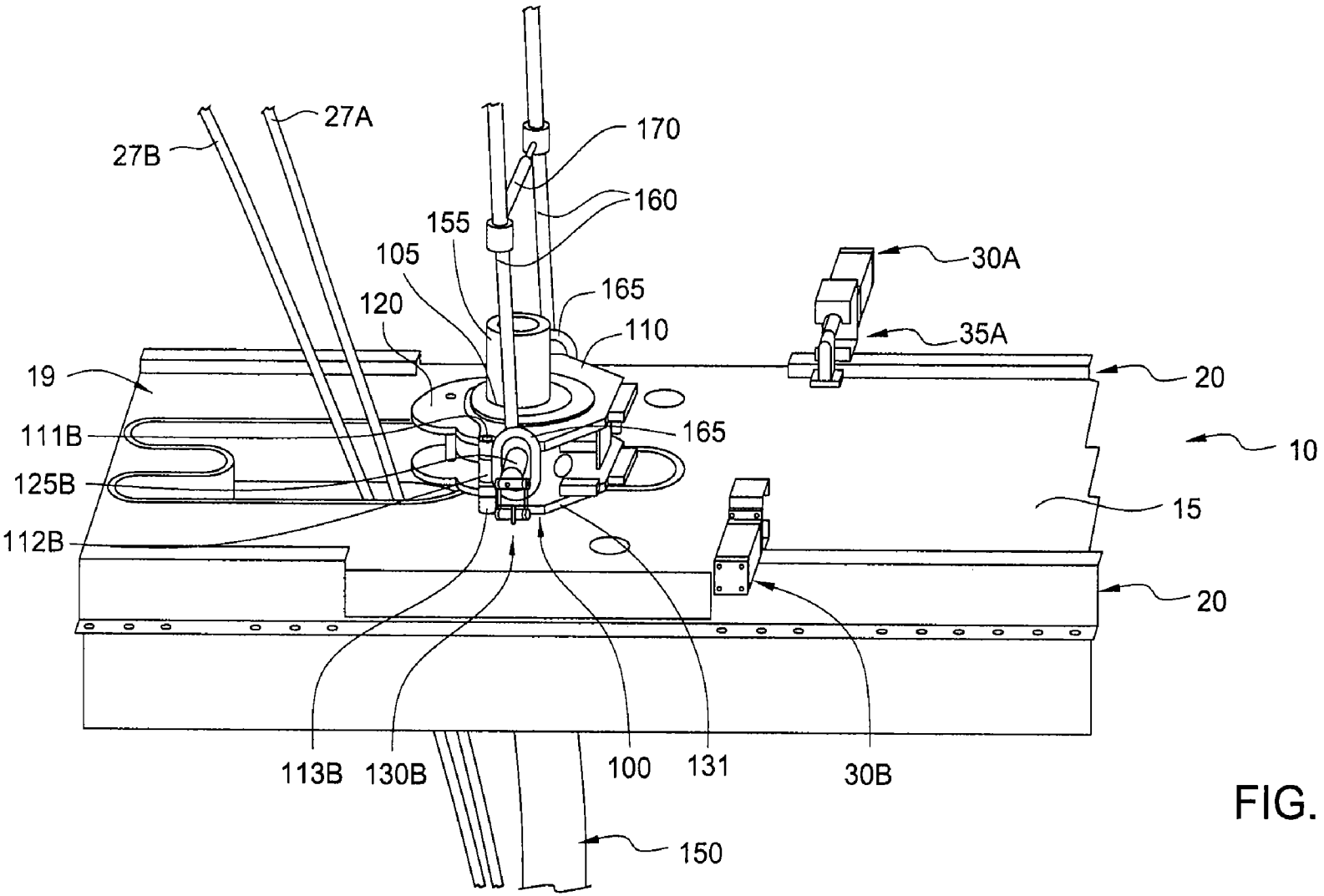
FIG. 3 shows the automated false rotary table of FIG. 2 with a first tubular section landed on the false rotary table with a first elevator.

FIG. 3 shows the automated false rotary table 10 in the position for landing one or more tubulars shown in FIG. 2. A first elevator 100 is shown landed on the narrowed portion 16 (see FIG. 2) of the hole 19 in the sliding table 15. The first elevator 100 is preferably a door-type elevator having a supporting portion 110 pivotably connected to a door portion 120. As shown, each side of the door portion 120 adjacent to each side of the supporting portion 110 is connected by pins 111B and (other side not shown) through holes 112B and (other side not shown) to holes 113B and (other side not shown) extending through the supporting portion 110 above and below the door portion 120.

Figure 5:
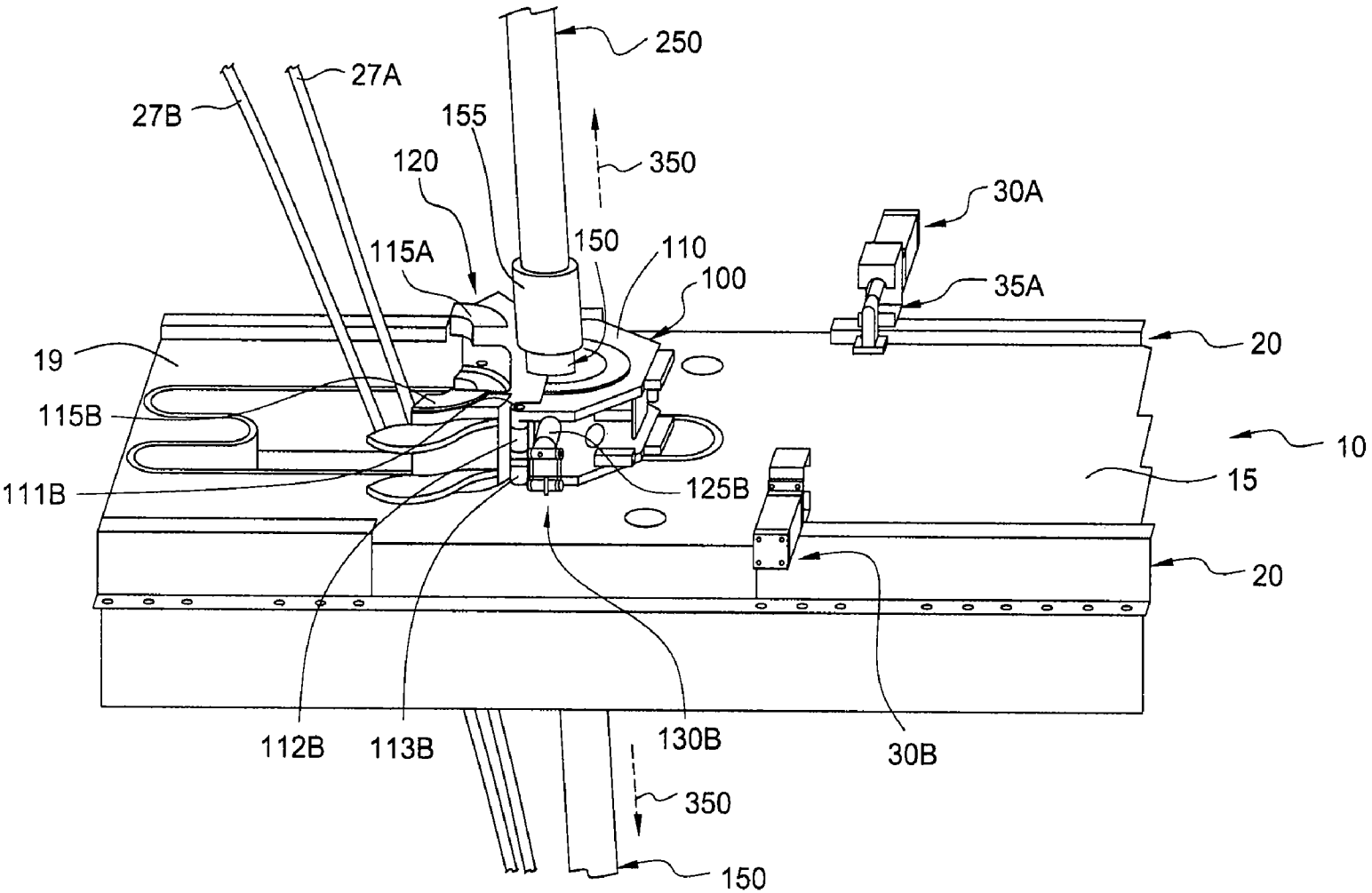
FIG. 5 shows the automated false rotary table of FIG. 2 with the first elevator in an open position.

The door portion 120 includes a first jaw 115A and a second jaw 115B, as shown in FIG. 5. The first and second jaws 115A and 115B are pivotable outwards in opposite directions from one another to the position shown in FIG. 5. The first jaw 115A is pivotable around the first pin (not shown), while the second jaw 115B is pivotable around the second pin 111B to open the "door" to the first elevator 100 to insert a tubular in the exposed bore of the first elevator 100, as shown in FIG. 5, or to close the "door" to the first elevator 100 to retain a tubular, as shown in FIG. 3.

Referring again to FIG. 3, mounted on opposing sides of the supporting portion 110 of the first elevator 100 are lifting ears (not shown) and 125B. An elevator link retainer assembly (not shown) and 130B is attached to and extends from each lifting ear (not shown) and 125B, as described below in relation to FIGS. 13-16.

The first elevator 100 is shown in FIG. 3 axially and rotationally engaging a first tubular section 150. The first tubular section 150 is axially engaged below female threads 155, also called a shoulder. The first elevator 100 has an inner surface 105 which corresponds to the outer surface of the female threads 155 to allow the tubular body portion of the first tubular section 150 to run downward through the first elevator 100, but to prevent the female threads 155, or the upset portion of the first tubular section 150, to continue through the first elevator 100. The corresponding inner surface 105 negates the need for damaging slips or wedges in the first elevator 100 to prevent the first tubular section 150 from slipping through the first elevator 100. A typical tubular section includes female threads on one end (often termed the "box end") and male threads on the opposite end (often termed the "pin end"). To connect tubular sections to one another to form a tubular string, the male threads are threaded onto the female threads (described below). The threaded connection of male and female threads, often termed a "coupling", serves as the shoulder below which the first elevator 100 may be located to help hoist the first tubular section 150 and to retain the first tubular section 150 in position at various stages of the operation. The first tubular section 150 shown in FIG. 3 illustrates the female threads 155, but male threads (not shown) also exist at a lower end of the first tubular section 150.

Also shown in FIG. 3 are elevator links 160. The elevator links 160 have elevator link retainers 165 at their lower ends. The elevator link retainers 165 are loops that are shaped to be disposable around the lifting ears 125B, (not shown) of the first elevator 100 when desired. The elevator links 160 are preferably spaced from one another at a distance so that the elevator links 160 extend straight downward from the top drive (described below) when engaging the lifting ears 125B, (not shown).

The elevator links 160 are connected at their upper ends to a top drive (not shown). The top drive is used to rotate a tubular section relative to another tubular section or tubular string which is engaged by the elevator to thread the tubular sections to one another and form a tubular string (see description of process below). The top drive extends from a draw works (not shown), which extends from the drilling rig by a winch (not shown). The top drive is moveable vertically relative to the drilling rig on vertical tracks (not shown). Connected to each elevator link 160 is one end of a corresponding piston within a cylinder ("piston/cylinder assembly"). Each piston/cylinder assembly is connected at its other end to opposing sides of the top drive to allow the elevator links 160 to pivot outward radially from well center upon extension of the pistons from the cylinders through remote actuation. An assembly including a top drive, an elevator with links attached to the top drive, and pistons and cylinders to pivot the links relative to the top drive which may be utilized in one embodiment with the present invention is described in commonly-owned U.S. Pat. No. 6,527,047 B1 issued on Mar. 4, 2003, which is herein incorporated by reference in its entirety. Alternatively, the elevator links 160 may be pivoted towards and away from in line with the top drive by any other means, including mechanical and electrical.

The elevator links 160 of FIG. 3 also possess a spreading member such as a link spreader 170 between the two elevator links 160 and connecting the two elevator links 160 to one another. In the retracted position, the link spreader 170 holds the elevator links 160 at a distance from one another relatively equal to the distance between opposing outer surfaces of the first elevator 100 so that the elevator link retainers 165 loop around the lifting ears 125B, (not shown) to lift the first elevator 100 in this position. In the extended position, the link spreader 170 spreads the elevator links 160 to a distance outward from one another sufficient to extend the elevator link retainers 165 out of engagement with the lifting ears 125B, (not shown). The link spreader 170 includes a motive member to provide a driving impetus for its spreading and retracting action. Preferably, the link spreader 170 is a piston and cylinder assembly. The piston and cylinder assembly includes a piston within a cylinder which may be remotely actuated by introducing pressurized fluid (pneumatic or hydraulic fluid) behind the piston to extend the piston from the cylinder and remotely deactuated by reducing fluid pressure behind the piston. The pressurized fluid may be introduced behind the piston using a hydraulic line (not shown). Extension of the piston from the cylinder spreads the elevator links 160 outward from the bore axis of the first elevator 100 to disengage the elevator links 160 from the first elevator 100. Extension or retraction of the piston from the cylinder may also be accomplished by a biasing torsion spring used with a piston and cylinder assembly, as well as by electronic means. While the link spreader 170 is shown as a piston and cylinder assembly in FIG. 3, it may include any other mechanism capable of remote actuation to spread and retract the elevator links 160.

Figure 4:
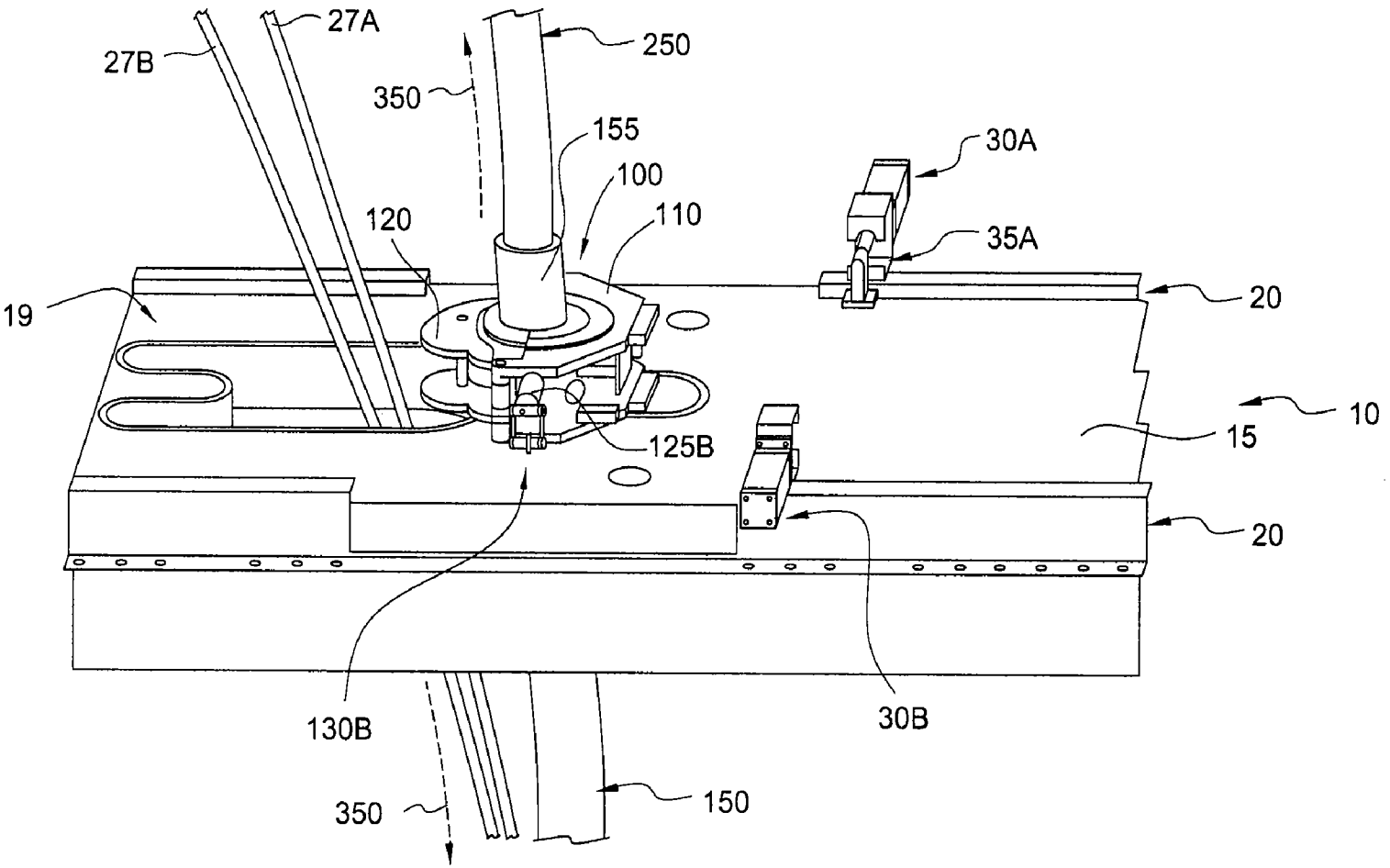
FIG. 4 shows the automated false rotary table of FIG. 2 with a second tubular section threaded onto the first tubular section.

FIG. 4 shows the first elevator 100 axially engaging the first tubular section 150 at its female threads 155 and a second tubular section 250 threaded onto the first tubular section 150. The first tubular section 150 threaded to the second tubular section 250 forms a tubular string 350.

Figure 9:
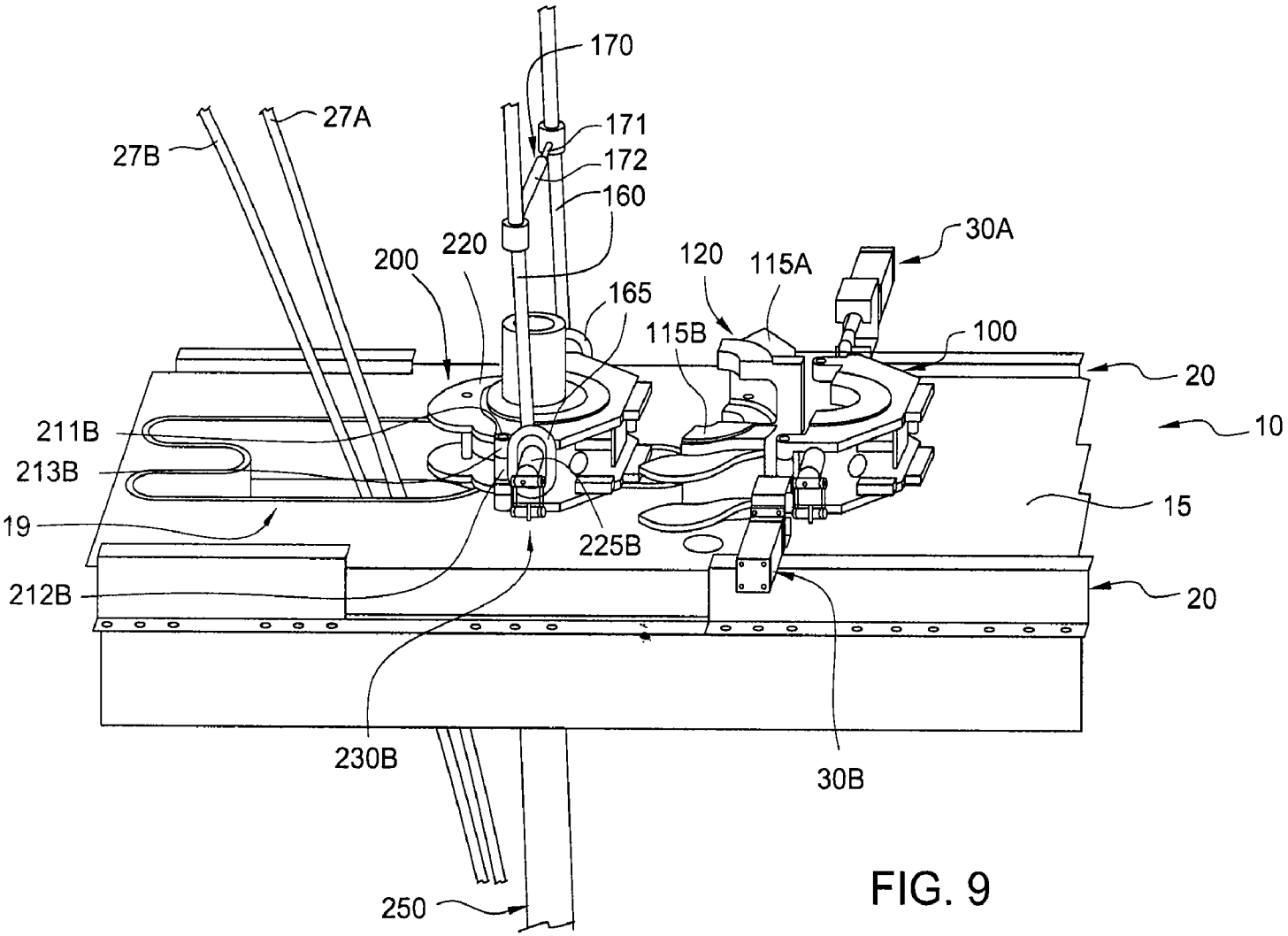
FIG. 9 shows a second elevator landed on the automated false rotary table with the second tubular section.

FIG. 9 depicts a second elevator 200. The second elevator 200 is substantially identical to the first elevator 100; therefore, elements of the first elevator 100 designated by the "100" series are designated by the "200" series for substantially identical elements of the second elevator 200.

In operation, the automated false rotary table 10 is initially disposed in the position for landing tubulars shown in FIG. 2 before the tubular running operation commences. The piston/cylinder assembly (not shown) pivotably connecting the top drive and the elevator links 160 may be activated to pivot the elevator links 160 radially outward relative to the top drive to allow the first elevator 100 to pick up the first tubular section 150 from a location away from well center (typically tubular sections are picked up from a rack). The door portion 120 of the first elevator 100 is in the open position (see FIG. 5) initially until the first tubular section 150 is placed within the first elevator 100 so that the first elevator 100 is below the female threads 155 of the first tubular section 150. The jaws 115A and 115B of the door portion 120 are then are then moved to the closed position remotely, e.g., by introducing pressurized fluid behind a piston within a cylinder to pivot jaws 115A and 115B inward towards one another. Alternatively, the jaws 115A and 115B may be opened and closed by a biasing spring mechanism or electrical means. The tubular section 150 is axially and rotationally engaged by the first elevator 100 upon closing the jaws 115A and 115B, as the female threads 155, which are seated in the corresponding inner surface 105 of the first elevator 100, define an upset portion of the tubular section 150 which cannot pass through the narrower hole within the first elevator 100 which exists below the inner surface 105 corresponding to an outer surface of the shoulder (the female threads 155). Deactivation of the piston/cylinder assembly connecting the top drive and the elevator links 160 pivots the elevator links 160, along with the connected first elevator 100 and engaged first tubular section 150, into substantial co-axial alignment with the top drive and the narrowed portion 16 of the hole 19 in the sliding table 15.

The top drive is then lowered by movement along its rails so that the first elevator 100 is lowered into contact with the sliding table 15, as shown in FIG. 3. While the elevator 100 is being lowered, prior to contacting the first elevator 100 with the sliding table 15, the elevator link retainers 165 are disposed around the lifting ears 125B, (not shown) of the first elevator 100, and the first elevator link retainer assemblies 130B, (not shown) are pivoted to hold the elevator link retainers 165 into position on the lifting ears 125B, (not shown). FIG. 3 shows the next step in the operation. Upon contact of the first elevator 100 with the sliding table 15, the link retainer assemblies 130B, (not shown) pivot and release the elevator link retainers 165 so that they are free to move outward from the lifting ears 125B, (not shown) of the first elevator 100. FIG. 3 shows the elevator link retainers 165 released from engagement with the lifting ears 125B, (not shown).

The link spreader 170 is then activated to extend the first elevator links 160 outward relative to one another. When using a piston/cylinder assembly as the link spreader 170, fluid pressure behind the piston extends the piston from the cylinder, thereby spreading the elevator links 160. The extension of the elevator links 160 from one another to an appropriate distance allows the elevator links 160 to clear the lifting ears 125B, (not shown) when the top drive is moved upward along its rails. FIG. 4 shows the first elevator 100 located on the sliding table 15 with the first tubular section 150 engaged therein and the elevator links 160 removed from the first elevator 100.

At this point in the operation, the elevator links 160 are pivoted radially outward relative to the top drive by the piston/cylinder assembly pivotably connecting the elevator links 160 to the top drive to pick up a second elevator 200 (see FIG. 9) by its lifting ears 225B, (not shown). To pick up the second elevator 200, the elevator links 160 are moved so that the elevator link retainers 165 are disposed adjacent to and around the lifting ears 225B, (not shown) of the second elevator 200 to straddle the lifting ears 225B, (not shown). The link spreader 170 is deactivated to reduce the distance between the elevator links 160 and place the elevator link retainers 165 over the lifting ears 225B, (not shown). As the elevator links 160 are brought together, the elevator link retainers 165 pivot to the closed position. The second elevator 200 is then lifted and the elevator link retainer latches 230B, (not shown) are released to pivot and lock the elevator link retainers 165 into place on the lifting ears 225B, (not shown).

The second elevator 200, now connected to the elevator links 160, is then pivoted using the piston/cylinder assembly connected to the top drive to pick up a second tubular section 250 (see FIG. 4). To pick up the second tubular section 250, the second elevator 200 acts substantially as described above in relation to the first elevator 100 picking up the first tubular section 150, specifically by opening the door portion 220 by pivoting the first and second jaws 215A and 215B outward relative to one another and closing the jaws 215A and 215B around the second tubular section 250 below the female threads 255 (see FIG. 9) to engage the second tubular section 250. As shown in FIG. 9, each side of the door portion 220 adjacent to each side of a supporting portion is connected by pins 211B and (other side now shown) through holes 212B and (other side not shown) to holes 213B and (other side not shown) extending through the supporting portion above and below the door portion 220.

The piston/cylinder assembly is next deactivated to retract the piston within the cylinder, thereby pivoting the second tubular section 250 to well center, so that the second tubular section 250 is substantially coaxial with the top drive and the first tubular section 150. The top drive is lowered on its tracks to place the male threads (not shown) of the second tubular section 250 into contact with the female threads 155 of the first tubular section 150. The top drive then rotates the second tubular section 250 relative to the first tubular section 150 to thread the second tubular section 250 onto the first tubular section 150. During the threading of the tubular sections 150 and 250, the first elevator 100 engages the first tubular section 150 axially and rotationally, while the second elevator 200 engages the second tubular section 250 axially and rotationally. The top drive has a swivel connection below its motor to allow rotational movement of the lower portion of the top drive. FIG. 4 illustrates the second tubular section 250 threadedly connected to the first tubular section 150 to form the tubular string 350.

Because the second elevator 200 is now engaging the entire tubular string 350, the first elevator 100 may be released from its engagement with the first tubular string 150 without dropping the first tubular string 150 into the hole 19 through the sliding table 15 and into the wellbore (not shown) below. To begin the lowering operation of the tubular string 350 into the wellbore, the second elevator 200 is moved upward longitudinally by the top drive moving upward along its track. This upward movement of the tubular string 350 initially disengages the first elevator 100 from the upset portion of the tubular string 350, or the female threads 155 of the first tubular section 150.

The door portion 120 of the first elevator 100 is then moved to the open position to disengage the tubular section 150 from the first elevator 100. As described above, the jaws 115A and 115B are pivoted away from one another by pivoting the jaws 115A and 115B around the pins (not shown) and 111B. This movement may be actuated by one or more piston/cylinder assemblies or any other known method of remote actuation. FIG. 5 shows the first elevator 100 disengaged from engagement with the tubular string 350 and the tubular string 350 raised upward relative to the first elevator 100. The second elevator 200 (not shown in FIG. 5) is engaging the tubular string 350.

Next, the sliding table 15 is slidingly moved along its track 20 to the right into the position for running tubulars through the false rotary table 10, as shown and described in relation to FIG. 1. The sliding table 15 is moved so that the first elevator 100 and the narrowed portion 16 of the hole 19 in the sliding table 15 do not interfere with the tubular string 350 and its female threads 155 being lowered below the sliding table 15. The sliding table 15 is slid by remote actuation. One type of remote actuation which may be utilized includes a piston/cylinder assembly (not shown), where the piston is moveable from the cylinder to extend the sliding table 15 in one direction upon introduction of pressurized fluid behind the piston within the cylinder or by a biasing spring. Other types of remote actuation are contemplated for use in sliding the sliding table 15 which are known by those skilled in the art.

The brackets 30A and 30B and the range of sliding motion of the sliding table 15 on the track 20 are preferably configured so that sliding the sliding table 15 to the right as far as possible positions holes (not shown) in the first elevator 100 which correspond with the pistons 36A and 36B (see FIG. 6) adjacent to the pistons 36A and 36B of the brackets 30A and 30B. When sliding the sliding table 15 to the right at this stage of the operation, the first elevator 100 in its open position remains in its place on the sliding table 15 and slides with the sliding table 15. The control lines 27A and 27B, the tubular string 350, the tubular-shaped support 25 beneath the sliding table 15, the track 20, and the brackets 30A and 30B attached to the track remain stationary relative to the sliding table 15 and the first elevator 100.

Figure 6:
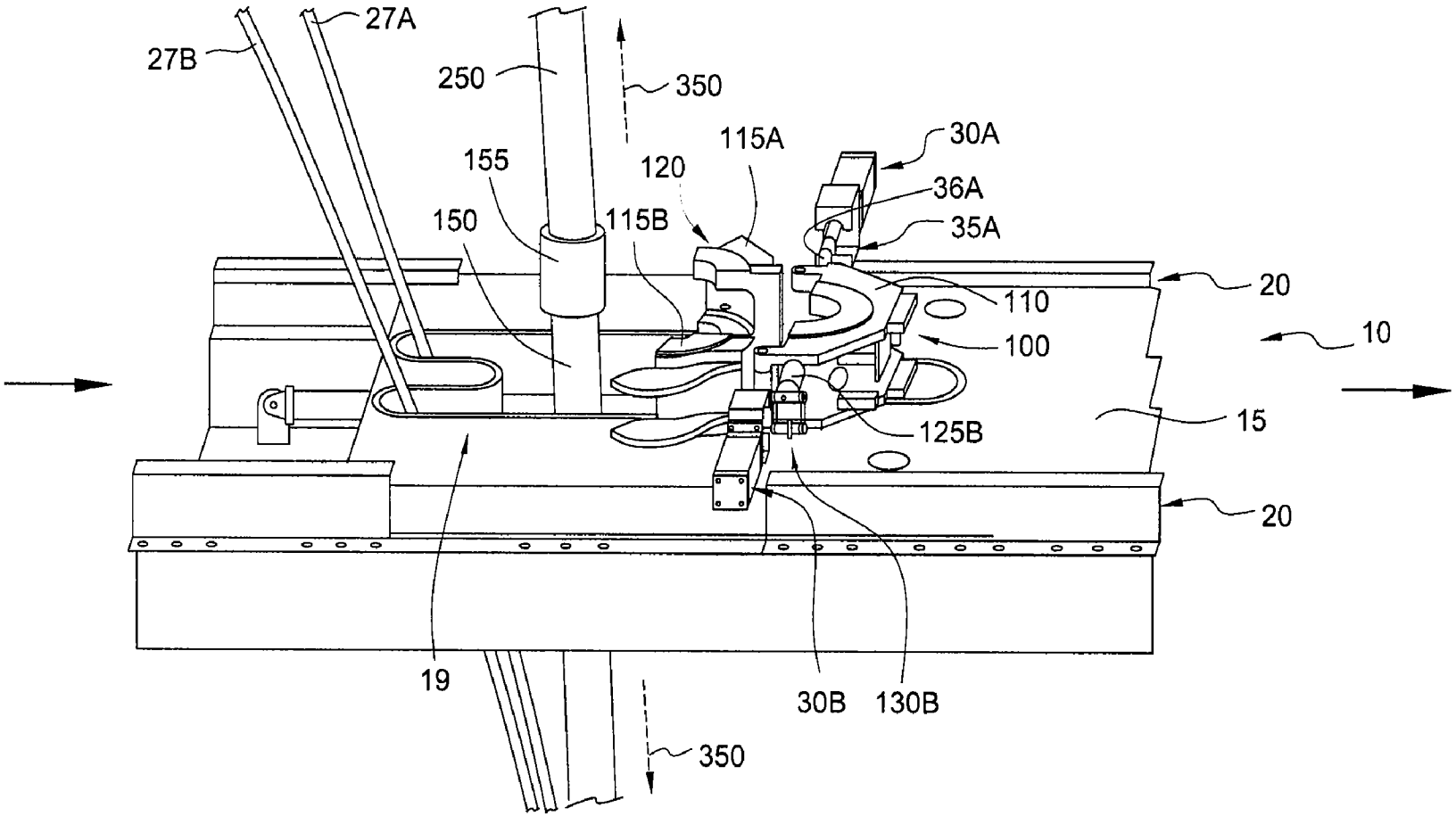
FIG. 6 shows the automated false rotary table moved to the position shown in FIG. 1.

As shown in FIG. 6, upon sliding the sliding table 15 to the right, the control lines 27A and 27B change from their location within the widened portion 17 of the hole 19 in the sliding table 15 into within the control line portion 18 of the hole 19. The tubular string 350 changes from its location within the narrowed portion 16 to within the widened portion 17. The first elevator 100 moves to a location between the brackets 30A and 30B.

Figure 7:
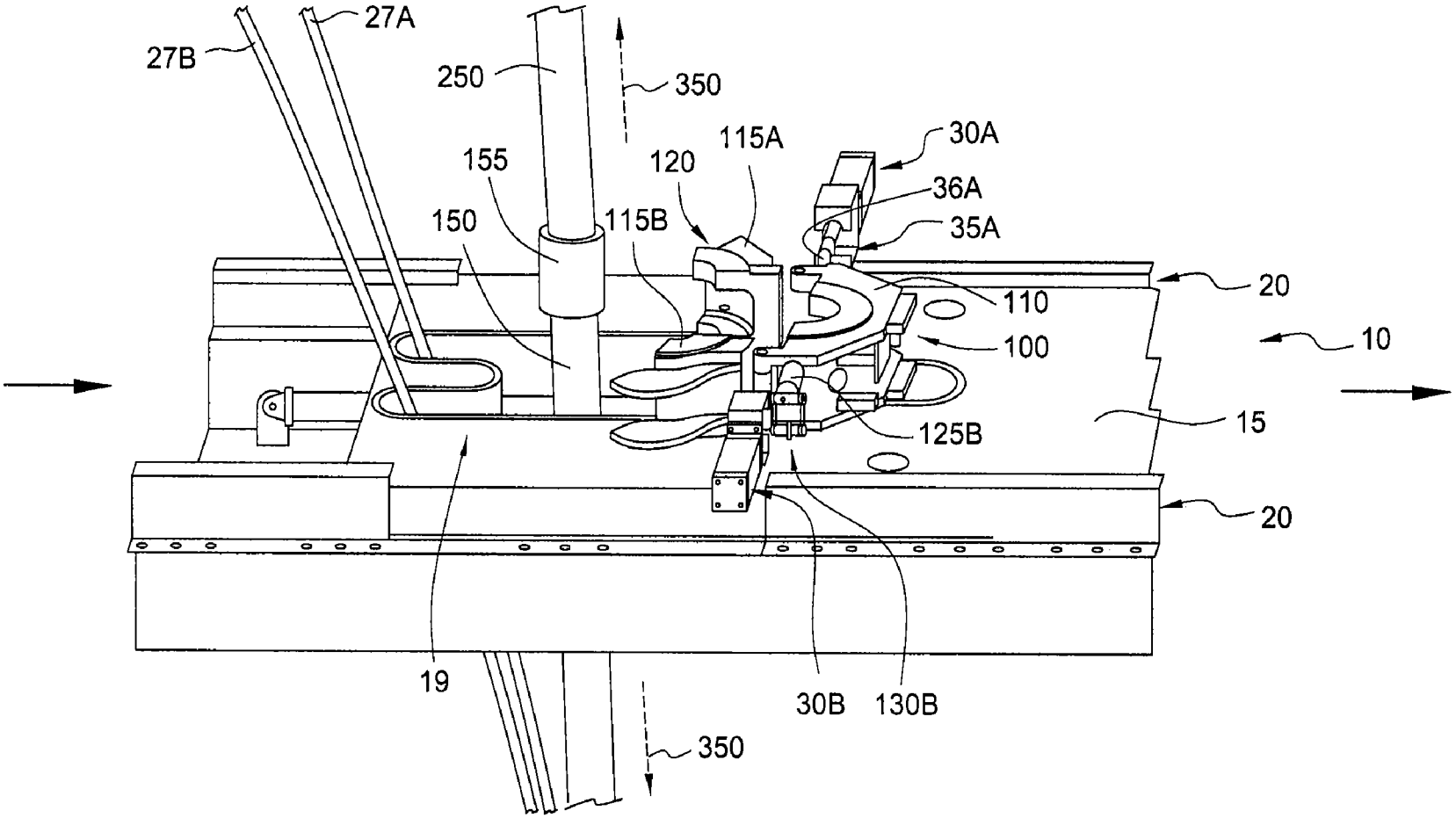
FIG. 7 shows the first elevator fixed relative to a sliding table of the automated false rotary table.
Figure 8:
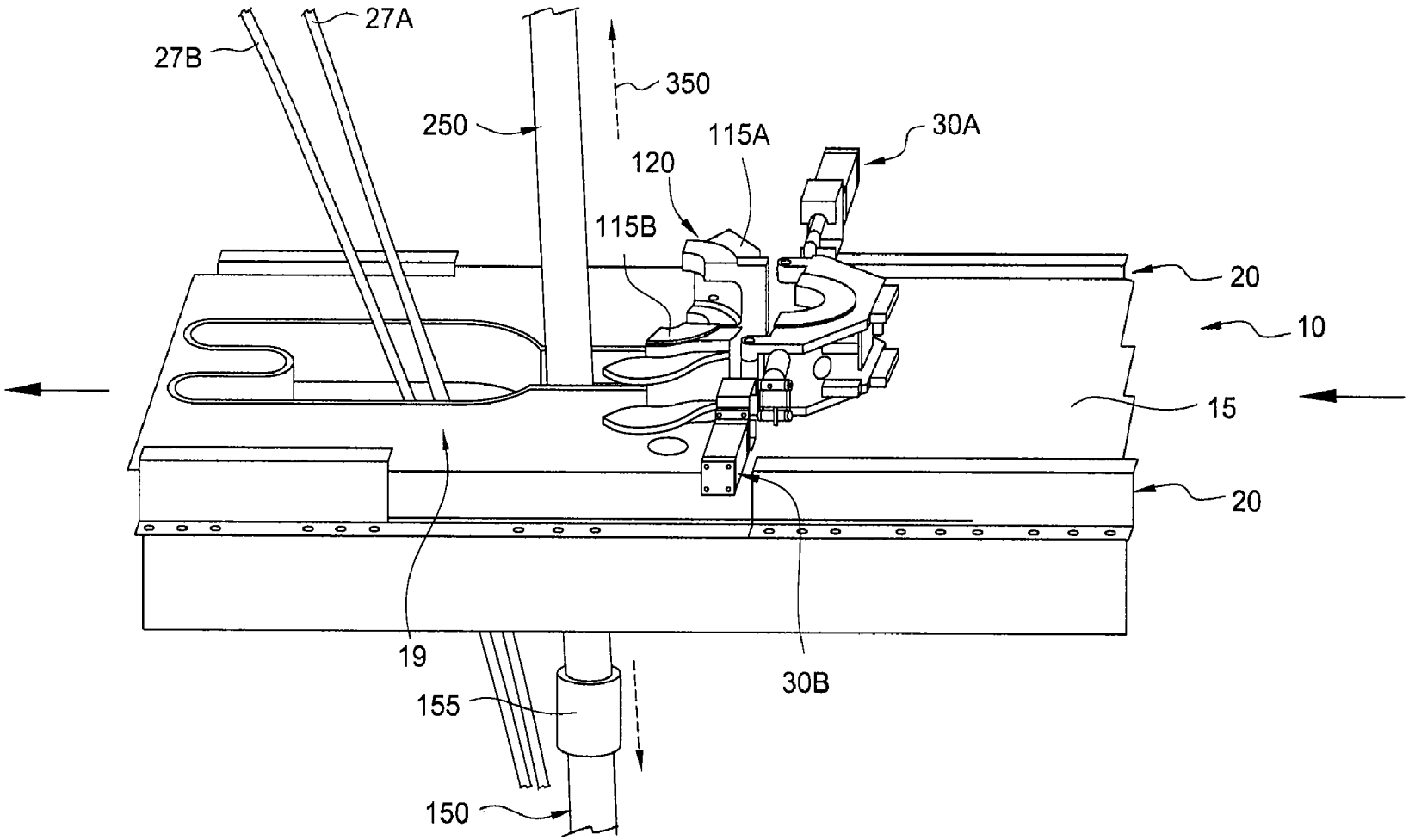
FIG. 8 shows the second tubular section lowered through the automated false rotary table and the automated false rotary table moved back to the position for landing tubulars shown in FIG. 2.

After sliding the sliding table 15 to the right, the first elevator is retained in position by remotely activating the elevator retaining assemblies 35A, 35B. When using pistons 36A, 36B and cylinders 37A, 37B as the elevator retaining assemblies 35A, 35B, pressurized fluid is introduced behind the pistons 36A and 36B within the cylinders 37A and 37B to force the pistons 36A and 36B inward towards the first elevator 100 and into corresponding retaining pin holes (not shown) in the outer surface of the first elevator 100. FIG. 7 illustrates the elevator retaining assemblies 35A and 35B disposed within the retaining pin holes (not shown) to lock the first elevator 100 and prevent it from sliding movement.

The top drive is then moved downward along its rails so that the tubular string 350 is lowered through the widened portion 17 of the hole 19 in the sliding table 15 and through the support 25. The control lines 27A and 27B may be simultaneously lowered with the tubular string 350 through the control line portion 18 of the hole 19 and the control line passages 26A and 26B (shown in FIG. 1). After the female threads 155 of the tubular string 350 are lowered through the widened portion 17, the first tubular section 150 running portion of the operation is finished; therefore, the sliding table 15 is remotely actuated as described above to slide the sliding table 15 back into the landing position shown in FIG. 2 to allow an additional tubular section (not shown) to be added to the tubular string 350. When the sliding table 15 is moved back to the landing position, the first elevator 100 remains in the parked position due to the elevator retainer assemblies 35A and 35B retaining the first elevator 100 in a stationary position on the track 20. The sliding table 15 slides under the first elevator 100 to the position shown in FIG. 8. The tubular string 350, control lines 27A and 27B, and support 25 again remain stationary while the sliding table 15 moves to the left along the track 20. The control lines 27A and 27B return to their location within the widened portion 17, while the tubular string 350 returns to its location within the narrowed portion 16 so that the sliding table 15 may support the weight of the tubular string 350.

After slidingly moving the sliding table 15 back to the tubular landing position, the tubular string 350 is lowered through the narrowed portion 16 until the second elevator 200 lands on the sliding table 15. The second elevator 200 operates in substantially the same manner as described above in relation to the first elevator 100 in FIG. 3, so that the link retainer latches 230B, (not shown) of the second elevator 200 are pivoted from engagement with the elevator link retainers 165, permitting movement of the elevator links 160 outward from the lifting ears 225B, (not shown) of the second elevator 200. FIG. 9 shows the second elevator 200 landed on the narrowed portion 16 of the sliding table 15 and the elevator links 160 rendered free to move outward from the lifting ears 225B, (not shown).

Figure 10:
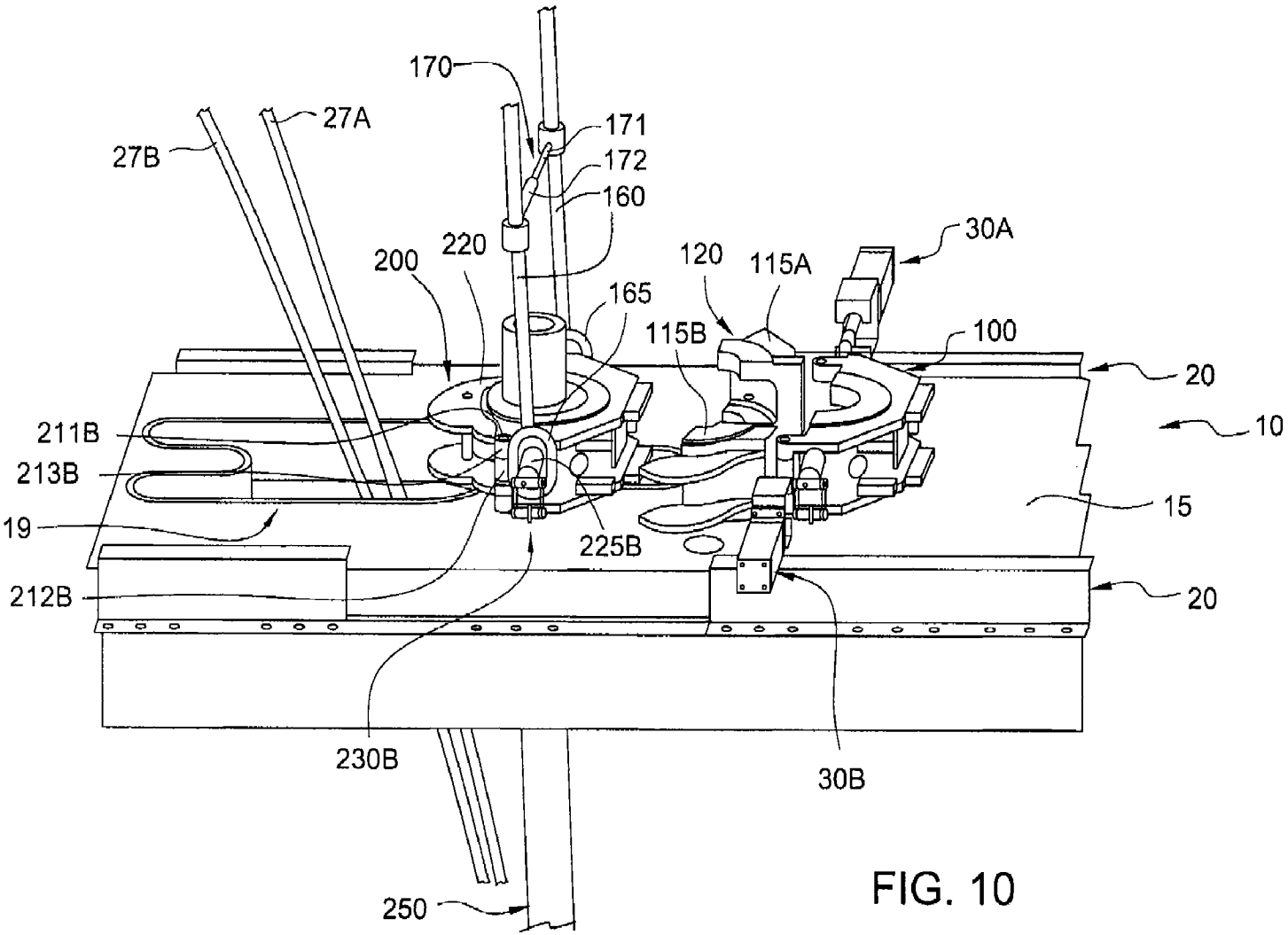
FIG. 10 shows the automated false rotary table of FIG. 9 with the second elevator and the second tubular section landed on the automated false rotary table. Elevator links are shown detached from the second elevator.

FIG. 10 illustrates the next step in the operation which was described above in relation to the first elevator 100. The link spreader 170 is remotely and automatically actuated so that the elevator links 160 are moved outward to define a larger distance relative to one another. FIG. 10 shows the piston 171 moved outward from the cylinder 172 of the link spreader 170 in one embodiment of the present invention. The elevator link retainers 165 may now clear the lifting ears 225B, (not shown) as the top drive moves upward along its rails and separates the elevator links 160 from the second elevator 200.

Figure 11:
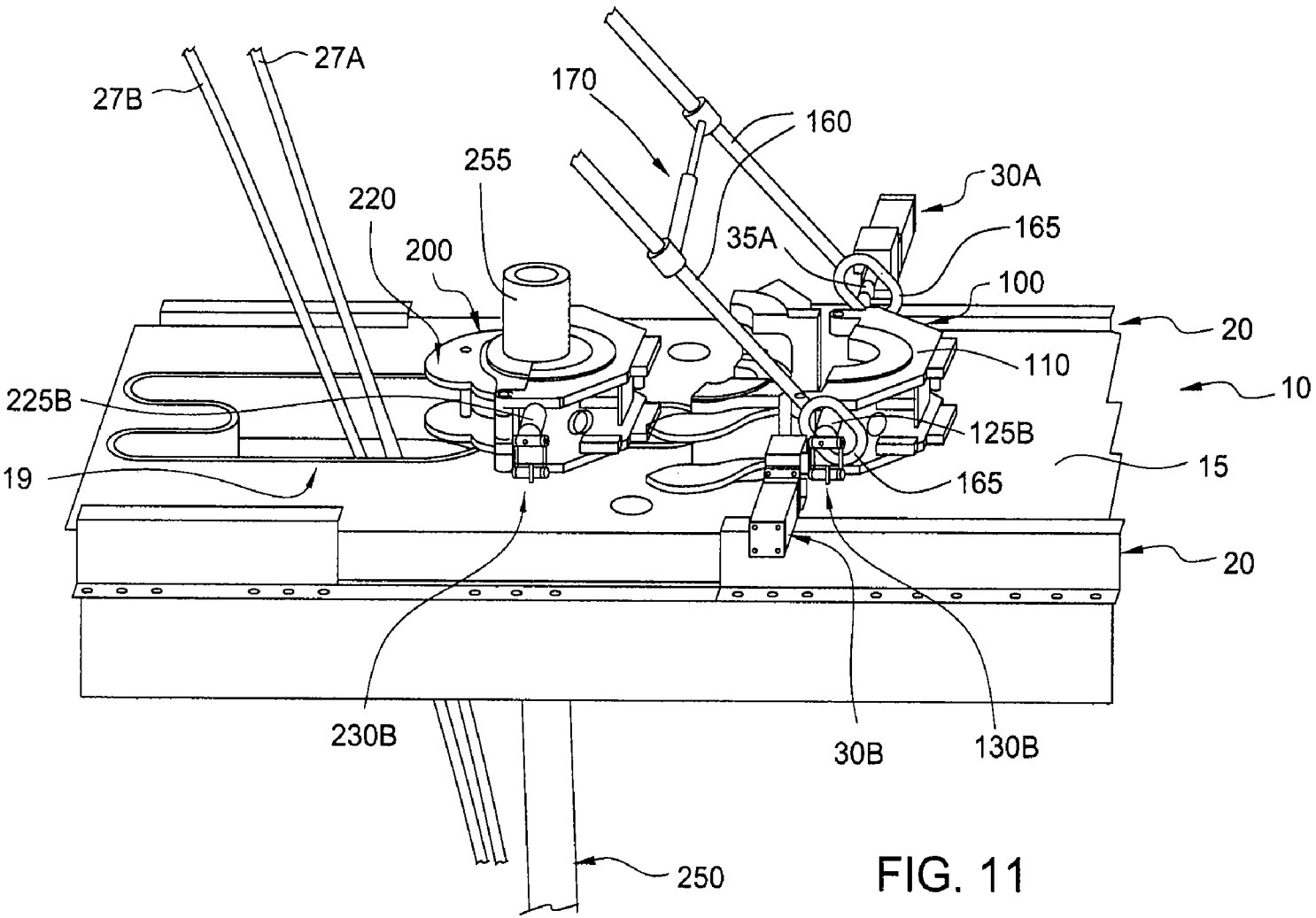
FIG. 11 shows the false rotary table in the position of FIG. 9. The elevator links are tilted and placed around the first elevator.

At this point in the operation, the second elevator 200 supports the weight of the tubular string 350 by preventing the female threads 255 of the second tubular section 250 from lowering through the bore of the second elevator 200 and through the sliding table 15. The elevator links 160 are pivoted outward, as described above, by the piston/cylinder assembly pivotably connecting the top drive to the elevator links 160. While the link spreader 170 still spreads the elevator links 160 outward from one another, the elevator link retainers 165 are placed adjacent to the lifting ears 125B, (not shown) of the first elevator 100 to straddle the first elevator 100. FIG. 11 shows the link spreader 170 extending the elevator links 160 and the elevator link retainers 165 disposed adjacent to the lifting ears 125B, (not shown).

Figure 12:
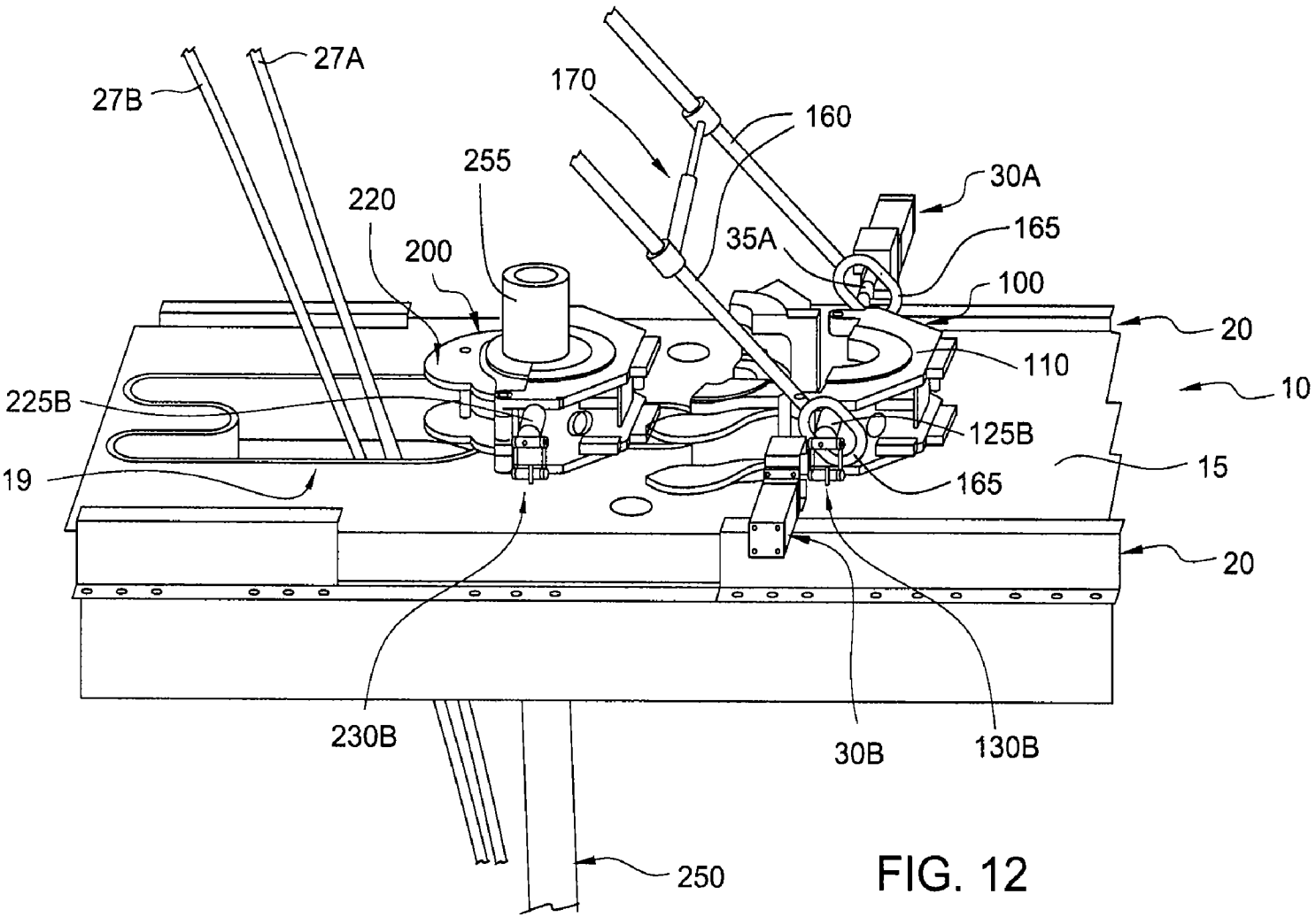
FIG. 12 shows the false rotary table in the position shown in FIG. 9. The elevator links are attached to the first elevator.

The link spreader 170 is then deactivated to retract the piston 171 back into the cylinder 172 so that the elevator link retainers 165 loop around the lifting ears 125B, (not shown) to latch onto the first elevator 100. The elevator link retainer latches 130B, (not shown) automatically pivot to latch around the elevator link retainers 165, as described below, to retain the first elevator 100 with the elevator links 160. FIG. 12 shows the elevator links 160 connected to the first elevator 100.

The first elevator 100 is then lifted by the top drive moving upward on its rails and is pivoted as needed to pick up a third tubular section (not shown), as described above. Also as described above, the door portion 120 of the first elevator 100 is closed around the third tubular section and the elevator links 160 are pivoted back to coaxial alignment with the top drive above the second tubular section 250. The threaded connection between the third tubular section and the second tubular section 250 is made up and the operation repeated with subsequent tubular sections, interchanging the first and second elevators 100 and 200 repeatedly, as desired.

FIGS. 13-16 show the operation of the link retainer assembly 130B. The link retainer assembly of the other side (not shown) operates in substantially the same manner. The link retainer assembly 130B includes a link retainer latch 186. The upper end of the link retainer latch 186 has a cut-out portion 187, into which a protruding portion 188 of the elevator lifting ear 125B is placed. Link retainer arms 180 are rigidly mounted to outer opposing surfaces of the link retainer latch 186, substantially perpendicular to the link retainer latch 186 to form an "L-shape". The link retainer latch 186 and the link retainer arms 180 are pivotable with respect to the lifting ear 125B, around the protruding portion 188. A torsion spring 181 extends through the link retainer latch 186 and the protruding portion 188 of the lifting ear 125B to bias the link retainer latch 186 upward when the elevator link retainer assembly 130B is in the "open" position (see FIG. 16).

Figure 13:
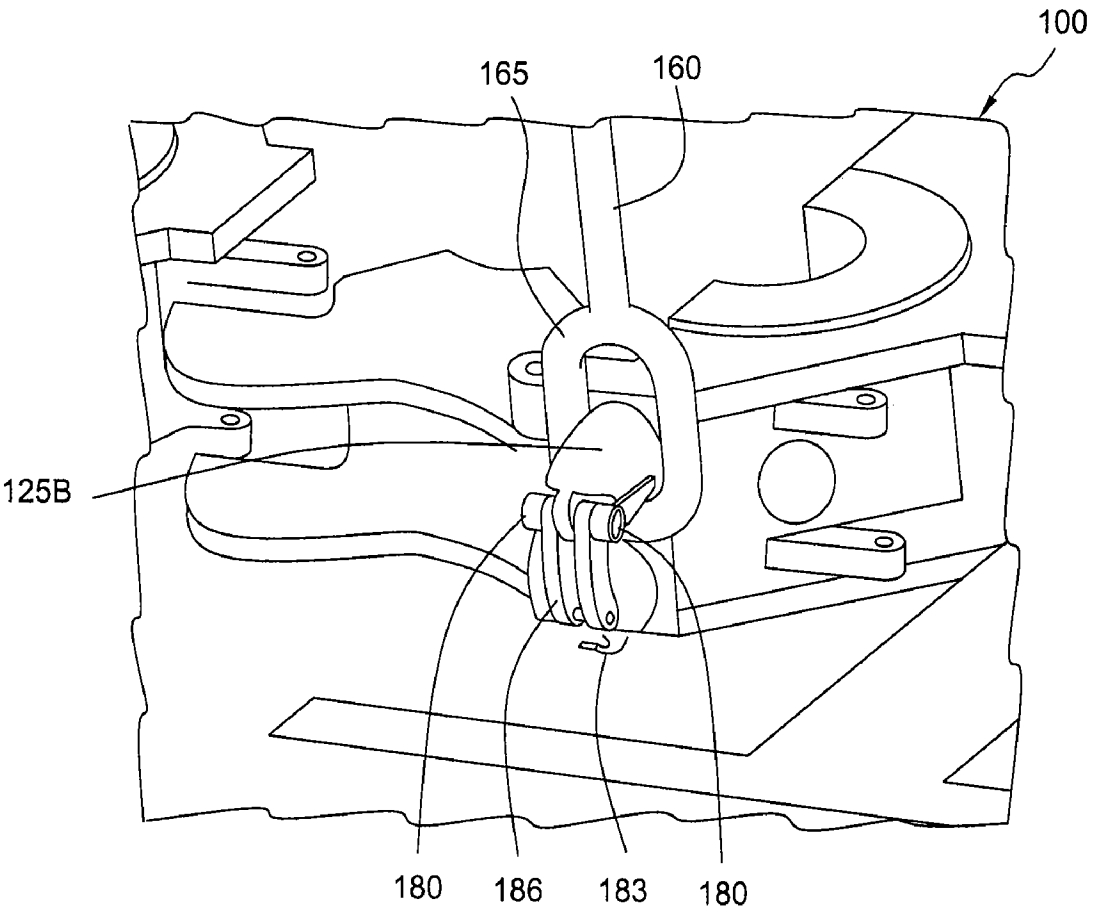
FIG. 13 shows the elevator link retainer assembly of the embodiment in FIGS. 1-12.

As best seen in FIG. 13, the link retainer latch 186 also has a cut-out portion 189 at its lower end, so that the link retainer latch 186 essentially forms an "H-shape". A pin 182 extends through holes in a lower portion of the link retainer latch 186 and through the cut-out portion 189 between holes in the link retainer latch 186.

Figure 16:
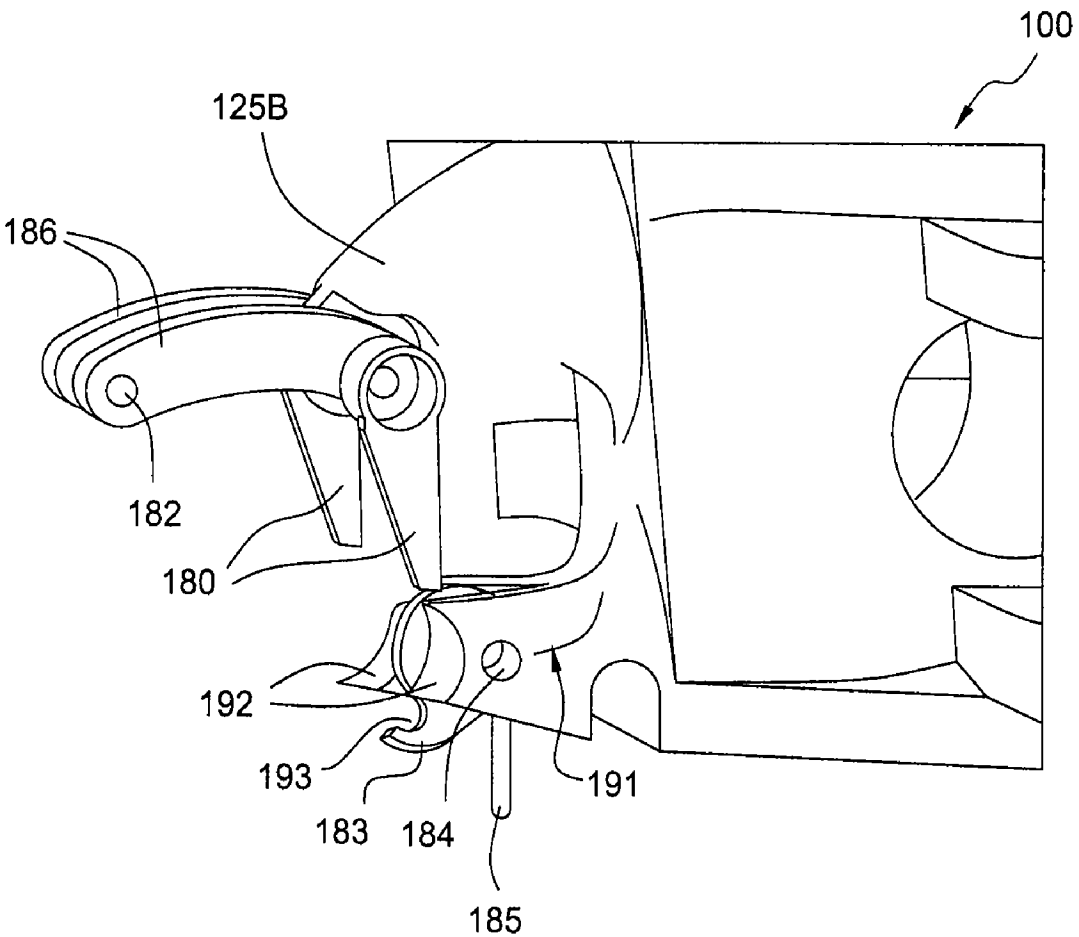
FIG. 16 shows the elevator link retainer assembly of FIG. 13 in the open position.

Referring especially to FIG. 16, elevator extensions 190 protrude outward from a lower portion of the elevator 100 substantially in line with and below the lifting ear 125B. The elevator extensions 190 and the lifting ear 125B, along with an outer surface of the elevator 100, form a cavity 191 for housing the lower portion of the elevator link retainers 165 (see FIG. 13). The elevator extensions 190 each have curved outer surfaces 192 shaped to receive the curved outer surfaces of the arms of the link retainer latch 186. Disposed between the elevator extensions is a link retainer lock 183. The link retainer lock 183 is shaped has a hook portion which defines a cavity 193 shaped to essentially conform around the pin 182. The link retainer lock 183 is pivotable around the elevator extensions 190. A torsion spring 184 extends through holes in the elevator extensions and the link retainer lock 183 to bias the link retainer lock 183 upward when the elevator link retainer assembly 130B is in the "closed" position. A pin 185 extends downward from the link retainer lock 183, and is moveable upward and downward with respect to the elevator 100.

In the closed position of the elevator link retainer assembly 130B, the link retainer latch 186 is pivoted downward over the elevator link retainer 165, as shown in FIG. 13. Also as shown in FIG. 13, the elevator link retainer 165 is looped around the lifting ear 125B, so that the lower inside surface of the loop of the elevator link retainer 165 engages a lower surface of the lifting ear 125B. Although not shown, the curved outer surfaces of the arms of the link retainer latch 186 engage the curved outer surfaces 192 of the elevator extensions 190. The link retainer lock 183 is pivoted upward relative to the elevator extensions 190 so that the cavity 193 is hooked around the pin 182 within the cut-out portion 189 of the link retainer latch 186 to lock the link retainer latch 186 into place. The pin 185 extends downward to its most extended position.

Figure 14:
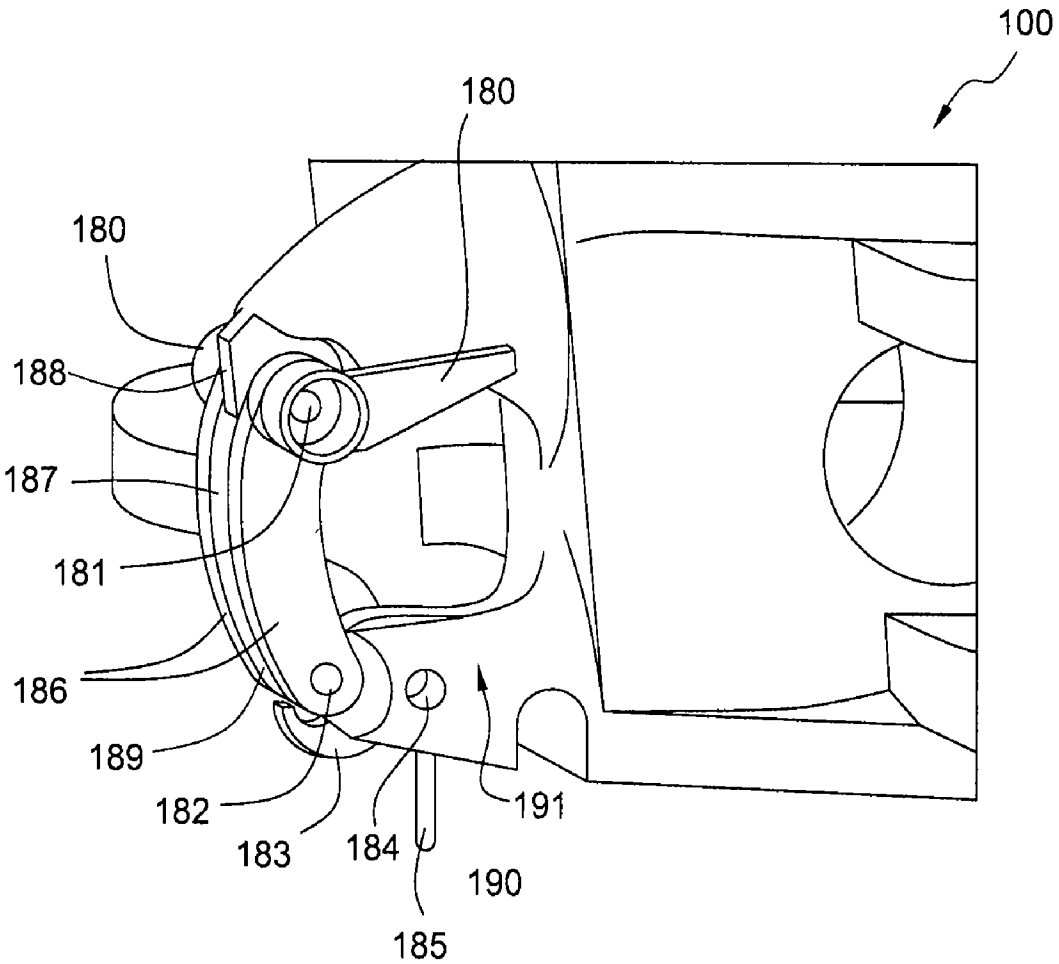
FIGS. 14-15 show the elevator link retainer assembly of FIG. 13 moving from the closed position to the open position.

When the elevator 100 is lowered so that the base plate 131 of the elevator 100 lands on the automated false rotary table 10, the pin 185 is forced upward into the elevator 100. The upward motion of the pin 185 pushes the back end (not shown) of the link retainer lock 183 upward, thus counteracting the bias of the torsion spring 184 to pivot the hook portion of the link retainer lock 183 downward around the elevator extensions 190. Rotating the hook portion of the link retainer lock 183 downward unhooks the link retainer lock 183 from the pin 182, as shown in FIGS. 13 and 14. FIG. 13 shows the elevator link retainer 165 within the elevator link retainer assembly 130B. The elevator link retainer 165 is extracted from FIG. 14 for ease of viewing in describing the elements of the elevator link retainer assembly 130B.

Figure 15:
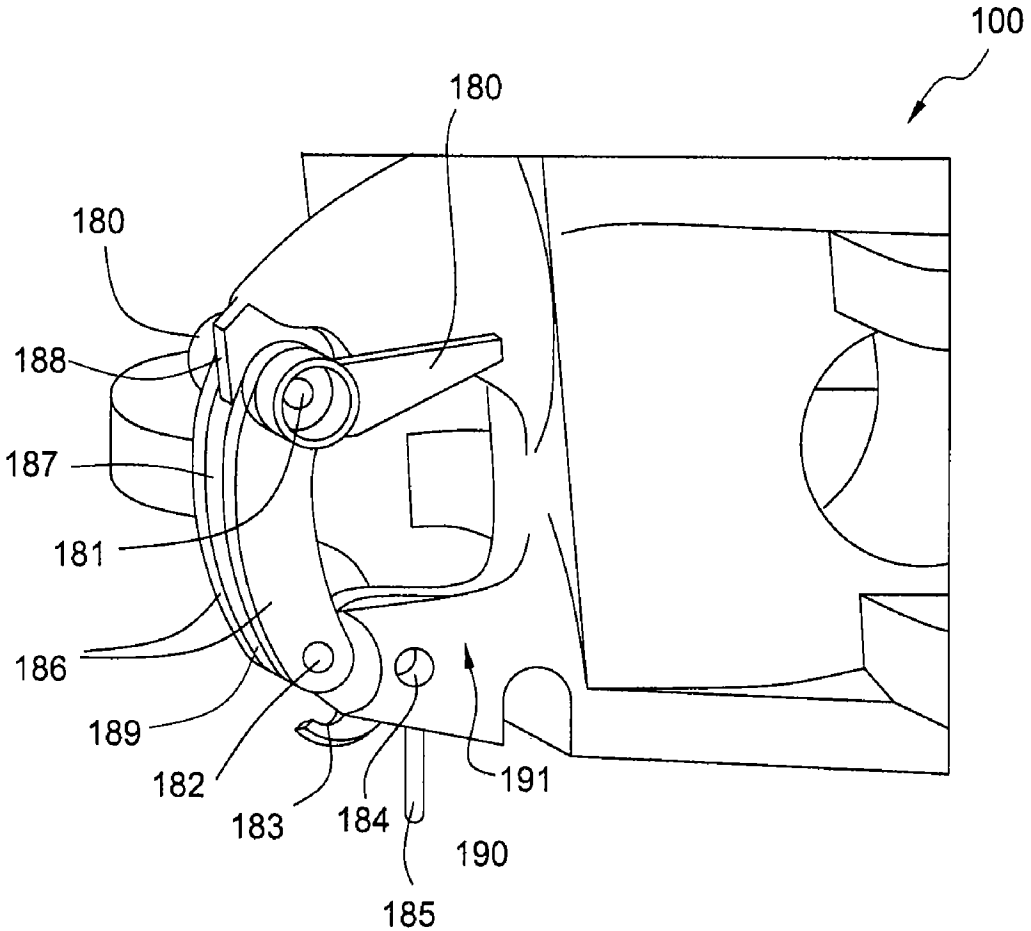

When the hook portion of the link retainer lock 183 releases the pin 182, the link retainer latch 186 is forced to pivot upward and outward relative to the lifting ear 125B by the upward bias of the torsion spring 181, as shown in FIG. 15. The link retainer latch 186 pivots to its full range of motion, as shown in FIG. 16, and the elevator link retainer 165 is free to move outward from the cavity 191 when the link spreader 170 extends the elevator links 160 outward from the lifting ears 125B, (not shown). FIG. 16 shows the elevator link retainer assembly 130B in the open position, as the pin 185 counteracts the bias of the torsion spring 184 and the torsion spring 181 biases the link retainer latch outward.

To close the link retainer assembly 130B, the elevator links 160 are placed over the elevator 100 to straddle the elevator 100, with the elevator link retainers 165 adjacent to the elevator lifting ears 125B, (not shown). Referring to FIG. 16 (which does not show the elevator link retainers 165 for ease of viewing), the elevator link retainers 165 are forced inward relative to one another when the link spreader 170 is retracted. The elevator link retainers 165 counteract the bias of the torsion spring 181 when the elevator link retainers 165 push against the link retainer arms 180. The link retainer arms 180 are forced inward within the cavity 191, and the attached link retainer latch 186 pivots downward relative to the lifting ear 125B around the elevator link retainer 165, as shown in FIG. 13. The elevator 100 is then lifted by the elevator links 160, which are engaged with the elevator 100 by the elevator link retainers 165 being looped around the lifting ears 125B, (not shown). The upward movement of the base plate 131 of the elevator 100 relative to the false rotary table 10 allows the pin 185 to again extend to its most extended position from the base plate 131, allowing the torsion spring 184 to again bias the hook portion of the link retainer lock 183 upward into engagement with the pin 182, so that the elevator link retainer assembly 130B, (not shown) is again in the closed position.

While the above description of FIGS. 13-16 relates to the elevator 100, it is understood that the description applies equally to the operation and elements of the elevator 200. Furthermore, while the link retainer assemblies 30B and (not shown) are opened and closed due to action of biasing springs 181 and 184, the opening and closing may be accomplished by any other mechanical means known to those skilled in the art or by electrical means, as well as by one or more fluid-actuated piston and cylinder assemblies (including hydraulic or pneumatic piston and cylinder assemblies).

Figure 17:
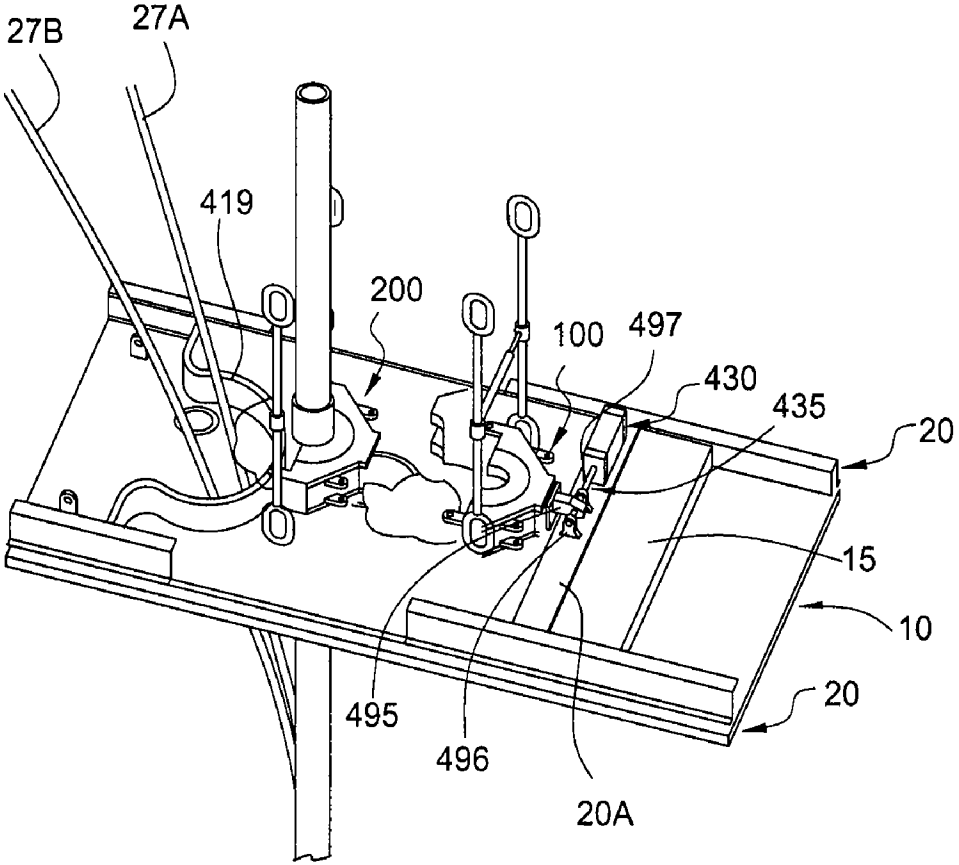
FIG. 17 shows an alternate embodiment of the automated false rotary table.

FIG. 17 shows an alternate configuration of the first embodiment of the present invention. This embodiment is configured and operates in substantially the same manner as described above in relation to FIGS. 1-16, except for the hole 19 in the automated false rotary table 10 and the brackets 30A and 30B of FIGS. 1-16. The hole 419 in the automated false rotary table 10 is open all the way to the left end of the sliding table 15, and the hole 419 does not include a control line portion 18. This embodiment of the sliding table 15 may prevent any damage to the control lines 27A and 27B which may result from the control lines 27A, 27B hitting the edge of the hole 19.

Figure 18:
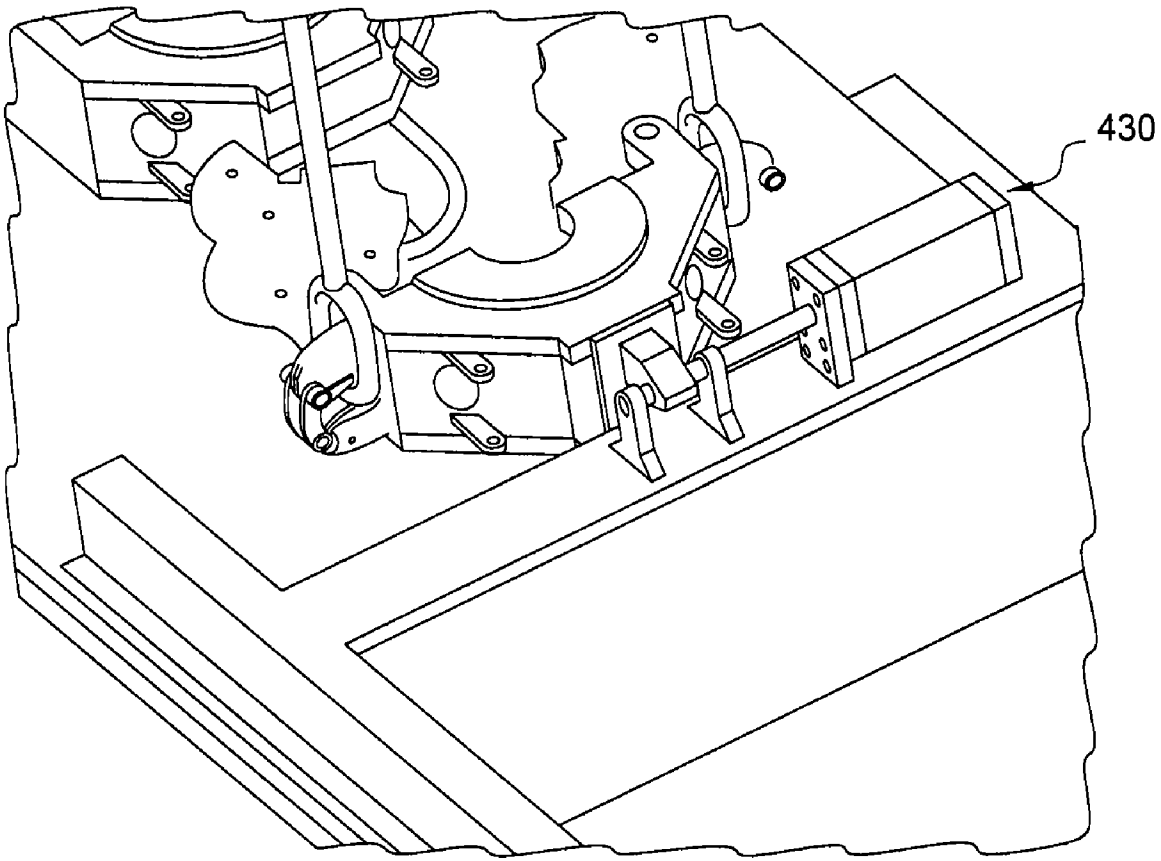
FIGS. 18-19 show the automated false rotary table of FIG. 17, with a bracket engaging an elevator.
Figure 19:
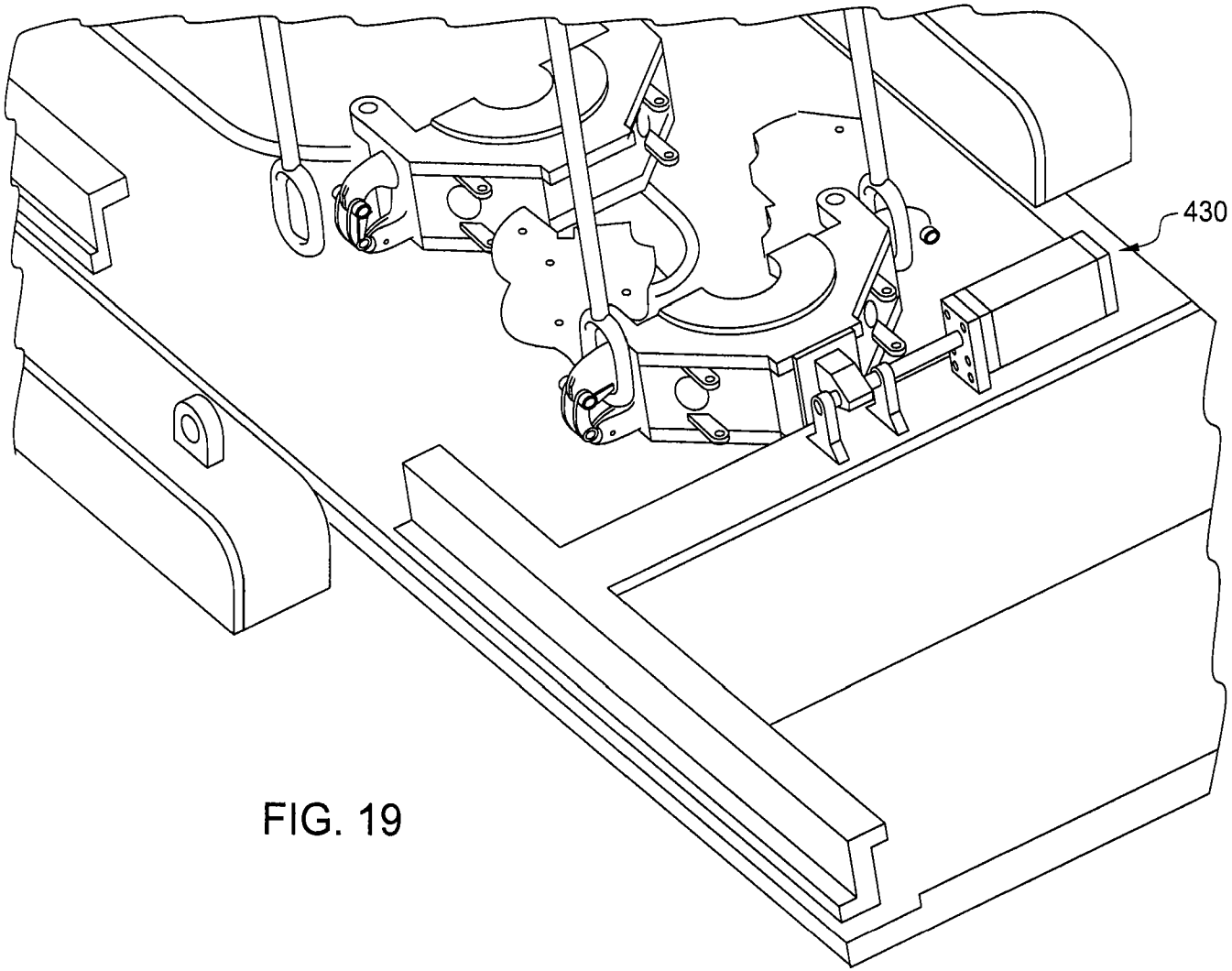

In FIGS. 17-19, only one bracket 430 is utilized. The elevator 100 has an extension 495 with a hole therethrough, and the track 20 has a portion 20A which runs perpendicular to the direction of sliding motion of the sliding table 15 to which the elevator 100 is configured to slide when the automated false rotary 10 is in the running position, as shown in FIG. 17. The bracket 430 is affixed to the portion 20A of the track 20. Also affixed to the portion 20A, across from the bracket 430, are one or more guides 496 and 497.

In operation, when the bracket 430 is employed to engage the elevator 100 when the automated false rotary table 10 is in the running position, fluid pressure is introduced into the piston and cylinder assembly 435 of the bracket 430, as described above in relation to the piston and cylinder assemblies 35A and 35B of FIGS. 1-12. The piston extends from the cylinder so that the piston extends through the holes in the guides 496 and 497 and the hole in the elevator extension 495 which is sandwiched between the two guides 496 and 497. When it is desired to release the piston from engagement with the elevator 100, the piston is retracted into the cylinder by a decrease in fluid pressure behind the piston.

FIGS. 20-36 illustrate a second embodiment of an automated false rotary table ("AFRT") 510 and elevators 600 and 700 usable therewith. In the second embodiment, two sliding plates are utilized to move the automated false rotary table 510 between the tubular running position (shown in FIG. 20) and the tubular landing position (shown in FIG. 21). Specifically, a first sliding plate 515A is slidable over a track 582 and a second sliding plate 515B is independently slidable over tracks 520. The tracks 582 and 520 are rigidly mounted to a base plate 575. The base plate 575 may be provided in two pieces 575A, 575B and connected together by one or more pins 596 as shown in FIGS. 20-32, or in the alternative may be provided in more than two pieces or in one continuous piece.

A power supply communicates with the track 582 using a manifold block 584 and power communication device 583, while a power supply (which may be the same power supply) communicates with the tracks 520 using a manifold block 585 and one or more power communication devices 586. The power supply may supply hydraulic fluid, pneumatic fluid, electrical power, or any other type of power capable of actuating the sliding motion of the sliding plates 515A and 515B, and the power communication devices 583 and 586 may include a hose for conveying hydraulic or pneumatic fluid, an electrical cable or optical fiber (when utilizing optical sensing or optical waveguides), or any other means for communicating the power from the power supply to the tracks 582, 520. The manifold blocks 584, 585 provide a porting arrangement and distribution center from the power supply to the power communication devices 583, 586 and may include one or more valves to reduce or increase the amount of power supplied to the hoses. One or more tank lines and one or more pressure lines may be utilized to connect the manifold blocks 584, 585 to the power supply.

The manifold block 585 is shown having two power communication devices 586, each in communication with one of the tracks 520. In an alternate embodiment, only one power communication device 586 is utilized which communicates the power to both tracks 520 in series. Further, it is contemplated that one track or two tracks may be utilized as either of the tracks 582, 520.

The first sliding plate 515A includes a first guide portion 580A facing inward. The first guide portion 580A is preferably semi-circular. The second sliding plate 515B includes a second guide portion 580B (see FIG. 21) facing inward and opposing the first guide portion 580A. Like the first guide portion 580A, the second guide portion 580B is preferably semi-circular. When the sliding plates 515A and 515B slide towards one another into the tubular-landing position shown in FIG. 21, the first and second guide portions 580A and 580B generally form a circle on which an elevator may be landed. The mated guide portions 580A and 580B serve as a guide 580 for placing an elevator on the AFRT 510. The guide 580 preferably has an inner diameter larger than the outer diameter of the tubular body which is utilized in the pipe handling operation but smaller than the coupling of the tubular body utilized, so that the tubular body cannot fall completely through the guide 580 when the AFRT 510 is in the tubular landing position but the tubular body itself can run below the AFRT 510 in the tubular landing position.

Figure 20:
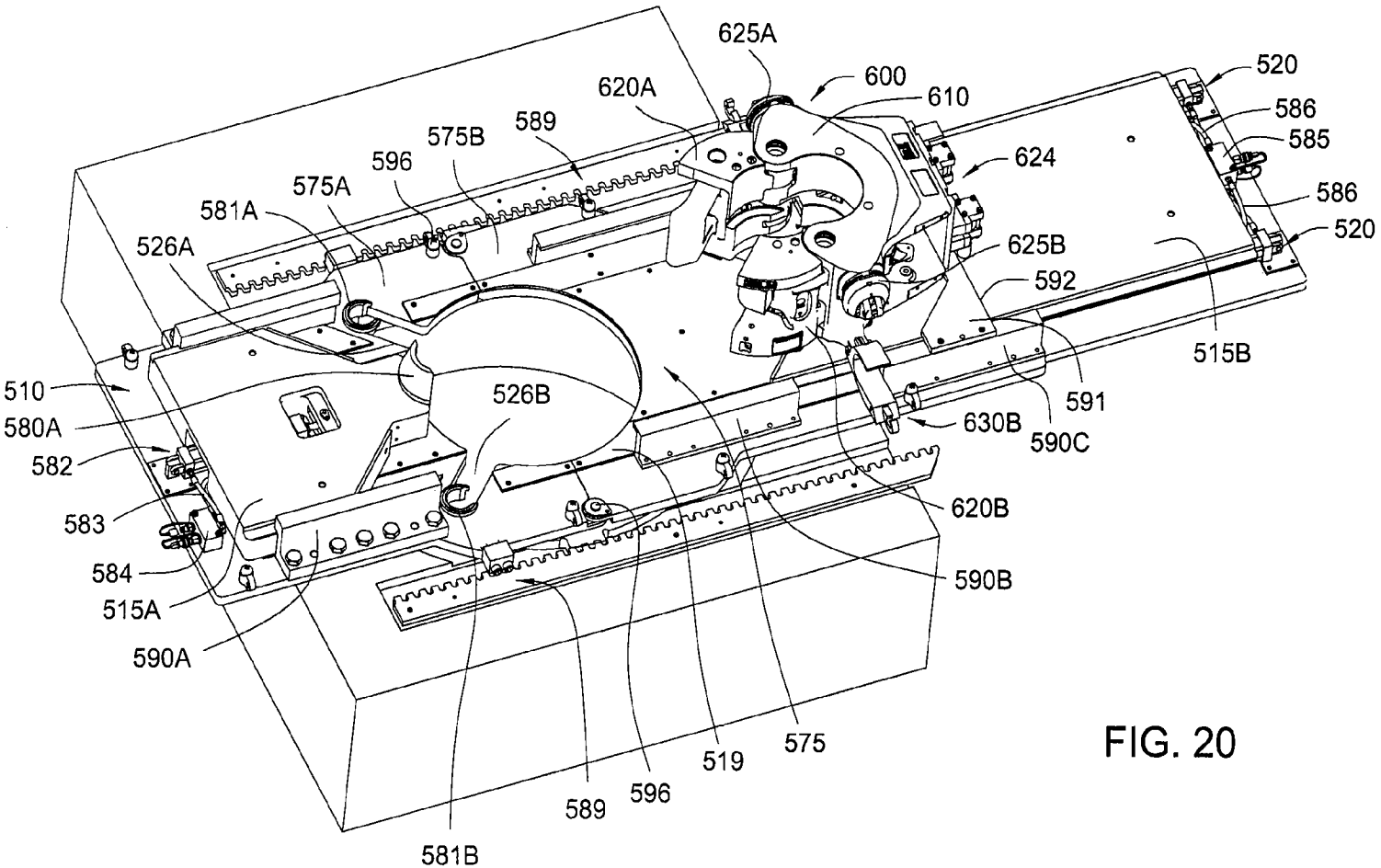
FIG. 20 shows a second embodiment of an automated false rotary table in position to run a tubular through the automated false rotary table.

The base plate 575 remains stationary during the pipe handling operation. Referring to FIG. 20, within the base plate 575 is a hole 519, which is preferably (although not limited to) approximately 36 inches in diameter to accommodate tubulars and their associated couplings by allowing their passage therethrough. The hole 519 is larger in diameter than the inner diameter of the guide 580 so that the inner diameter of the hole 519 is smaller when the elevator is landed on the AFRT 510 than when running tubular bodies through the hole 519. Also, the hole 519 is larger than the outer diameter of any coupling desired to run through the AFRT 510.

The hole 519 is generally cylindrical for the majority of its circumference. The remainder of the circumference may branch into control line passages 526A and 526B for allowing passage of one or more control lines 527 therethrough (see FIG. 22) when running the tubulars into the wellbore below the AFRT 510. Located within the control line passages 526A and 526B are control line guides 581A and 581B for retaining the control lines 527 therein at various stages of the tubular-running operation. Although two control line passages 526A, 526B are shown, in an alternate configuration of the present invention only one control line passage is located in the base plate 575.

Figure 21:
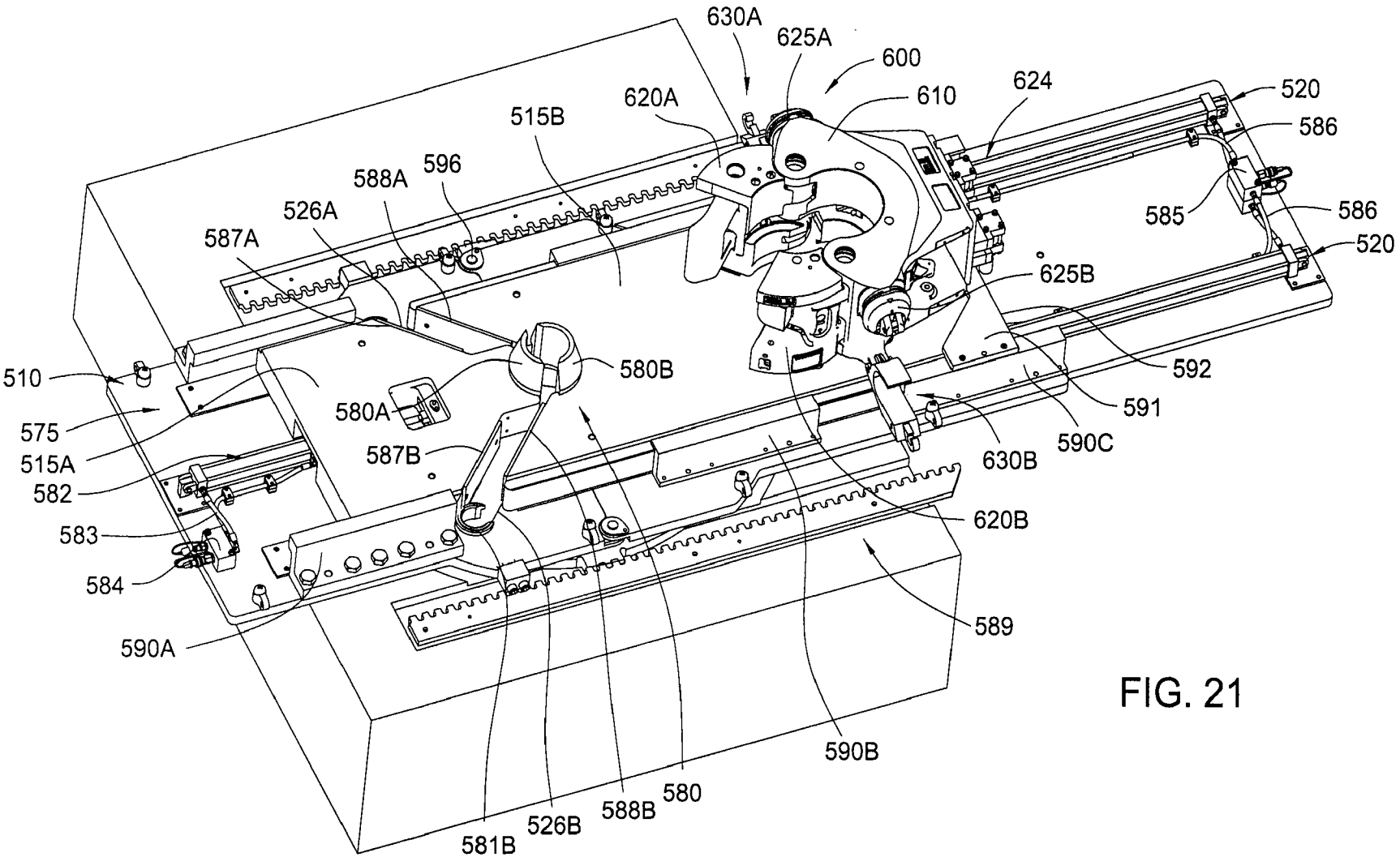
FIG. 21 shows the automated false rotary table of FIG. 20 in position to land a tubular on the automated false rotary table for the threading of additional tubulars thereon.

As shown in FIG. 21, the sliding plates 515A and 515B are angled at their inwardly-facing end portions 587A, 587B and 588A, 588B, respectively, to generally comply with the angled control line passages 526A and 526B in the base plate 575 when in the tubular landing position shown in FIG. 21. The angled end portions 587A, 587B and 588A, 588B allow placement of the control line(s) 527 within the control line guides 581A, 581B when the tubular is landed on the AFRT 510.

Disposed on the base plate 575 is an optional gear arrangement 589. The gear arrangement 589 may be utilized to center the device for making up the tubular connections, which may be, for example, a tong.

Figure 21A:
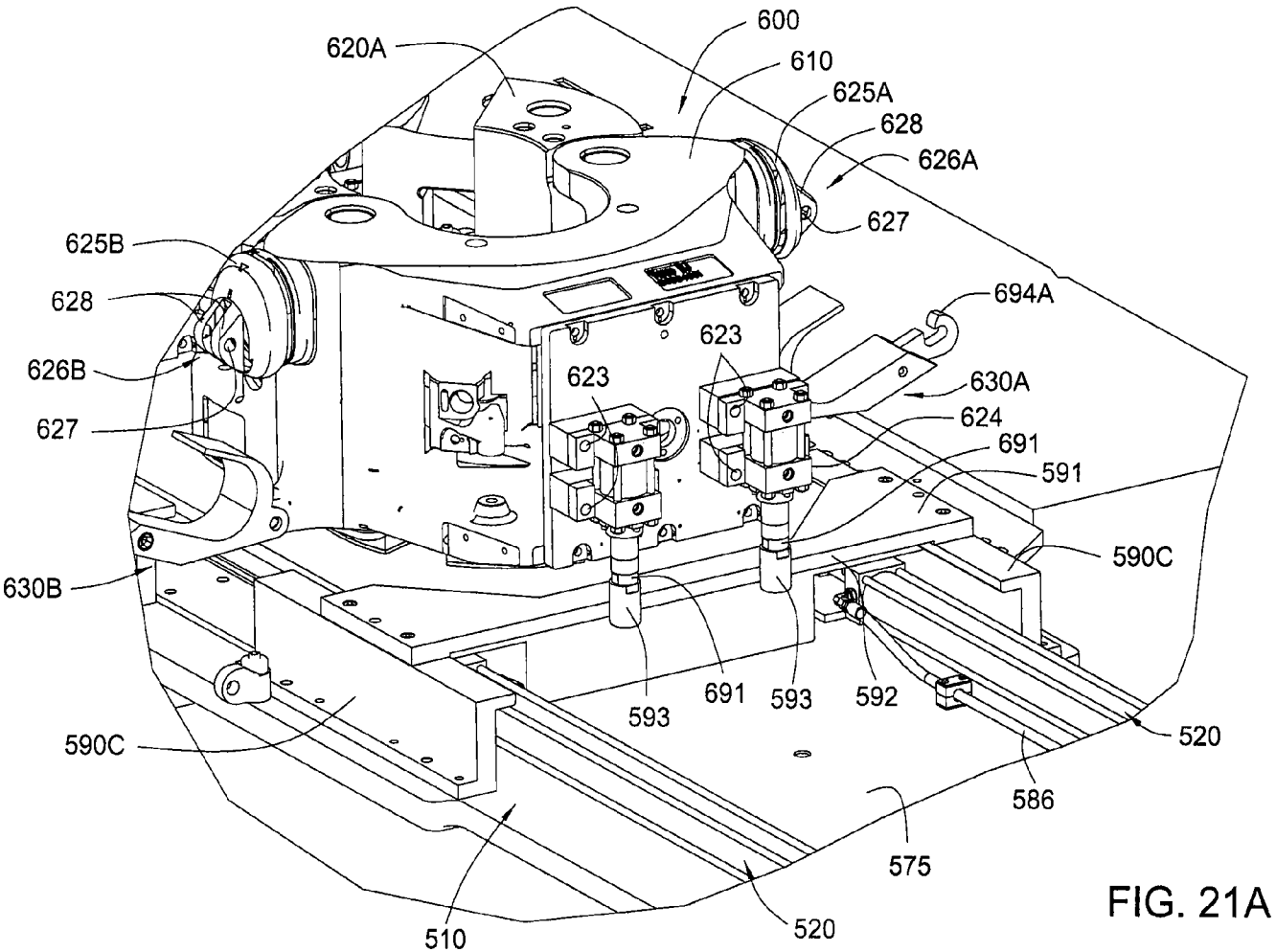
FIG. 21A is a section view of a portion of a first elevator and a portion of the automated false rotary table of FIG. 21 on which the first elevator is disposed. The first elevator is locked in position on the automated false rotary table.

One or more plate guides 590A, 590B, 590C are rigidly attached to the top of the base plate 575 to guide and center the sliding plates 515A, 515B on the tracks 582, 520. Attached to the top of the plate guide 590C is an elevator retaining plate 591, which has an inwardly-facing end which is cut out to receive a first elevator 600, as shown in FIG. 20 (or a second elevator 700). As shown in FIG. 21A, at the outwardly-facing end 592 of the elevator retaining plate 591 are one or more upwardly-facing slots 593 for receiving one or more pistons 691 extended from the first elevator 600. The one or more pistons 691 extend from one or more assemblies 624 which are rigidly connected to the first elevator 600, for example connected by one or more pins 623 through slots in the assemblies 624. The pistons 691 are extendable from the assemblies 624 by hydraulic or pneumatic fluid delivered to the assemblies from one or more power supplies (not shown) through one or more manifold blocks (not shown) similar to the manifold blocks 584, 585 and then through one or more power communication devices (not shown) similar to power communication devices 583, 586. Rather than being powered by hydraulic or pneumatic fluid, the power source for operation of the assemblies 624 may be electrical or optical.

The first elevator 600 and the second elevator 700 are structurally and operationally substantially the same. The description below and above concerning the first elevator 600 therefore applies equally to the second elevator 700.

The first elevator 600 is preferably a door-type elevator including a supporting portion 610 and door portions 620A, 620B which are pivotable with respect to the supporting portion 610 to receive, expel, and/or retain a tubular therein. The door portions 620A, 620B may be pivotable with respect to the supporting portion 610 by one or more pins extending through one or more slots connecting the door portions 620A, 620B and the supporting portion 610 to one another.

Figure 23:
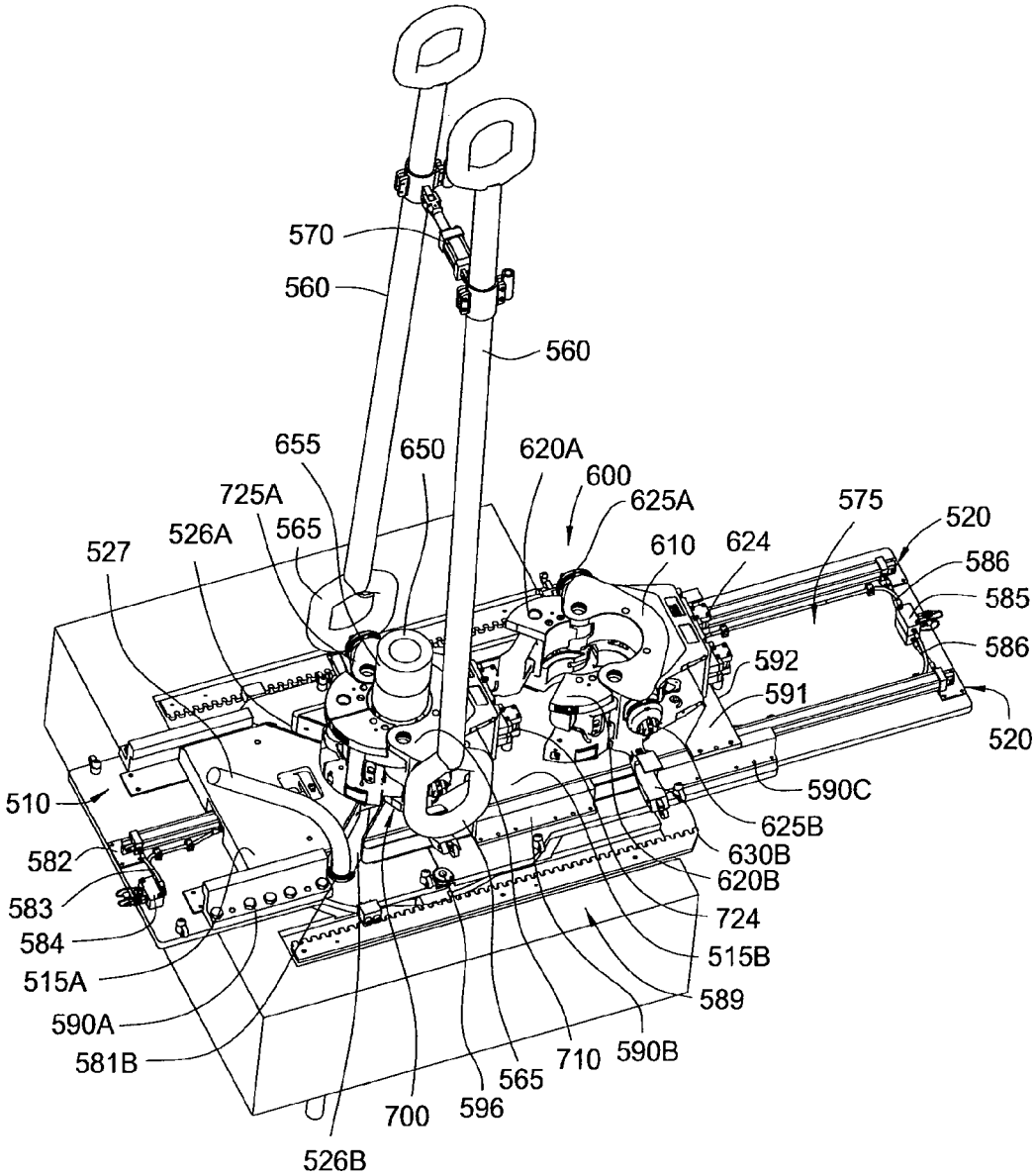
FIG. 23 shows the automated false rotary table of FIG. 20 with elevator links spread for detachment from the second elevator.

Referring to FIG. 23, elevator links 560 capable of liftingly engaging each of the elevators 600, 700 are operatively connected at upper portions, preferably at their upper ends, to a top drive (see description above in relation to FIGS. 1-19 of a top drive usable with embodiments of the present invention). The lower, looped ends of the elevator links 560 constitute elevator link retainers 565. The elevator link retainers 565 are capable of looping around lifting ears 625A, 625B of the first elevator 600 or lifting ears 725A, 725B of the second elevator 700 to lift the elevator 600, 700 by its lifting ears 625A, 625B, 725A, 725B. The elevator links 560, and thus the elevators 600, 700, are pivotable with respect to the top drive using the mechanism incorporated by reference above, specifically a piston/cylinder arrangement connected at one end to the top drive and at the other end to the elevator links 560. The elevator links 560 may also be pivoted by electrical currents or optical signals. A spreading member such as link spreader 570 is operatively connected at one end to one of the elevator links 560 and at the other end to the other elevator link 560. The link spreader 570 is substantially the same as the link spreader 170 described above in relation to FIGS. 1-19, and may be powered by hydraulic fluid, pneumatic fluid, electrical currents, or optical signals.

Substantially in line with one another and extending outwardly from an outer diameter of the first elevator 600 are lifting ears 625A, 625B (see in particular FIG. 21A), which are used to lift the first elevator 600. On the outer surfaces of the lifting ears 625A, 625B are link-locking extensions 626A, 626B, which generally each include two spaced-apart, extending members 628 having slots 627 therein. FIGS. 33-36 show a side view of the first elevator 600 and its link-locking mechanism, including an elevator link retainer assembly 630A and the link-locking extension 626A. The other side of the first elevator 600 having the lifting ear 625B has substantially the same link-locking mechanism as the side of the first elevator 600 having the lifting ear 625A described herein, so the description herein of the link-locking mechanism operable with the lifting ear 625A applies equally to the link-locking mechanism operable with the lifting ear 625B. Furthermore, the second elevator 700 includes lifting ears 725A, 725B and link-locking mechanisms which are substantially the same as the lifting ears 625A, 625B and link-locking mechanisms of the first elevator 600; therefore, the description of the lifting ear 625 and its corresponding link-locking mechanism applies equally to the lifting ears 725A, 725B and associated link-locking mechanisms of the second elevator 700.

Referring to FIGS. 33-36, a pin 695A extends through the slots 627 through the extending members 628 of the link-locking extension 626A. The lifting ear 625A is disposed preferably at an upper portion of the first elevator 600.

Figure 24:
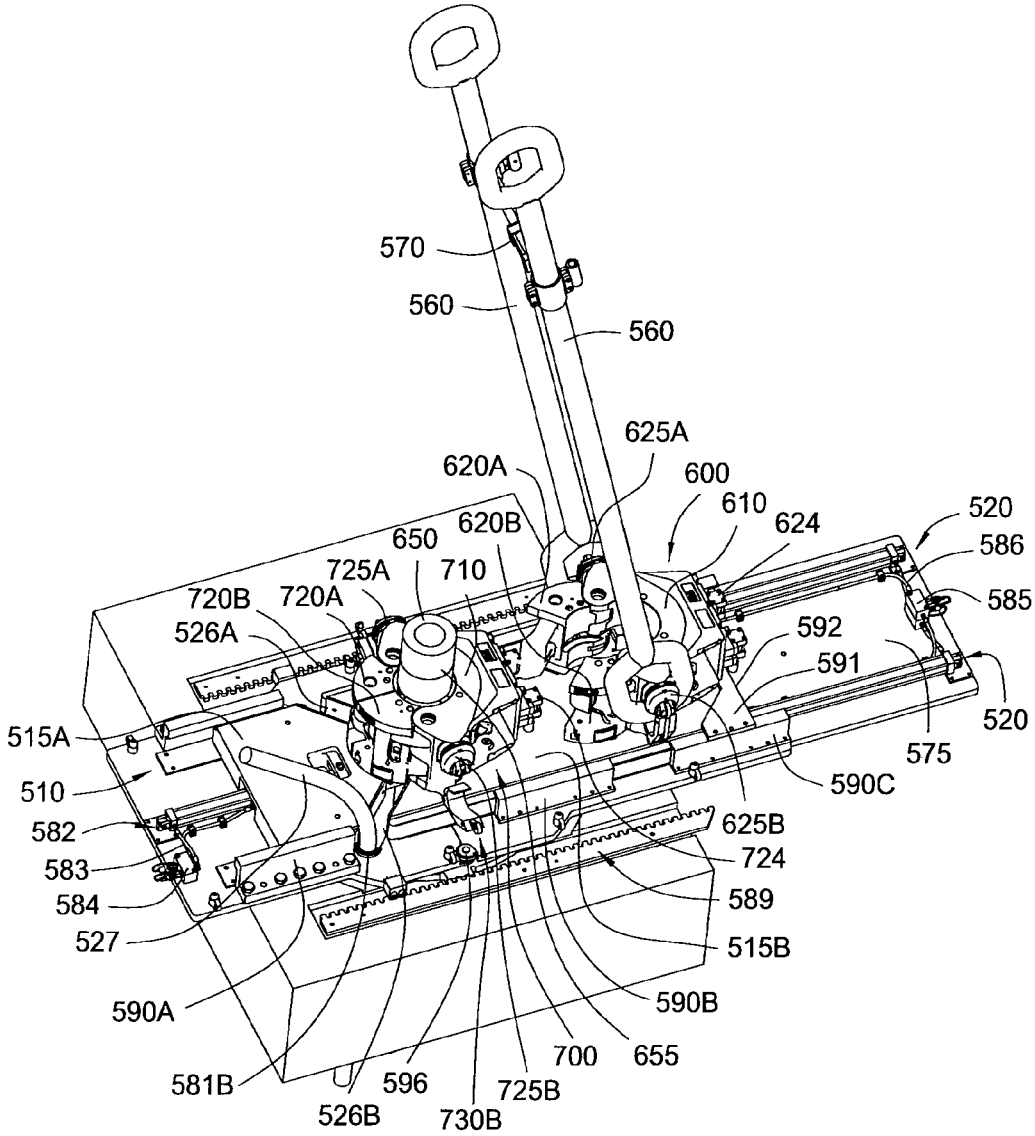
FIG. 24 shows the automated false rotary table of FIG. 20 with elevator links in position to lift the first elevator from the automated false rotary table.
Figure 34:
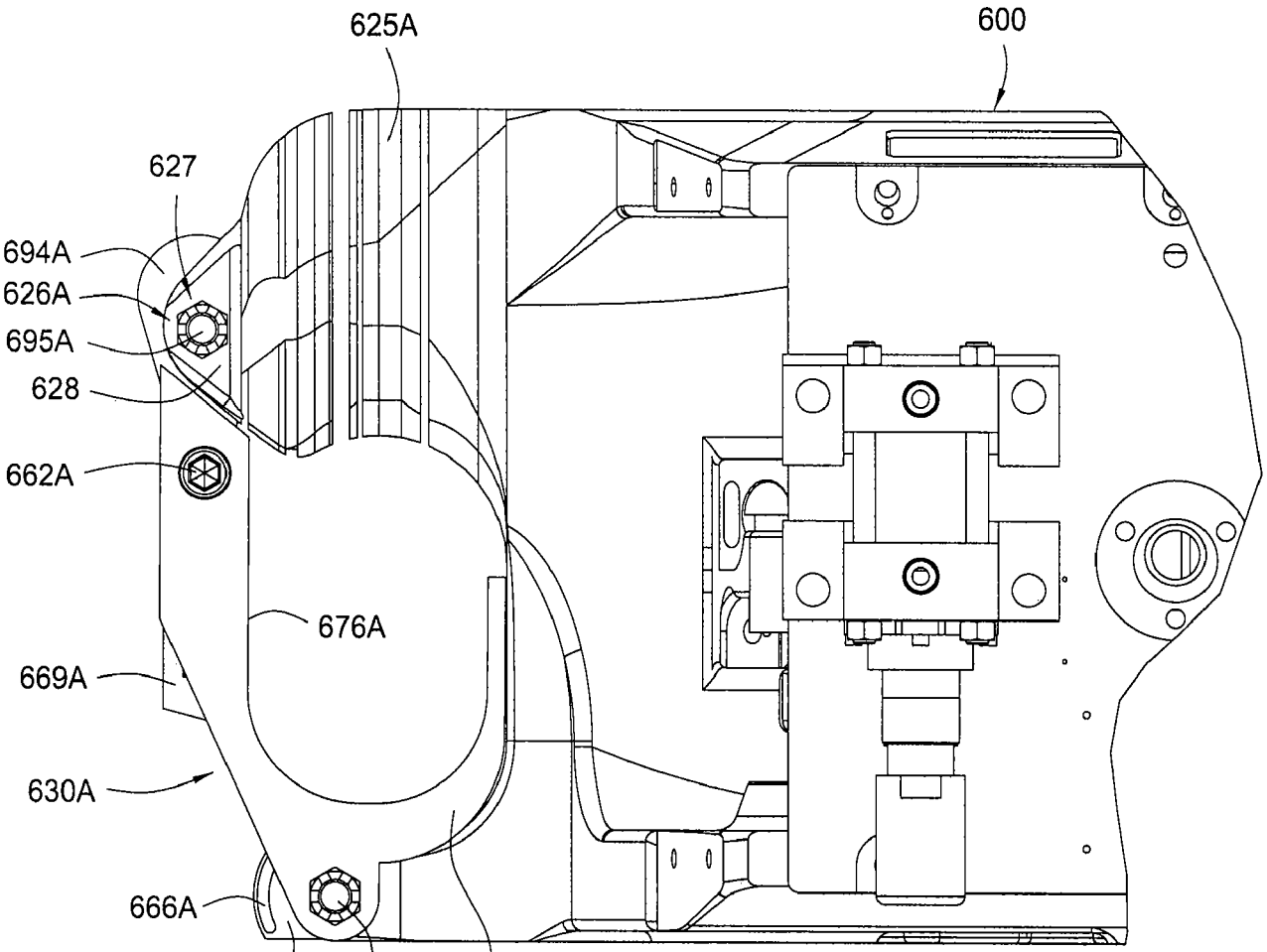
FIG. 34 is a side view of the elevator link retainer assembly of FIG. 33 in the closed position.
Figure 34A:
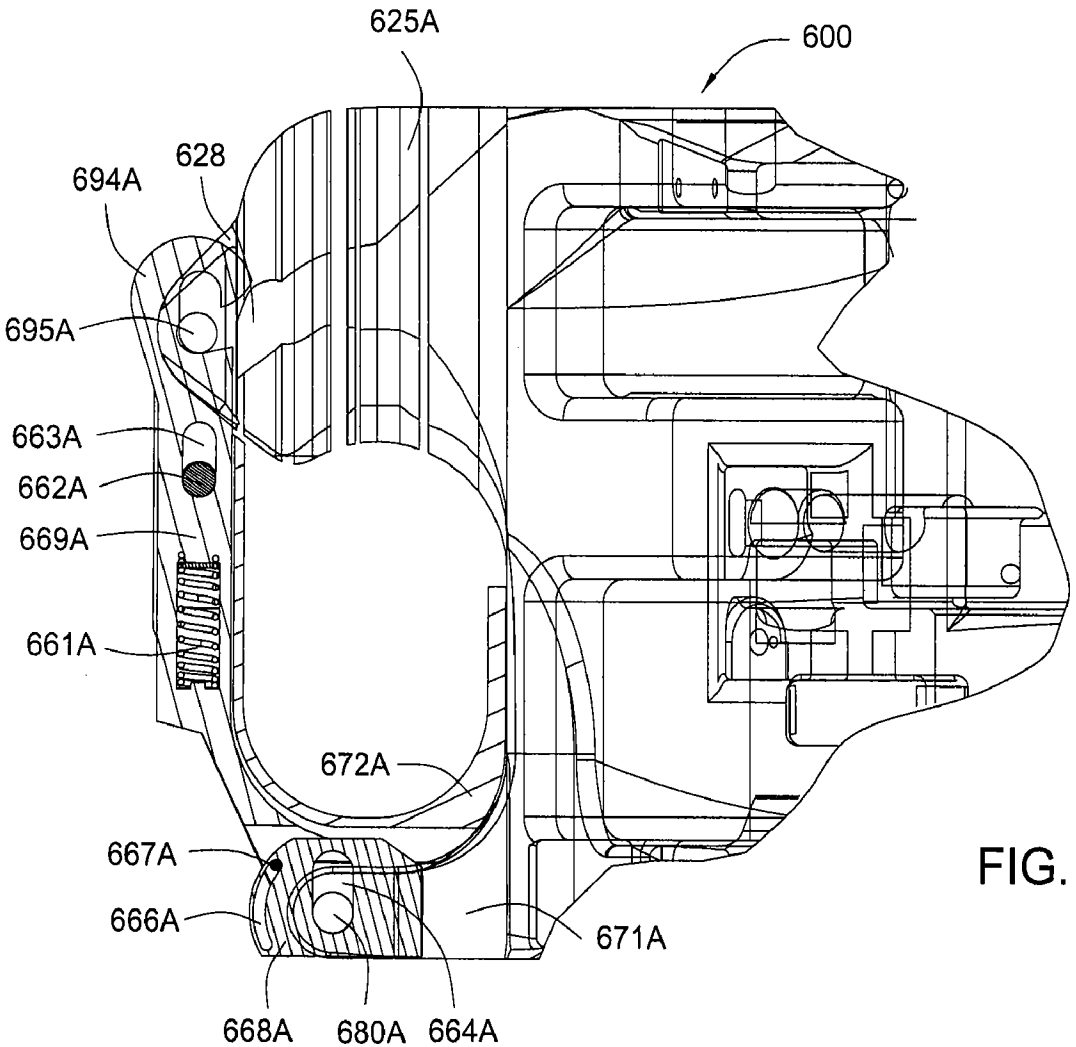
FIG. 34A is a side view of the elevator link retainer assembly of FIG. 34, with outer portions of the elevator link retainer assembly removed.

Preferably disposed at a lower portion of the first elevator 600 below the lifting ear 625A is the elevator link retainer assembly 630A, which is capable of lockingly mating with the pin 695A to retain the elevator links 560 with the first elevator 600 (see FIG. 24). The elevator link retainer assembly 630A includes a retaining member 672A having a generally longitudinal slot 673A therein (see FIG. 36). A locking member 669A is disposed within the slot 673A and connected to the retaining member 672A by a pin 662A. As shown in FIG. 34A, the pin 662A is movable through a cam slot 663A longitudinally disposed through the side of the locking member 669A.

Figure 35:
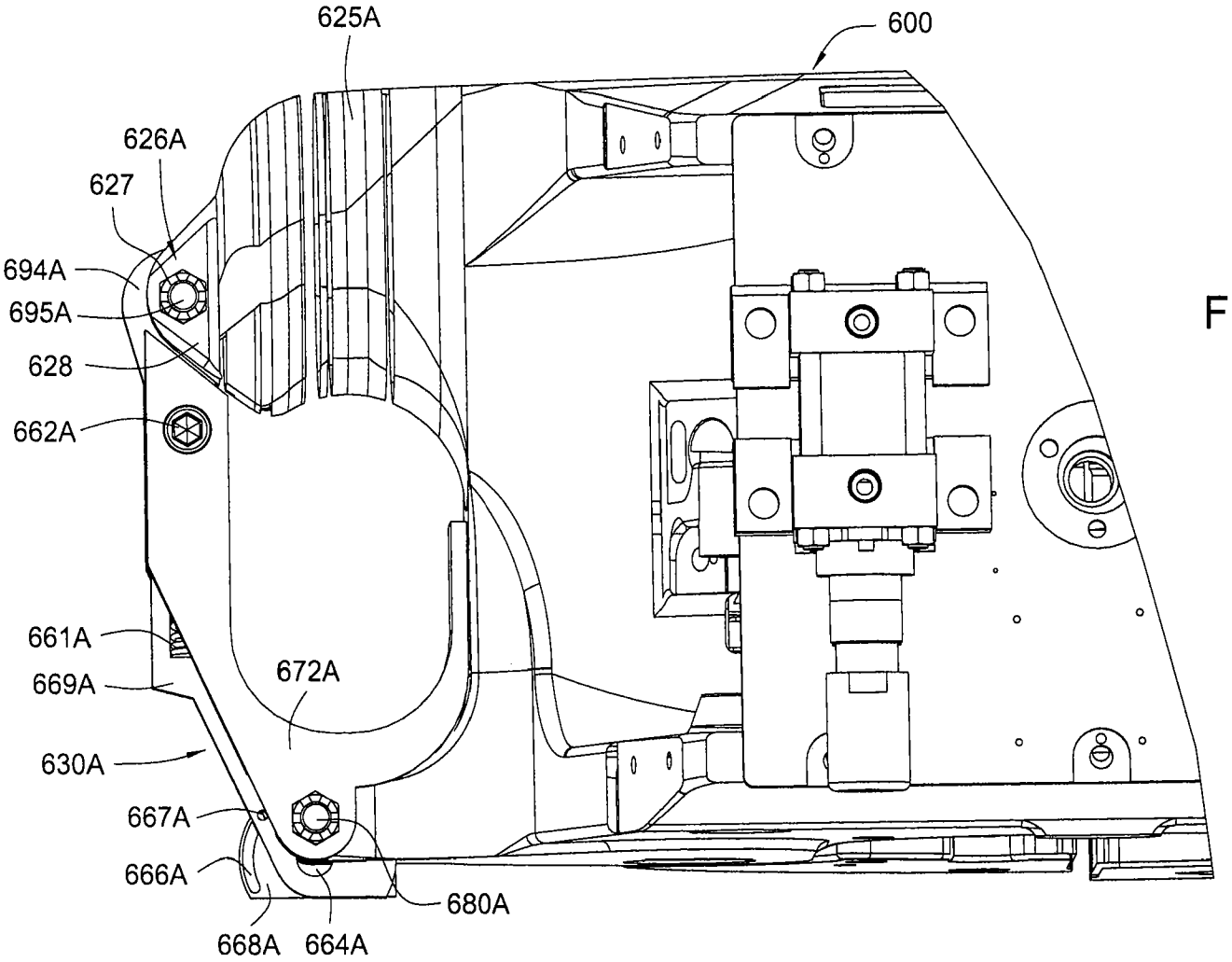
FIG. 35 is a side view of the elevator link retainer assembly of FIG. 34 in the closed and locked position.
Figure 36:
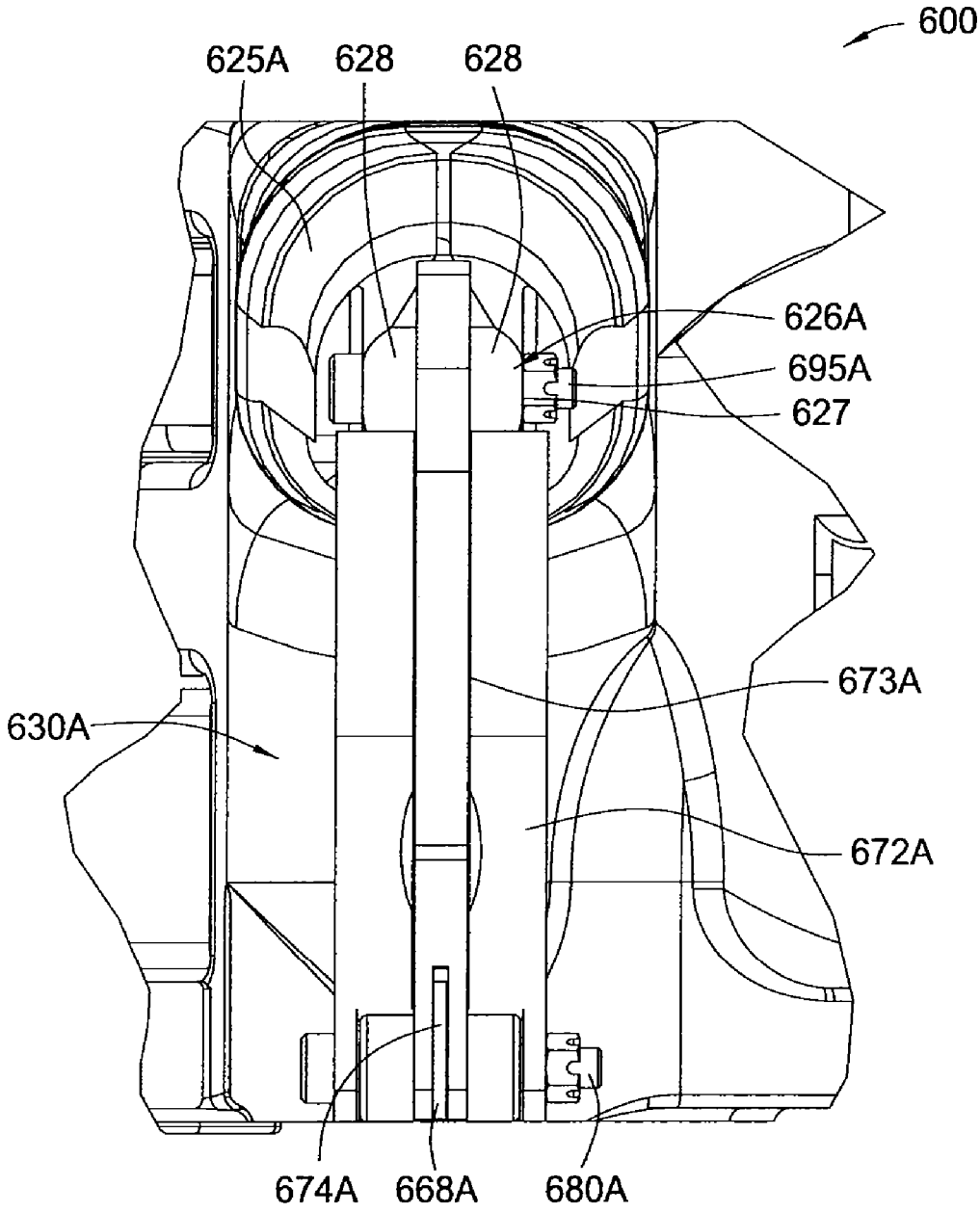
FIG. 36 is an end view of the elevator link retainer assembly of FIG. 34.

As shown in FIG. 36, within the locking member 669A is a generally longitudinal slot 674A having a camming member 668A disposed therein. The camming member 668A is connected to the retaining member 672A by a pin 667A (see FIGS. 34A and 35). The pin 667A travels through a part-cylindrical cam slot 666A within the outer surface of the camming member 668A. Both the camming member 668A and the retaining member 672A are connected to an elevator extending member 671A portion of the elevator 600 by a pin 680A (see FIG. 34A). The retaining member 672A is pivotably connected to the elevator extending member 671A by the pin 680A extending through preferably generally cylindrical slots through the retaining member 672A and the elevator extending member 671A. The camming member 668A is connected to the elevator extending member 671A by the pin 680A extending through a longitudinally-disposed cam slot 664A which generally conforms to the length and shape of the cam slot 663A.

The locking member 669A includes a hook 694 thereon for locking with the pin 695A when desired, as described in the operation below. Also included within the locking member 669A is a resilient member 661A (see FIG. 34A), such as a biasing spring, which biases the locking member 669A and the camming member 668A downward with respect to the retaining member 672A and with respect to the elevator extending member 671A (see FIG. 35), thereby permitting the locking member 669A to lock over the pin 595A when lifting the first elevator 600 from the AFRT 510.

Figure 33:
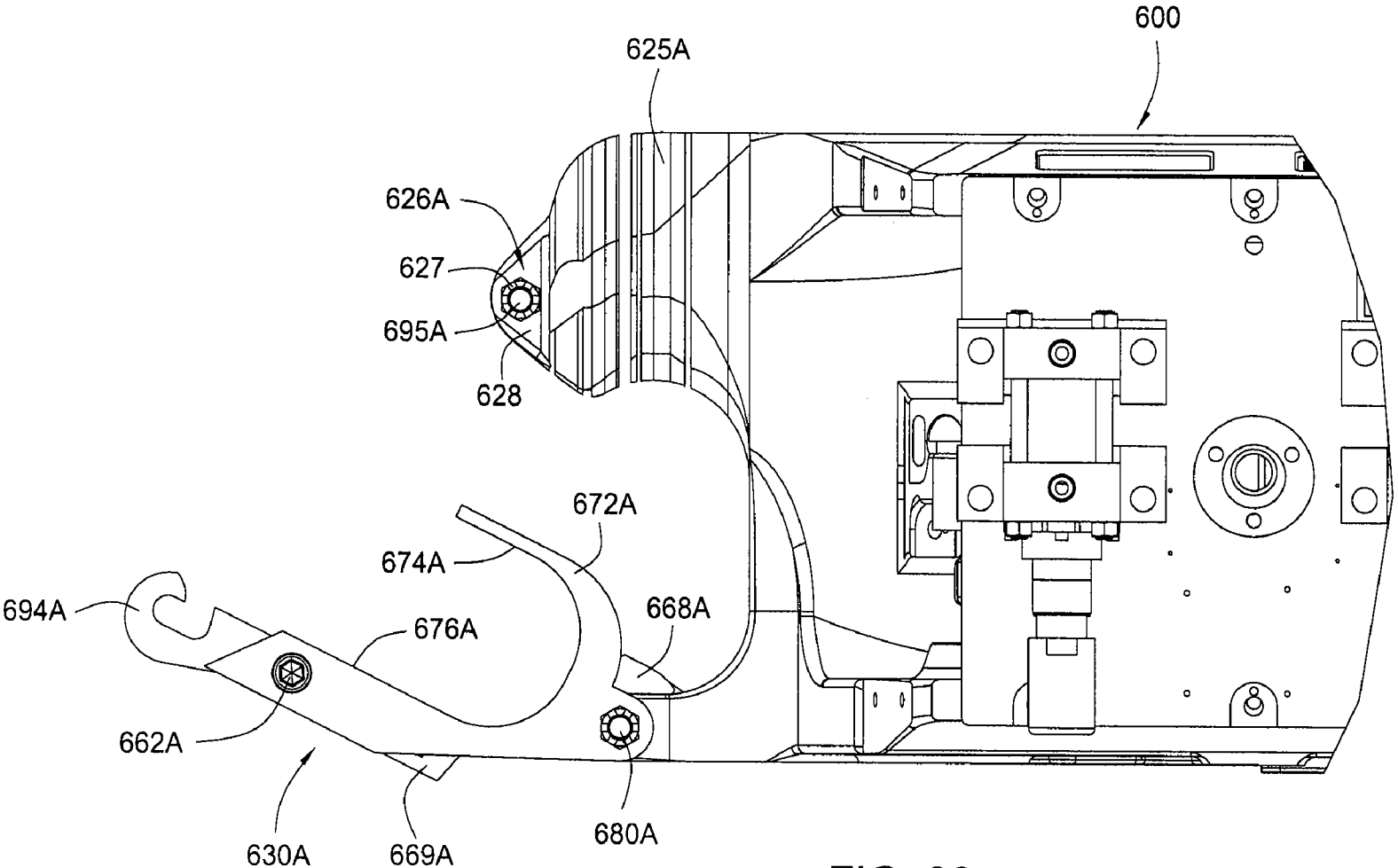
FIG. 33 is a side view of an elevator link retainer assembly of a first elevator in the open position.

The operation of the elevator link retainer assembly 630A is as follows. FIGS. 33, 34, and 34A show positions of the elevator link retainer assembly 630A while the elevator 600 is in contact with the AFRT 510. The camming member 668A and the locking member 669A are forced upward relative to the retaining member 672A against the downward biasing force of the resilient member 661A because the camming member 668A and locking member 669A are forced upward by the AFRT 510 surface acting against the camming member 668A and locking member 669A.

FIGS. 34 and 34A depict the elevator link retainer assembly 630A in the unlocked position. The force exerted on the camming member 668A and the locking member 669A by the AFRT 510 when the first elevator 600 is located on the AFRT 510 causes the elevator link retainer assembly 630A to remain unlocked. The force exerted by the AFRT 510 against the camming member 668A and the locking member 669A causes the pins 680A and 662A to be positioned at the lowermost points within the slots 663A and 664A (see FIG. 34A). The hook 694A is spaced upward from the pin 695A due to the force of the AFRT 510.

To place the elevator link retainer assembly 630A in the open position shown in FIG. 33 after unlocking it, a force is placed on an opening inside surface 676A of the elevator link retainer assembly 630A to cause the retaining member 672A and the locking member 669A to rotate radially outward relative to the remainder of the first elevator 600. Preferably, the force is placed on the inside surface 676A by an elevator link retainer 565 disposed within the elevator link retainer assembly 630A (see FIG. 22) moving outward by use of the link spreader 570 (described below). Referring now to FIG. 34A, the inside surfaces 676A of the retaining member 672A and locking member 669A are pushed outward relative to the remainder of the first elevator 600. The pin 667A rotates downward through the cam slot 666A as the retaining member 672A and locking member 669A rotate to the position shown in FIG. 33.

The elevator link retainer assembly 630A remains in the open position shown in FIG. 33 until a force towards the remainder of the first elevator 600 is placed on a closing inside surface 674A of the retaining member 672A. Preferably, this force is placed on the inside surface 674A by the elevator link retainer 565 placed within the inside surface 674A of the elevator link retainer assembly 630A. Force applied against the inside surface 674A in the direction of the remainder of the first elevator 600 causes the locking member 669A and the retaining member 672A to rotate radially inward towards the remainder of the elevator 600 to again attain the position shown in FIGS. 34 and 34A. The pin 667A rotates through the cam slot 666A from a lower portion of the cam slot 666A to an upper portion of the cam slot 666A (the position shown in FIG. 34A).

The elevator link retainer 565 is automatically locked within the elevator link retainer assembly 630A upon lifting the first elevator 600 from the AFRT 510 by lifting the elevator links 560. FIG. 35 shows the elevator link retainer assembly 630A in the locked position. When the first elevator 600 is removed from its contact with the AFRT 510, the force of the AFRT 510 surface no longer acts against the bias force of the resilient member 661A. Thus, the downward bias force of the resilient member 661A causes the locking member 669A and the camming member 668A to move downward relative to the retaining member 672A and the remainder of the first elevator 600 so that cam slots 664A and 663A move downward over their respective pins 680A and 662A to the locked position shown in FIG. 35. The slots 664A and 663A of the locking member 669A and the camming member 668A moving downward forces the hook 594A downward over the pin 695A to lock the elevator link retainer 565 to the first elevator 600. In the locked position, the camming member 668A and the locking member 669A protrude below the bottom of the remainder of the first elevator 600.

To unlock the elevator link retainer assembly 630A, the first elevator 600 must merely be placed on the AFRT 510 to again cause the camming member 668A and the locking member 669A to act against the bias force of the resilient member 661A. The unlocked, closed position of the elevator link retainer assembly 630A, shown in FIGS. 34 and 34A, is described above. Opening, closing, and unlocking the elevator link retainer assembly 630A may be repeated any number of times. The elevator link retainer assembly 630A is automatically cycled between the open, closed, and locked positions during an ordinary pipe running operation using the two elevators 600 and 700 and the AFRT 510, as described below.

In operation, a first elevator 600 is locked in position on the base plate 575 by the pistons 691, in their extended positions, extending through the slots 593 in the elevator retaining plate 591, as shown in FIGS. 20, 21, and 21A. The AFRT 510 is in the tubular running position shown in FIG. 20, where the sliding plates 515A and 515B are extended away from one another to expose the hole 519 in the base plate 575.

To land the second elevator 700 having a first tubular section 650 therein on the AFRT 510, the sliding plates 515A and 515B are retracted towards one another, as shown in FIG. 21, by supplying power to the manifold blocks 584 and 585. Power through the manifold blocks 585, 585 is supplied to the tracks 582, 520 using the power communication device 583, 586. The power may be supplied to the tracks 582, 520 by a piston/cylinder arrangement using hydraulic or pneumatic fluid, or may be supplied by electrical or optical stimulation. Regardless of the type of power utilized, the power supplied to the tracks 582, 520 causes the sliding plates 515A, 515B to slide towards one another to abut one another and form the guide 580 from the mating guide portions 580A and 580B, as shown in FIG. 21. Sliding of the sliding plates 515A, 515B does not move the first elevator 600, as the first elevator 600 is attached at this time to the elevator retaining plate 591, which remains stationary along with the base plate 575 to which it is rigidly attached.

A second elevator 700 (depicted in FIG. 22) is then moved by the piston/cylinder arrangement described and incorporated by reference above in relation to the first embodiment or by some other elevator-pivoting arrangement connected at one end to the top drive (not shown) and at the other end to the elevator links 560 by activating the piston/cylinder arrangement to pivot the second elevator 700 and the elevator links 560 relative to the top drive. The second elevator 700 is moved so that the first tubular section 650 is inserted through the door portions 720A and 720B.

The second elevator 700 is eventually positioned so that the door portions 720A, 720B and the supporting portion 710 of the second elevator 700 cooperate to surround the first tubular section 650. The door portions 720A, 720B are pivoted radially inward with respect to the supporting portion 710 by use of a powering arrangement (not shown), for example by operation of a piston/cylinder arrangement utilizing pneumatic or hydraulic fluid for power, or by electrical or optical power. Pivoting the door portions 720A, 720B causes the second elevator 700 to at least substantially envelope the first tubular section 650. The first tubular section 650 is then lifted upward by moving the top drive upward along its tracks, thereby causing the second elevator 700 to engage a lower surface of an upset portion of the first tubular section 650, preferably a lower surface of female threads 655, which are used as part of a coupling (male threads connected to female threads). Upon engagement of the lower surface of the female threads 655 by the second elevator 700, the first tubular section 650 is lifted further by sliding the top drive upward along its tracks, then the first tubular section 650 is pivoted back to a position where its centerline is substantially in line with the center of the guide 580 by de-activation of the piston/cylinder arrangement connecting the top drive to the elevator links 560.

Figure 22:
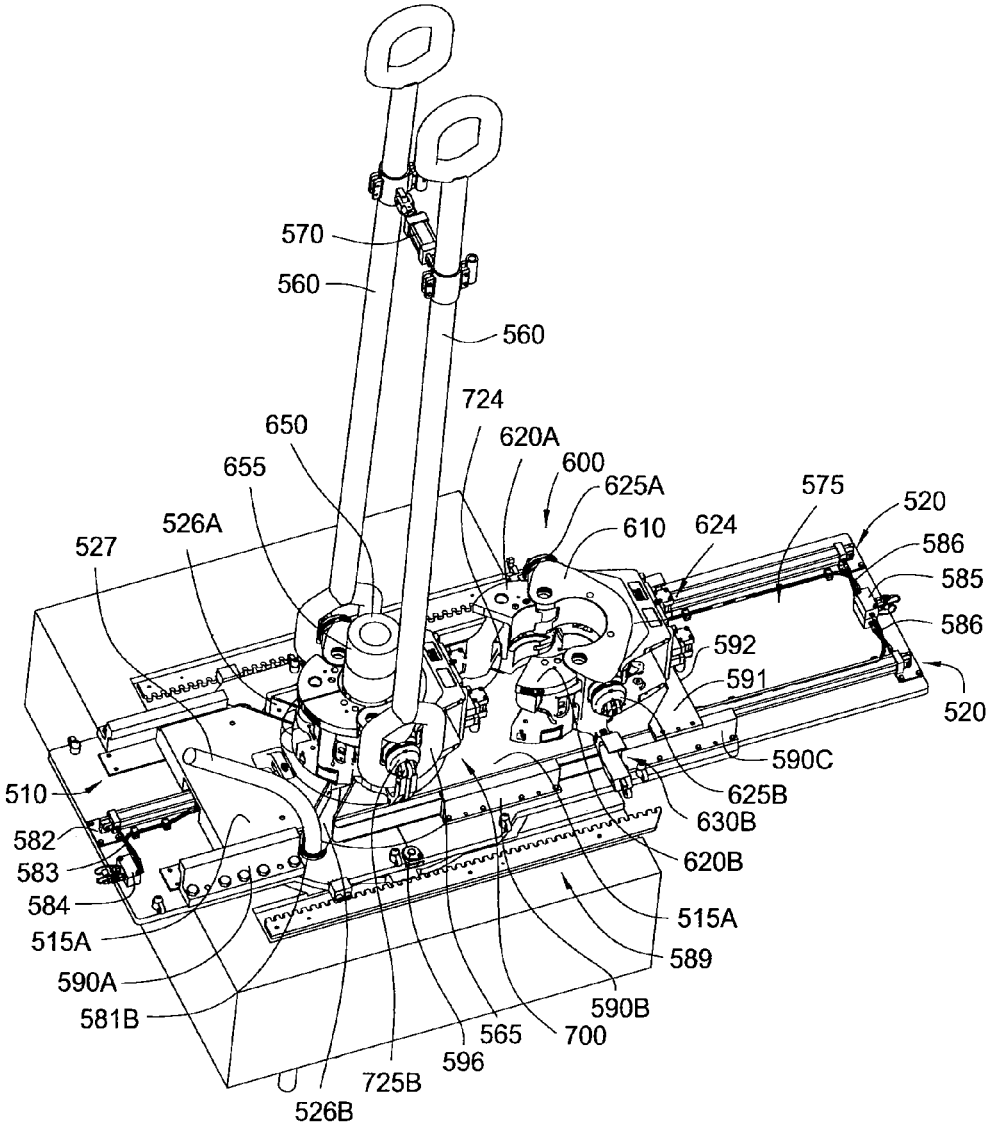
FIG. 22 shows the automated false rotary table of FIG. 20 in the position to land a tubular, as shown in FIG. 21. A second elevator having a first tubular section therein is landed on the automated false rotary table.

When the first tubular section 650 is in position so that its centerline is substantially in line with the center of the guide 580, the top drive is lowered on its tracks, thereby lowering the second elevator 700 and the first tubular section 650 therewith. Lowering the first tubular section 650 continues until the second elevator 700 rests on the AFRT 510, as shown in FIG. 22.

While the second elevator 700 is not located on the AFRT 510, the elevator links 560 are disposed around the lifting ears 725A, 725B and locked into place by the elevator link retainer assemblies 730A, 730B (locked position). Contacting the second elevator 700 with the AFRT 510 automatically unlocks the elevator link retainer assemblies 730A, 730B from the lifting ears 725A, 725B (unlocked, closed position) by unhooking the hooks 794A, 794B from the pins 795A, 795B, which is described above in relation to FIGS. 33-36.

After the hooks 794A, 794B are unhooked from the pins 795A, 795B extending through the link-locking extensions 726A, 726B, the link spreader 570 is activated to force the elevator links 560 outward relative to one another. The link spreader 570 may be activated by providing power in the form of hydraulic or pneumatic fluid to the link spreader 570 when it is a piston/cylinder assembly, or in the alternative by providing electrical power to the link spreader 570 when it is actuable electrically or optical signals to the link spreader 570 when it is actuable optically. When using a piston/cylinder assembly as the link spreader 570, the piston is extended from the cylinder by application of fluid to spread the elevator links 560 further apart.

Spreading the elevator links 560 causes the elevator link retainers 565 to push outward radially against the elevator link retainer assemblies 730A, 730B, causing the elevator link retainer assemblies 730A, 730B to pivot radially outward relative to the second elevator 700. This step in the operation is shown in FIG. 23, where the elevator links 560 are disengaged from the second elevator 700.

The top drive is then lifted upward along its tracks, and the elevator links 560 are pivoted radially outward from the top drive using the piston/cylinder assembly connected at one end to the top drive and at the other end to the elevator links 560. The elevator link retainers 565 are positioned adjacent to the lifting ears 625A, 625B of the first elevator 600, and the link spreader 570 is deactivated to retract (pivot) the elevator links 560 towards one another. Retracting the elevator links 560 towards one another at the position adjacent to the lifting ears 625A, 625B causes the elevator link retainers 565 to push against the inside surfaces 674A, 674B of the elevator link retainer assemblies 630A, 630B, thereby pivoting the elevator link retainer assemblies 630A, 630B towards the body of the first elevator 600 until the hooks 694A, 694B are positioned directly above the pins 695A, 695B. This position is shown in FIG. 24, where the elevator link retainer assemblies 630A, 630B are closed around the elevator link retainers 565 but remain unlocked.

Next, the top drive is moved upward along its tracks to lift the first elevator 600 from the AFRT 510. Lifting the first elevator 600 from the AFRT 510 locks the elevator link retainers 565 around the lifting ears 625A, 625B by causing the hooks 694A, 694B to moved downward over the pins 695A, 695B.

The elevator links 560 are then pivoted relative to the top drive using the piston/cylinder assembly having one end connected to the top drive and one end connected to the elevator links 560. The elevator links 560 are pivoted relative to the top drive to pick up a second tubular section 750 (shown in FIG. 25) using the first elevator 600. As described above in relation to the second elevator 700 closing to pick up the first tubular section 650 at the lower surface of its upset portion (female threads) 655, the door portions 620A, 620B pivot around the supporting portion 610 of the first elevator 600 to close around the second tubular section 750 below the female threads 755. The top drive is then moved upward to cause the first elevator 600 to engage the lower surface of the female threads 755 and lift the second tubular section 750 from the rig floor (or the rack, if the tubulars are located on a rack).

Figure 25:
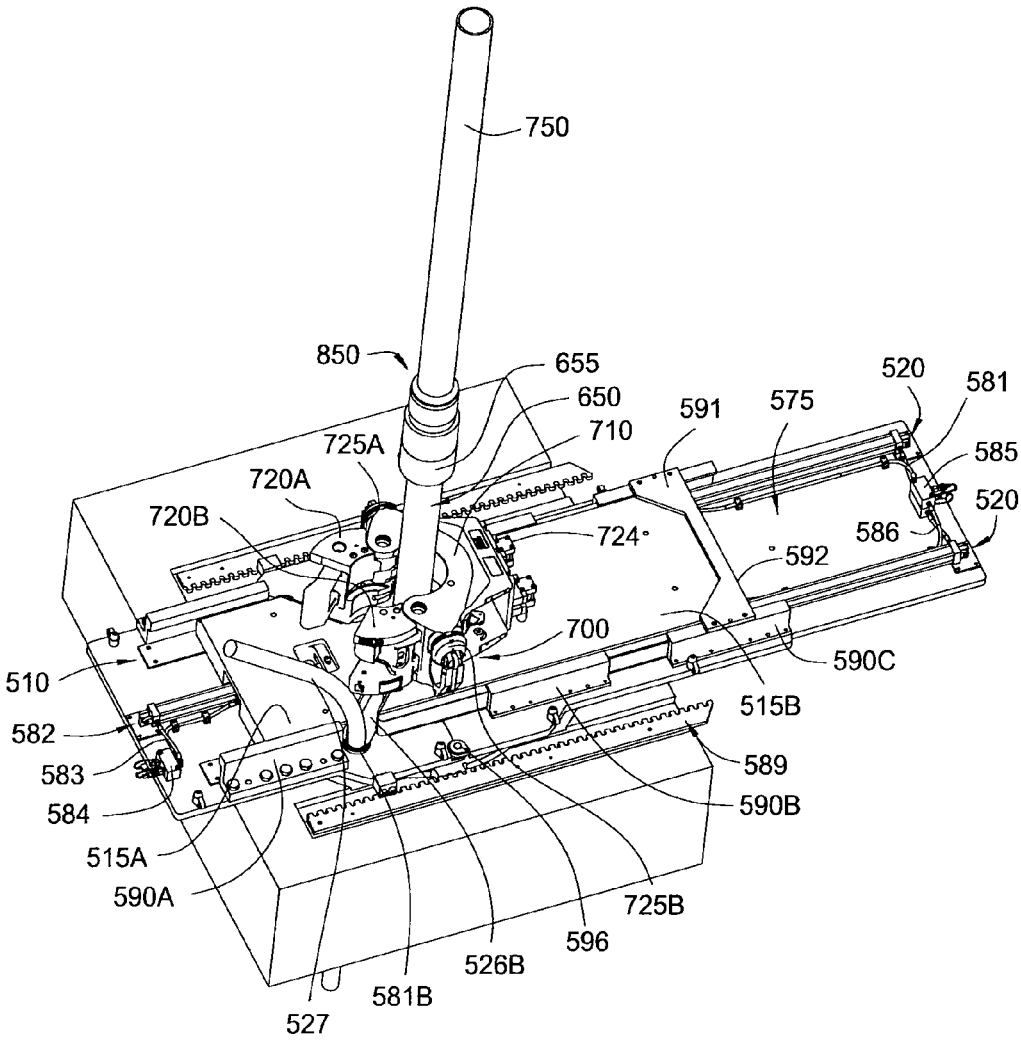
FIG. 25 shows the automated false rotary table of FIG. 20, with the first elevator lifting a first tubular string formed by a second tubular section connected to the first tubular section. The second elevator is in the open position.

The second tubular section 750 is then pivoted relative to the top drive to a position substantially in line with the first tubular section 650 by de-activation of the piston/cylinder assembly (retraction of the piston within the cylinder) connected at one end to the top drive and at the other end to the elevator links 560. The top drive is then lowered along its tracks (thereby lowering the first elevator 600 and the second tubular section 750) until the male threads of the second tubular section 750 and the female threads 655 of the first tubular section 650 initially engage with one another. The threaded connection between the first and second tubular sections 650 and 750 is then made up by rotating the second tubular section 750 relative to the first tubular section 650. The top drive may rotate the elevator links 560 and connected first elevator 600 to make up the connection. FIG. 25 shows the made up connection between the first and second tubular sections 650 and 750. The tubular sections 650, 750 now form a first tubular string 850.

To allow lowering of the first tubular string 850 into the wellbore below the AFRT 510, the AFRT 510 is moved to the tubular running position to expose the hole 519 within the rig floor suitable for lowering tubulars therethrough. Before moving the sliding plates 515A, 515B into the tubular running position, the top drive moves upward to lift the coupling of the first tubular string 850 from the second elevator 700. The door portions 720A, 720B are then pivoted radially outward relative to the supporting portion 710 of the second elevator 700 to disengage the second elevator 700 from the first tubular string 850, as shown in FIG. 25.

Figure 26:
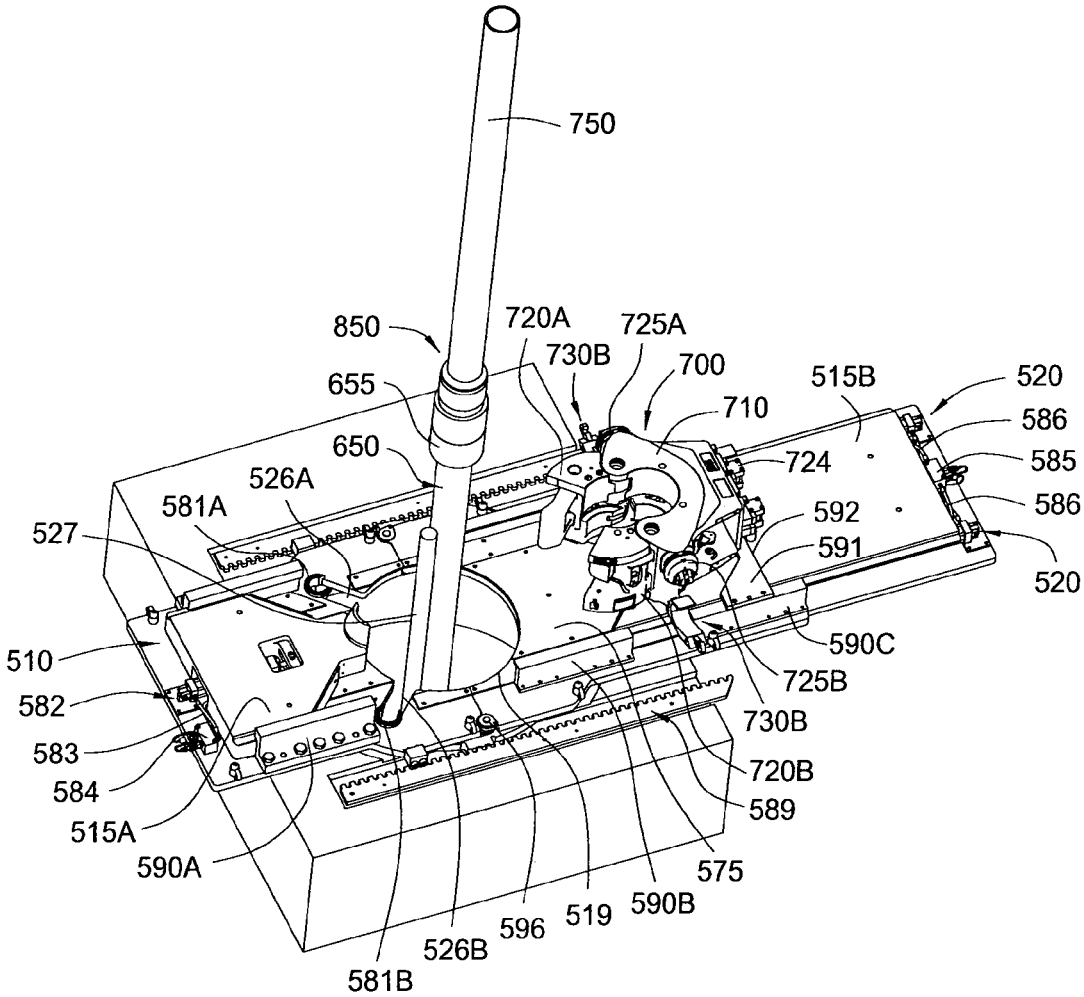
FIG. 26 shows the automated false rotary table moved to the tubular-running position shown in FIG. 20. The second elevator is moved to a position away from a hole in the automated false rotary table into which tubulars are run.

The tubular running position of the AFRT 510 is then achieved by reducing or halting power through the power communication assemblies 583, 586 to the tracks 582, 520, respectively, so that the first and second sliding plates 515A, 515B slide outward, away from each other, to the position shown in FIG. 26. In the position shown in FIG. 26, the second elevator 700 is moved out of the way from the tubular running operation by sliding with the second sliding plate 515B to allow the coupling of the first tubular string 850 to be lowered through the hole 519 without obstruction by the second elevator 700 (which has a smaller inner diameter than the outer diameter of the coupling).

Figure 27:
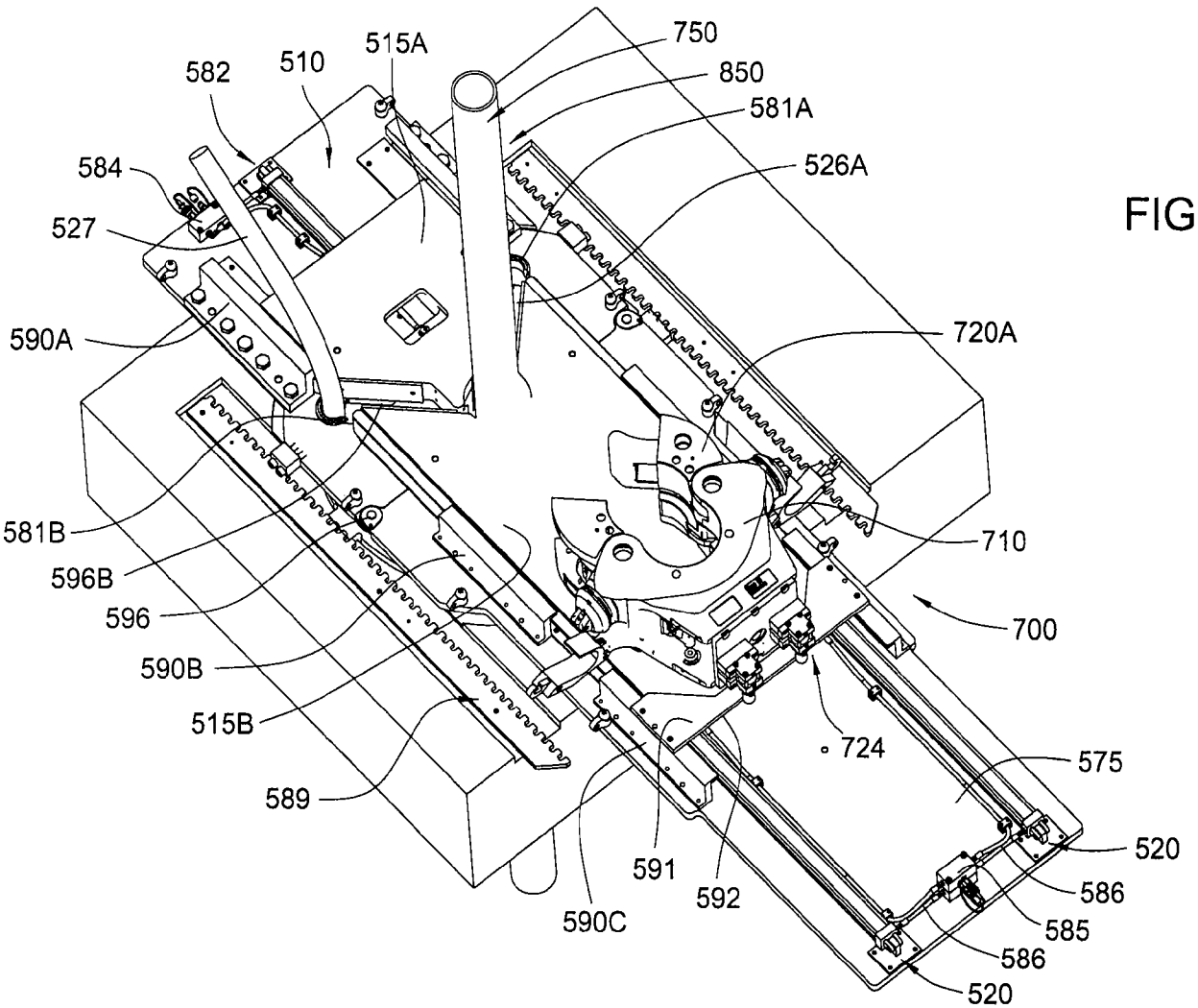
FIG. 27 shows the automated false rotary table of FIG. 20 in the tubular-running position of FIG. 26. The tubular string is lowered through the hole.

The top drive is then moved downward to lower the first tubular string 850 into the wellbore through the hole 519 at least until the coupling is located below the hole 519. With a portion of the first tubular string 850 remaining at a height above the sliding plates 515A, 515B, the sliding plates 515A, 515B are again moved inward towards one another by activation of the power supplies to the tracks 520, 582. Before sliding the sliding plates 515A, 515B into the tubular landing position, the second elevator 700 is locked into its position on the AFRT 510 using the assembly 724, as described above. The AFRT 510 is moved to this tubular landing position again to land a further tubular section on the guide 580. The first tubular string 850 lowered through the hole 519 and the AFRT 510 moved to the tubular landing position is shown in FIG. 27.

Figure 28:
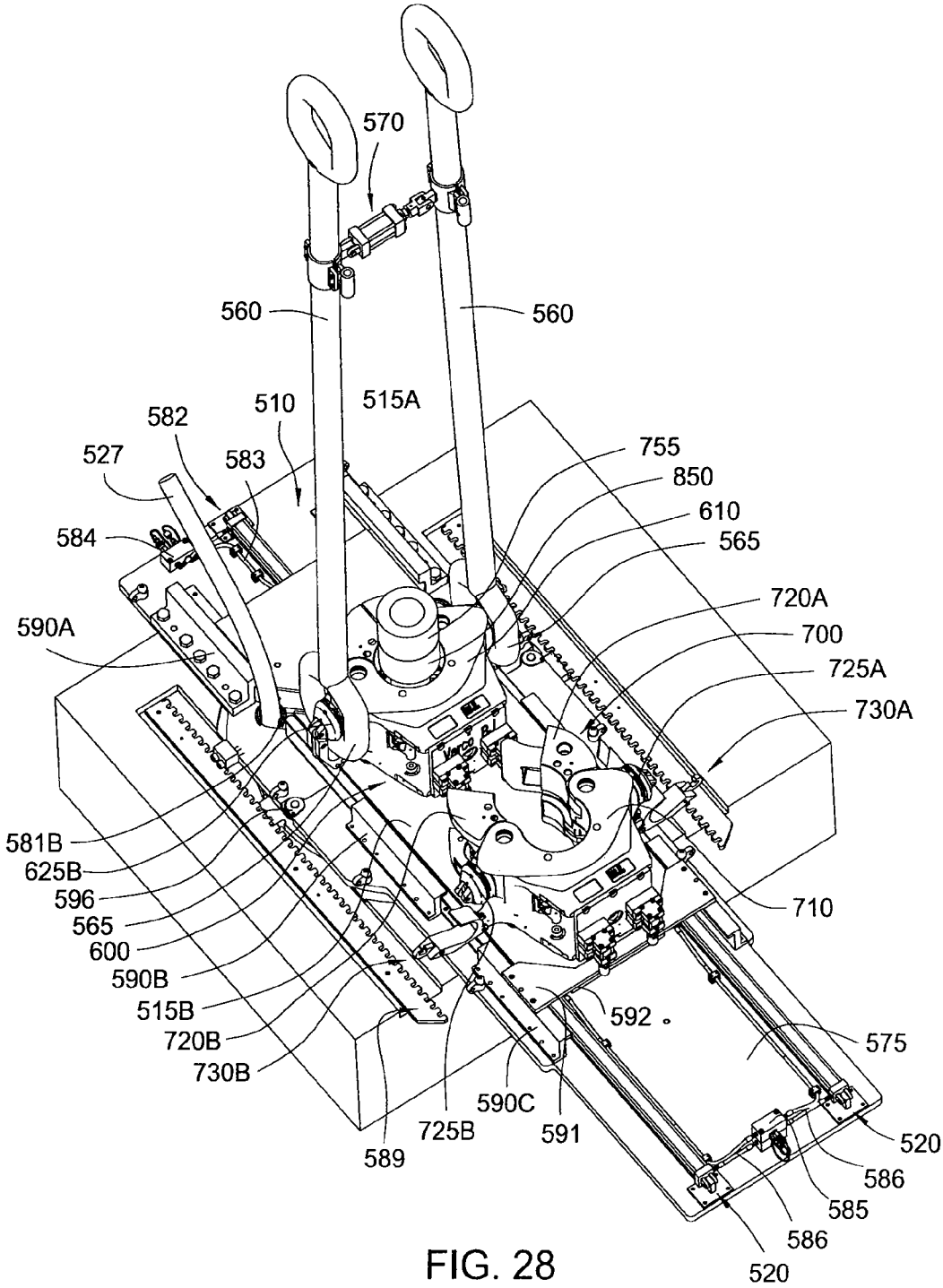
FIG. 28 shows the automated false rotary table of FIG. 20 moved to the tubular-landing position shown in FIG. 21. The first elevator having a tubular therein is in position to land on the automated false rotary table.
Figure 28A:
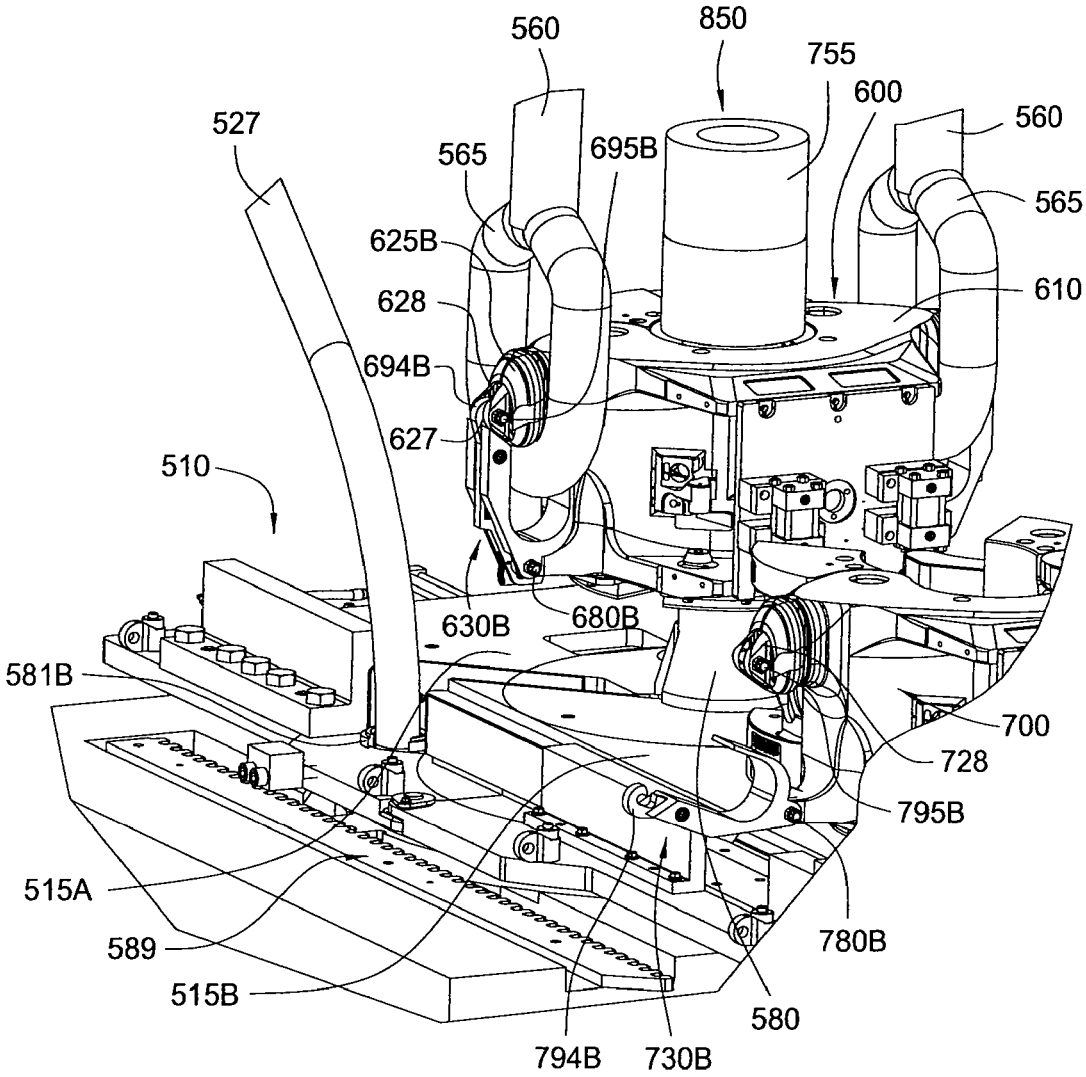
FIG. 28A is a section view of a portion of the first elevator in the position shown in FIG. 28.

After the AFRT 510 is placed in the tubular landing position, the first elevator 600 is lowered onto the guide 580 on the AFRT 510 by moving the top drive downward along its tracks. FIGS. 28 and 28A show the first elevator 600 lowering onto the guide 580 prior to landing the first elevator 600 into contact with the AFRT 510. At this point in the operation, the elevator link retainer assemblies 630A, 630B remain in the locked position.

Figure 29:
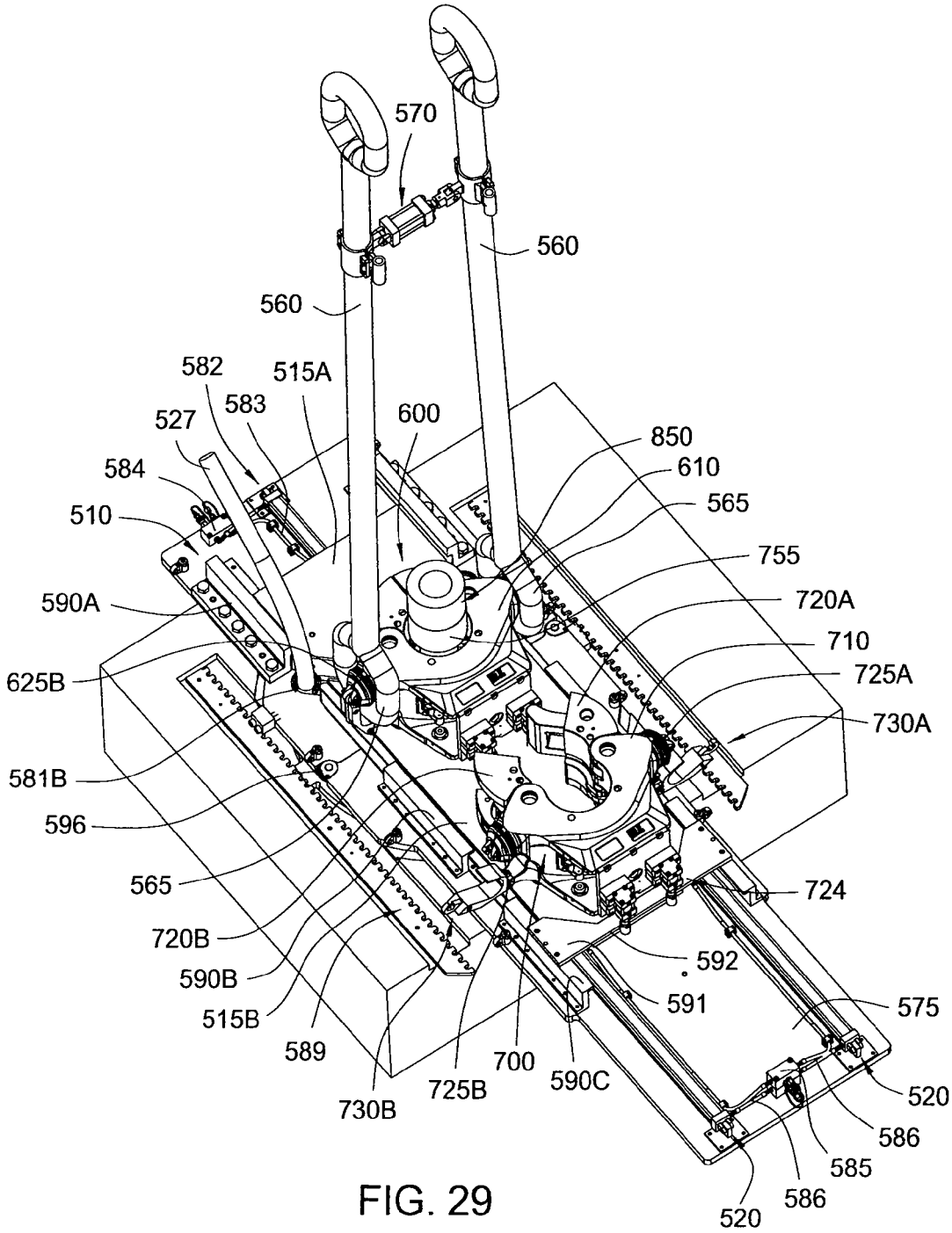
FIG. 29 shows the automated false rotary table of FIG. 20 in the tubular-landing position, with the first elevator landed on the automated false rotary table.
Figure 29A:
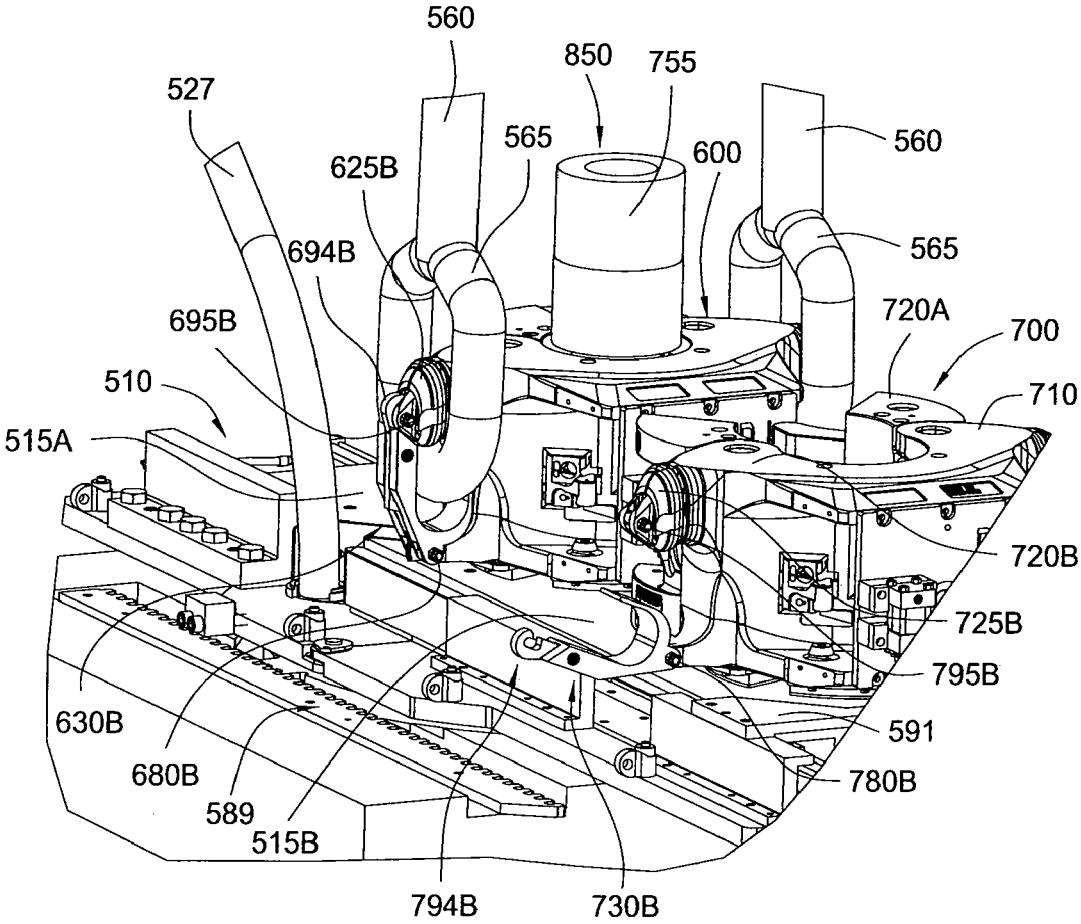
FIG. 29A is a section view of a portion of the first elevator in the position shown in FIG. 29.

Upon landing the first elevator 600 on the AFRT 510, the elevator link retainer assemblies 630A, 630B are unlocked because the hooks 694A, 694B move upward out of engagement with the pins 695A, 695B. FIGS. 29 and 29A illustrate the first elevator 600 landed on the AFRT 510 and the elevator links 560 unlocked from their engagement with the lifting ears 625A, 625B (unlocked, closed position).

Figure 30:
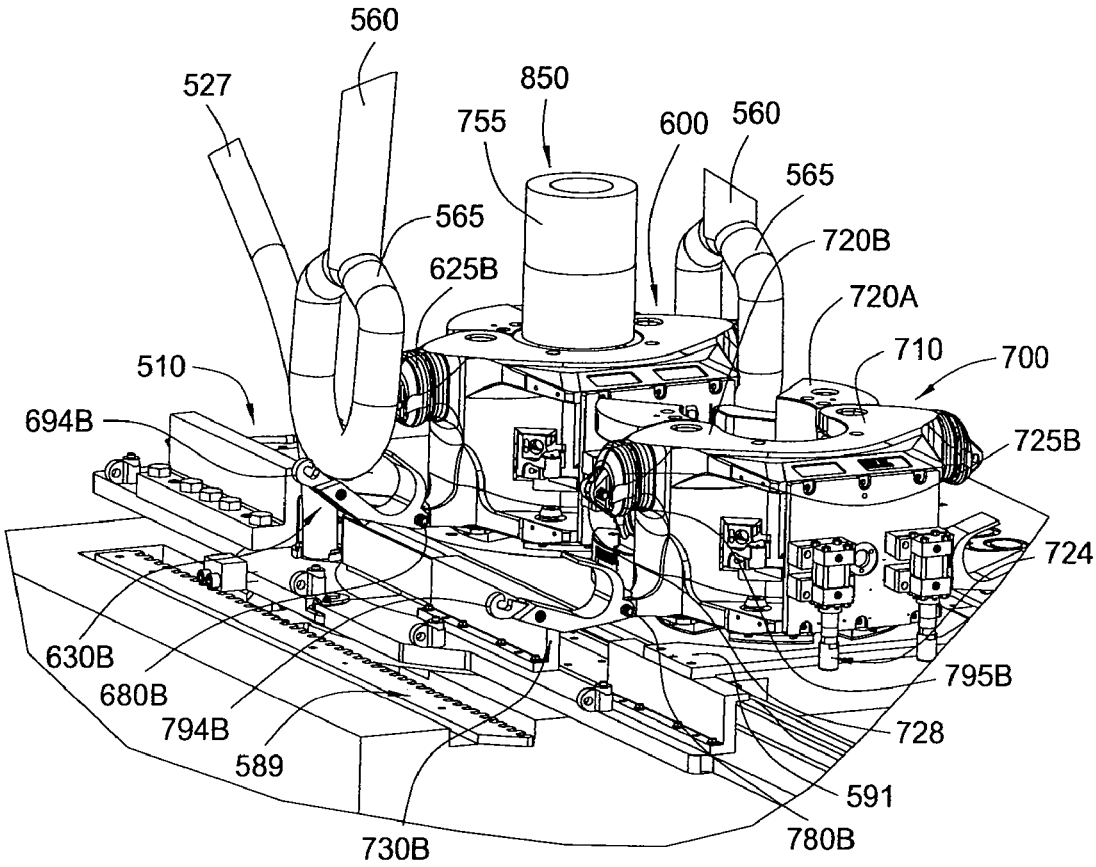
FIG. 30 shows the first elevator on the automated false rotary table of FIG. 20 having the elevator link retainer assemblies in the open position. The elevator links are in position to move the elevator link retainer assemblies on the first elevator to the closed position to retain the elevator links therein.
Figure 31:
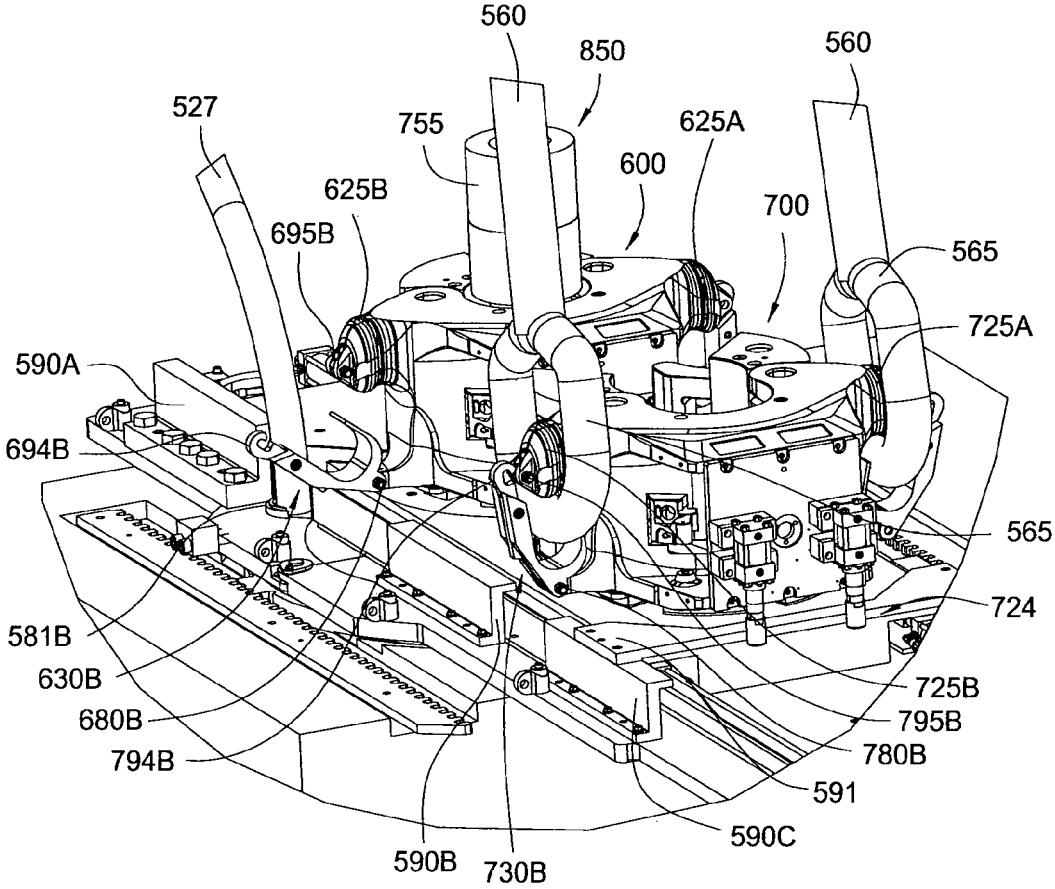
FIG. 31 shows the first and elevators on the automated false rotary table of FIG. 20, with the elevator links in the process of moving the elevator link retainer assemblies of the second elevator into the closed, retaining position.
Figure 32:
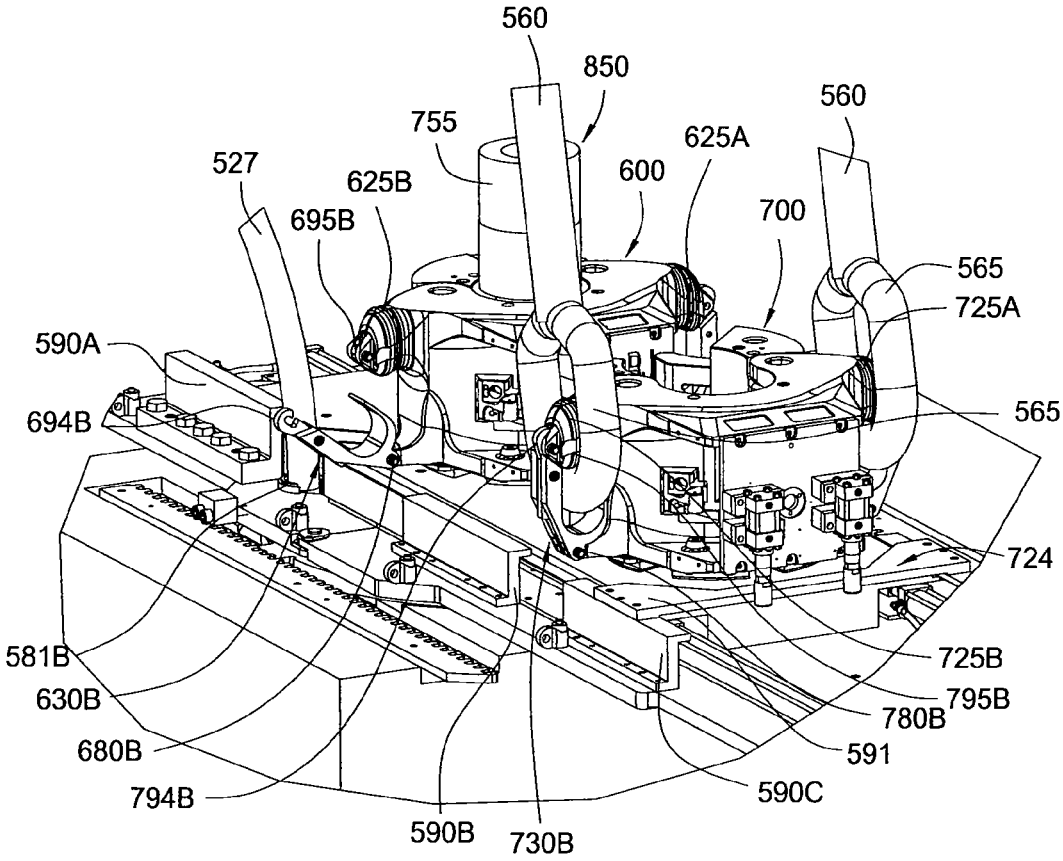
FIG. 32 shows the second elevator on the automated false rotary table of FIG. 20 being lifted from the automated false rotary table to lock the elevator link retainer assemblies into the locked, closed, link-retaining position.

The elevator links 560 are then spread outward by the link spreader 570, as described above, to pivot the elevator link retainer assemblies 630A, 630B relative to the remainder of the first elevator 600, as shown in FIG. 30. The elevator links 560 may then be pivoted relative to the top drive so that the elevator link retainers 565 may again be used to pick up the second elevator 700 by its lifting ears 725A, 725B to begin a second tubular-makeup operation. FIG. 31 shows the elevator link retainers 565 pivoting the elevator link retainer assemblies 730A, 730B inward to close the elevator link retainers 565 around the lifting ears 725A, 725B. As described above, the second elevator 700 is then lifted by the elevator links 560, as shown in FIG. 32, thereby forcing the hooks 794A, 794B over the pins 795A, 795B to lock the elevator link retainers 565 around the lifting ears 725A, 725B. The process described above may be repeated using the second elevator 700 and an additional tubular section to add the tubular section to the tubular string 850.

FIGS. 20-32 show an additional, optional feature of this second embodiment of the present invention. A control line 527 may be placed on the tubular sections 650 and 750 while the tubular landing, makeup/breakout, and running operation is occurring. The control line 527 is located within the control line guide 581B (optionally, there may also be a control line located within the control line guide 581A) during most of the operation, as illustrated in FIGS. 22-25, so that the control line 527 does not get in the way of the elevator landed on the guide 580. When neither elevator is located on the guide 580*r*, as shown in FIG. 26, and when the AFRT 510 is in the tubular running position, the control line 527 is moved into the hole 519 by way of the control line passage 526B (when the optional second control line is also placed on the tubular, it may be moved through control line passage 526A or through the same control line passage 526B into the hole 519). As the tubular string 850 is lowered into the wellbore, the control line 527 may be secured to the tubular string 850 above or below the rig floor. FIG. 26 shows the control line 527 secured to the tubular string 850.

Before moving the elevator back to well center and after the coupling of the tubular string is lowered through the hole 519, the control line 527 is moved back into the control line guide 581B as shown in FIG. 27 to avoid its interference with the elevator. The control line passages 526A, 526B are especially useful when the AFRT 510 is in the tubular landing position and the elevator is landed on the guide 580, as shown in FIG. 28, to prevent damage to the control line 527 by the elevator, sliding plates 515A, 515B, or any other device.

While the above description describes addition of tubular sections 150, 250, 650, 750 to a tubular section or a tubular string previously disposed at the false rotary table 10, 510, a tubular string may also be added to the previously disposed tubular section or tubular string. The tubular string comprising more than one tubular section may be made up prior to the tubular handling operation, even away from the rig site.

The automated false rotary table 10, 510 and the functionally interchangeable elevators 100 and 200, 600 and 700 allow for completely automatic and remote operation of transferring elevator links 160, 560. The present invention advantageously allows for remote and automatic transferring and locking of elevator links 160 from one elevator to another. The present invention also allows for an automatic and repeatable cycling pipe handling operation. Thus, the tubular handling operation, including but not limited to moving the false rotary table to a position above the wellbore when desired away from its position above the wellbore when desired, moving the elevator from its position directly above the wellbore when desired, opening the elevator jaws or door portions, pivoting the elevator relative to the top drive to pick up or land pipe, and removing elevator links from engagement with the elevator, may be completed without human intervention. Furthermore, the tubular handling operation allows for support of high tensile loads with reduced or nonexistent damage to the tubular section being engaged while supporting the high tensile loads, due to the door-type elevators 100 and 200, 600 and 700 utilized in lieu of the slip-type elevators, and also due to the high load-bearing false rotary table 10, 510 used in combination with the interchangeable elevators 100 and 200, 600 and 700.

Although the above description primarily concerns making up threaded connections using the interchangeable elevators 100 and 200, 600 and 700 and the false rotary table 10, 510, the reverse process may be utilized to break out the threaded connection to remove one or more tubular sections or tubular strings from another tubular section or tubular string, using the remote and automated system described above. Furthermore, while the above description involves handling tubulars, the elevators 100 and 200, 500 and 600 and the false rotary table 10, 510 may also be utilized to handle other wellbore tools and components.

Instead of or in addition to using a top drive to provide rotational force to the tubular sections or strings, a tong may be utilized in making up or breaking out tubulars. In addition, any features of the above-described first embodiment and described variations thereof may be combined with any features of the above-described second embodiment and described variations thereof, and vice versa.

The elevator links 160, 560 and the link spreaders 170, 570 are described above in reference to their use to grab, movingly manipulate, and/or release elevators 100, 200, 600, 700 in a pipe handling operation. The elevator links 160, 560 and link spreaders 170, 570 are not limited to use with elevators, however, and may be utilized to grab, movingly manipulate, and/or release other mechanisms or structures associated with an oil field operation, including but not limited to swivels.

While the foregoing is directed to embodiments of the present invention, other and further embodiments of the invention may be devised without departing from the basic scope thereof, and the scope thereof is determined by the claims that follow.

The invention claimed is:

1. A false rotary table disposed above a rig floor for use in handling tubulars, comprising:

a guide fixed to the rig floor;

a plate substantially parallel to the rig floor and movable along the guide as the plate moves towards and away from a well opening and, whereby the plate has a travel range sufficient to allow at least partial covering of the well opening in a first position and less covering of the well opening in a second position, wherein the plate comprises an upper surface to support an elevator and a pipe string in the first position and the plate comprises a hole configured to receive a tubular, wherein the hole includes at least one control line portion offset from a centerline of the hole and configured to receive a control line when the plate is in the first position; and an elevator retainer assembly attached to the guide, wherein the elevator retainer assembly is selectively activated in order to retain the elevator in a stationary position as the plate moves under the elevator to a position along the guide.

2. The false rotary table of claim 1, wherein the plate comprises two plates.

3. The false rotary table of claim 2, wherein the two plates comprise a split guide portion.

4. The false rotary table of claim 1, wherein the plate comprises a guide portion.

5. The false rotary table of claim 1, wherein the guide comprises a first track rail and a second track rail.

6. The false rotary table of claim 1, wherein the elevator includes a lock assembly that is movable from a locked position to an unlocked position when the elevator is placed on the substantially flat upper surface.

7. The false rotary table of claim 1, wherein the elevator retainer assembly includes a pin member that is configured to mate with a corresponding pin hole in the elevator.

8. The false rotary table of claim 7, wherein the elevator retainer assembly includes a cylinder member configured to move the pin member between a retracted position and an extended position.

9. The false rotary table of claim 1, wherein the hole includes a second control line portion offset from the centerline of the hole and configured to receive a second control line.

10. A method of handling tubulars, the method comprising:

supporting a string of tubulars using a first elevator;

moving a false rotary table to a tubular passing position;

passing a portion of the string of tubulars through the false rotary table;

moving the false rotary table to a tubular supporting position;

supporting the first elevator on the false rotary table;

attaching a tubular to the string of tubulars, wherein the tubular is supported by a second elevator; and releasing the first elevator from the string of tubulars and moving the first elevator with the false rotary table as the false rotary table moves to the tubular passing position.

11. The method of claim 10, further comprising moving the false rotary table to the tubular passing position to allow a portion of the tubular to pass through the false rotary table.

12. The method of claim 11, further comprising retaining the first elevator in a stationary position as the false rotary table moves to the tubular passing position.

13. The method of claim 11, further comprising moving the false rotary table to the tubular supporting position to allow the second elevator with the tubular and string of tubulars to be supported by the false rotary table.

14. The method of claim 13, further comprising removing the first elevator from the false rotary table to allow the first elevator to connect to a second tubular.

15. The method of claim 10, wherein the first elevator is supported by a substantially flat upper surface on the false rotary table.

16. A method of handling tubulars, the method comprising:

attaching a control line to a string of tubulars supported by a first elevator;

moving a false rotary table to a tubular passing position such that the control line is positioned within an elongated portion of a hole in the false rotary table and the string of tubulars is able to pass through the hole of the false rotary table;

moving the false rotary table to a tubular supporting position to support the first elevator with the attached string of tubulars, wherein the elongated portion is moved away from the control line;

attaching a tubular to the string of tubulars, wherein the tubular is supported by a second elevator; and releasing the first elevator from the string of tubulars to allow a portion of the tubular and string of tubulars to pass through the hole of the false rotary table.

17. The method of claim 10, further comprising attaching a control line to the string of tubulars supported by the first elevator.

18. The method of claim 17, wherein the control line is positioned within an elongated portion of a hole in the false rotary table in the tubular passing position.

19. The method of claim 18, wherein the elongated portion is moved away from the control line in the tubular supporting position.

* * * * *